US006644063B2

(12) United States Patent
Mogil

(10) Patent No.: US 6,644,063 B2
(45) **Date of Patent: *Nov. 11, 2003**

(54) DIVIDED INSULATED CONTAINER

(75) Inventor: Melvin S. Mogil, Toronto (CA)

(73) Assignee: California Innovations Inc., Willowdale (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,770

(22) Filed: Jun. 18, 2001

(65) Prior Publication Data

US 2001/0039807 A1 Nov. 15, 2001

Related U.S. Application Data

(63) Continuation of application No. 09/453,502, filed on Dec. 3, 1999, now Pat. No. 6,247,328, which is a continuation-in-part of application No. 09/323,202, filed on Jun. 1, 1999, now Pat. No. 6,234,677, which is a continuation-in-part of application No. 09/199,287, filed on Nov. 25, 1998, now Pat. No. 6,238,091, and a continuation of application No. 29/113,102, filed on Nov. 1, 1999.

(51) Int. Cl.[7] ..... F25D 3/08; B65D 30/08

(52) U.S. Cl. ..... 62/457.2; 383/110

(58) Field of Search ..... 62/457.2, 457.3; 220/592.23; 383/110, 111, 120

(56) References Cited

U.S. PATENT DOCUMENTS

| | | | | |
|---|---|---|---|---|
| 1,372,893 | A | | 3/1921 | Miller |
| 1,826,646 | A | | 10/1931 | Blake |
| 1,871,153 | A | | 8/1932 | Buchanan |
| 1,985,111 | A | | 12/1934 | Shofer et al. |
| 2,555,788 | A | | 6/1951 | Donaldson |
| 2,610,472 | A | | 9/1952 | Maxwell |
| 2,645,332 | A | | 7/1953 | Martin et al. |
| 2,770,275 | A | | 11/1956 | Suciu |
| 2,827,096 | A | * | 3/1958 | Hinson |
| 2,873,060 | A | | 2/1959 | Inman |
| 2,880,775 | A | | 4/1959 | Beattie |
| 3,255,607 | A | | 6/1966 | Bair et al. |
| 3,572,054 | A | | 3/1971 | Curcio |
| 3,998,072 | A | | 12/1976 | Shaw |
| 4,010,784 | A | | 3/1977 | Nattrass |
| 4,050,264 | A | | 9/1977 | Tanaka |
| 4,091,852 | A | | 5/1978 | Jordan et al. |
| 4,210,186 | A | | 7/1980 | Belenson |
| 4,260,004 | A | | 4/1981 | Domke |
| 4,286,440 | A | | 9/1981 | Taylor |
| 4,300,356 | A | * | 11/1981 | Notaro et al. ..... 62/48.1 |
| 4,334,601 | A | | 6/1982 | Davis |
| D273,533 | S | | 4/1984 | Weinreb |
| 4,468,933 | A | | 9/1984 | Christopher |
| 4,499,998 | A | | 2/1985 | Carlson |
| 4,499,999 | A | | 2/1985 | Behar |

(List continued on next page.)

FOREIGN PATENT DOCUMENTS

| | | |
|---|---|---|
| CA | 2149491 | 5/1995 |
| GB | 2 025 593 A | 1/1980 |

*Primary Examiner*—Chen-Wen Jiang
(74) *Attorney, Agent, or Firm*—Arent Fox Kintner Plotkin & Kahn, PLLC

(57) ABSTRACT

A portable soft sided insulated container has an impermeable liner that provides a liquid holding barrier. The liner is folded from a single monolithic plastic sheet to reduce or eliminate the need for heat welded seams. The liner seats within the container and has a releasable attachment around its lip for mating with the rim of the container. The container has an insulated lid so that the entire assembly may be closed. The liner can be removed for cleaning, or replacement if punctured. When not in use the entire assembly can be folded into a collapsed position for storage. The container has two storage chambers that share a common insulated dividing wall.

29 Claims, 48 Drawing Sheets

U.S. PATENT DOCUMENTS 4,506,769 A 3/1985 Franco et al.
4,509,645 A 4/1985 Hotta
4,521,911 A 6/1985 Vance
4,537,313 A 8/1985 Workman ..... 206/545
4,541,540 A 9/1985 Gretz et al. ..... 220/20
4,551,988 A 11/1985 Petrantoni
4,598,746 A 7/1986 Rabinowitz
4,610,286 A 9/1986 Cyr
4,655,052 A 4/1987 Garcia
4,673,117 A 6/1987 Calton
4,679,242 A 7/1987 Brockhaus
4,706,856 A 11/1987 Jacober
4,759,467 A 7/1988 Byrne
4,796,758 A 1/1989 Hauk
4,819,793 A 4/1989 Willard
4,858,444 A 8/1989 Scott
4,871,069 A 10/1989 Guimont
4,877,128 A 10/1989 Strickland
4,889,257 A * 12/1989 Steffes ..... 220/815
4,916,923 A 4/1990 Adams et al.
4,923,060 A 5/1990 Breslau
4,929,094 A 5/1990 Becker ..... 383/7
4,941,603 A 7/1990 Creamer et al.
4,974,966 A 12/1990 Fabbi
4,984,662 A 1/1991 Jacober
5,050,399 A 9/1991 Peahl
5,090,526 A 2/1992 Jacober ..... 190/107
5,095,718 A 3/1992 Ormond et al.
D328,550 S 8/1992 Mogil
5,149,203 A 9/1992 Sacks
D340,387 S 10/1993 Melk
5,313,807 A 5/1994 Owen
5,328,265 A 7/1994 Clooney
5,354,131 A 10/1994 Mogil
5,356,004 A 10/1994 Wienreb
5,400,610 A 3/1995 Macedo ..... 62/130
5,403,095 A 4/1995 Melk ..... 383/110
5,421,172 A * 6/1995 Jones ..... 62/457.5
5,472,279 A 12/1995 Lin ..... 383/2
5,490,396 A 2/1996 Morris
5,501,338 A 3/1996 Preston ..... 206/545
5,505,307 A 4/1996 Shink
5,526,907 A 6/1996 Trawick et al.
D373,515 S 9/1996 Melk
5,562,228 A 10/1996 Ericson ..... 220/415
D375,835 S 11/1996 Christopher et al.
D382,771 S 8/1997 Mogil
D382,772 S 8/1997 Mogil
5,660,476 A 8/1997 DeCoster ..... 383/29
D387,249 S 12/1997 Mogil
D389,704 S 1/1998 Yousko et al.
5,718,124 A 2/1998 Senecal
5,820,268 A 10/1998 Becker et al.
5,842,571 A 12/1998 Rausch ..... 206/549
5,857,778 A 1/1999 Ells ..... 383/5
5,865,314 A 2/1999 Jacober ..... 206/570
5,904,230 A 5/1999 Peterson
5,924,303 A 7/1999 Hodosh ..... 62/457.4
D414,379 S 9/1999 Haberkorn
5,974,826 A * 11/1999 Baldwin et al. ..... 62/457.2
6,015,072 A * 1/2000 Young ..... 224/153
6,105,844 A * 8/2000 Walters et al. ..... 224/610
6,179,182 B1 1/2001 Hayes
6,234,677 B1 5/2001 Mogil
6,238,091 B1 5/2001 Mogil
6,247,328 B1 6/2001 Mogil
6,264,084 B1 7/2001 Hayes

* cited by examiner

DIVIDED INSULATED CONTAINER

This application is a continuation of U.S. patent application Ser. No. 09/453,502, filed Dec. 3, 1999, now U.S. Pat. No. 6,247,328 which is a continuation-in-part of U.S. patent application Ser. No. 09/323,202, filed Jun. 1, 1999, now U.S. Pat. No. 6,234,677 which was itself a continuation-in-part of U.S. patent application Ser. No. 09/199,287, filed Nov. 25, 1998, now U.S. Pat. No. 6,238,091 and a continuation of U.S. Design patent application Ser. No. 29/113,102, filed Nov. 1, 1999.

FIELD OF THE INVENTION

This invention relates to the field of soft sided insulated containers. In particular it relates to soft sided insulated containers having a division between zones to permit different environments to be established in the different zones.

BACKGROUND OF THE INVENTION

In recent times, soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, pop, juices and milk. The containers are typically made in a generally cube like shape, whether of sides of equal length or not, having a base, four upstanding walls, and a top. The top is generally a lid which opens to permit articles to be placed in, or retrieved from, the container.

It may also be that, along with objects to be carried in a chamber at one temperature, another type of food may also be desired, requiring a different environmental condition. For example, it may be inconvenient for persons going to a picnic to carry a different insulated container for each type of food. They may prefer a single container that permits more than one type of food to be carried. That is, it may be preferable to have one zone in the insulated container for a cold, or very cold item, such as ice cream, and another zone for cool items, such as fruit or drinks. Alternatively, one zone may contain canned drinks in ice, while another zone contains warm or hot foods such as pizza or hamburgers. Temperature is not the only determining factor. For example, while an ice filled zone may be damp inside, other objects, such as bread or some fruits and vegetables, may need a less moist environment.

It is not necessary that segregated containers for maintaining materials in a generally warm, hot, cool, or cold condition be placed side-by-side, but could be placed one above the other. Hard shell metal lunch boxes have a roughly semi-cylindrical upper portion that can be equipped with a clip to hold a flask in place. The lower portion of the hard shell metal container is then used to carry sandwiches or other food. Such a structure may tend not to have a partition to segregate temperature zones, and may tend to employ a relatively hard, sharp cornered enclosure that is not easily squeezed or collapsed, as may be desirable, and may tend not to have insulated walls.

In typical use, the upper portion of a metal lunch bucket is adapted to carry a drink container, such as a canned drink or cylindrical bottle, and the lower portion of the lunch bucket is used for carrying food, generally a sandwich, some fruit such as an apple, a banana or an orange, and possibly a container for a food such as apple sauce or pudding. An advantage of a lunch box having a lower portion, and upper portion, and a handle on the top of the upper portion, is that the food inside the lunch bucket may tend to be carried in the same orientation as it is packed. Carriage of a container of apple sauce (or soup) on its side may tend to lead to unhappy results if the lid of the soup container leaks.

In metal lunch boxes, the physical strength of the lunch box is far beyond that required merely to carry a sandwich and a drink. Some metal lunch boxes have sufficient strength to support the weight of a person sitting on them. An advantage of such strength at a construction, mining, or forestry site, is that the metal lunch box may tend to resist being dented, and may provide protection for the kinds of insulated containers in which coffee, hot chocolate, soup or other liquid may be carried, as well as for sandwiches. This strength is well beyond the level of strength generally required for a school lunch box for students.

By contrast to metal lunch boxes, soft-sided, insulated lunch boxes tend to be sufficiently compliant to be crushed to a small size when empty, and are not intended to resist heavy blows from external objects. They are, moreover, clearly not intended to have the strength to support any significant portion of a person's weight. Some types of soft-sided food carrying cases tend to have box-like rectangular sides. These cases are placed on their largest side for loading and unloading. The opposite side is opened to permit food or other objects to be loaded, and once loaded, the case is lifted by a carrying strap attached to a pair of sides. When carried in this way, the food placed inside is immediately tipped over. This may tend to yield squashed sandwiches and crushed cookies. Placement of the handle on the large, or top, side tends to be cumbersome, and the top panel may tend not to have the body to resist bending, resulting in the vertical sides being pulled inward.

It is advantageous to have a lunch carrying sack or container having a pair of segregated chambers lying one above the other, such that the food may be carried in the same general orientation in which it is packed, and yet to employ insulated soft sides such that the container will tend not to damage objects it contacts, and may tend to keep food warm or cool as desired. A typical insulated panel has an inner skin, an outer skin, and a closed cell foam middle layer. Insulated panels tend to be able to retain their shape under modest loads. Rather than having the relatively cumbersome rectangular shape, a bucket having a lower portion, an upper, domed portion, and a handle running along the crest of the dome tends to have a tall, rather than wide or flat profile, and tends to reduce the width of the top panel. Further, forming the longitudinal member of the top panel on a pair of curved ends may tend to yield a structure that is stiffer than a flat panel, only modest strength being required for carrying a lunch.

SUMMARY OF THE INVENTION

In an aspect of the invention, there is a soft-sided insulated container assembly. It has a lower portion having a rectangular base having a pair of long edges and a pair of short edges. It has soft-sided insulated front and rear walls attached to, and extending upwardly from, the long edges, and soft-sided insulated end walls attached to, and extending upwardly from, the short sides. The front and rear walls and the end walls co-operate with the base to define the lower portion. An upper portion is mounted above the lower portion. The upper portion has a pair of end walls. Each of the end walls has a lower margin mounted adjacent to one of the end walls of the lower portion, and an upper edge. The upper edge has a downwardly concave arcuate profile, and a soft-sided insulated spanning wall extending between the end walls of the upper portion. The spanning wall conforms to the concave arcuate profile.

In an additional feature of that aspect of the invention, the front, rear and end walls of the lower portion have respective upper margins. The spanning wall of the upper portion has front and rear lower margins. The lower portion is joined to the upper portion by a hinge. The hinge is connected to the upper margin of the rear wall of the lower portion and to the rear lower margin of the spanning wall of the upper portion.

In another additional feature of that aspect of the invention, the container has a center of gravity and has a suspension member attached thereto at a location above the center of gravity whereby, when carried by the suspension member, the lower portion will hang below the upper portion.

In still another additional feature of that aspect of the invention, the spanning wall has a crest, and the container has a handle mounted along the crest, whereby, when carried by the handle, the lower portion is below the upper portion.

In an aspect of the invention, there is a soft sided, collapsible, insulated container assembly. It has a first soft-sided insulated container portion, a second soft sided container portion and a common wall shared between those first and second portions. The first container portion has an insulated wall structure and a first chamber defined therewithin. The second container portion has an insulated wall structure and a second chamber defined therewithin. The common wall segregates the first and second chambers from each other. The first chamber is maintainable at a different environmental condition from the second chamber.

In an additional feature of that aspect of the invention, one of the insulated container portions has a liner for containing liquids mounted within its respective chamber. In another additional feature, both of the insulated container portions have liners for containing liquids therein. In a further additional feature, the liner has a lowest extremity and an upper lip, and the liner is seamless to a depth of at least half the height from the lowest extremity to the upper lip. In a further additional feature, the liner is removable from its respective chamber. In a still further additional feature, the container has a partition member mounted within the liner. In an additional feature of that additional feature, the partition member includes a stiffening element. In another additional feature of that additional feature, the partition includes a thermally insulative layer for discouraging heat transfer through the partition. In still another additional feature, the liner has a fitting for engaging the partition, and the partition is movable to a plurality of positions in engagement with the fitting. In still yet another additional feature, the respective chamber has a plan form section, the partition is moveable to lie in a horizontal orientation relative to the chamber, and, in that horizontal position, the partition has a shape to match the plan form section.

In another aspect of the invention there is a soft sided insulated container assembly comprising a first insulated container portion, a second insulated container portion and a common wall shared between the first and second container portions. The first container portion has an insulated wall structure and a first chamber defined therewithin. The second container portion has an insulated wall structure and a second chamber defined therewithin. The common wall is located to segregate the first and second chambers from each other. The common wall has a hinge mounted along an edge thereof The hinge permits the first container portion to move relative to the second container portion. The first chamber is maintainable at a different environmental condition from that of the second chamber.

In an additional feature of that aspect of the invention, one of the insulated container portions has a liner for containing liquids mounted within its respective chamber. In another additional feature of that aspect of the invention, the common wall has a receptacle mounted thereto. The receptacle has an interior for receiving a thermal energy storage element. The receptacle has a vented portion to permit air from one of the chambers to communicate with the interior. In still another additional feature of that aspect of the invention, the container has a receptacle for receiving a thermal energy storage element. The receptacle is mounted within one of the chambers, and a thermal energy storage element is mounted therein. In yet another additional feature of that aspect of the invention, the receptacle is mounted to the common wall.

In a further additional feature of that aspect of the invention the first chamber has an opening and the common wall is moveable from a first position closing the first chamber, to a second position permitting access to the chamber. The common wall has a periphery and a closure member mounted to at least a portion of the periphery and at least a portion of the opening of the first chamber. The closure member controls the opening of the common wall relative to the first chamber.

In a still further additional feature of that aspect of the invention the common wall is a partition member lying between the first and second chambers. The partition member has a closure member mounted thereto for controlling opening of the partition member relative to the second chamber. In yet another additional feature of that aspect of the invention the partition includes a thermally insulative layer for discouraging heat transfer through the partition. In a further additional feature of that aspect of the invention the partition has a receptacle mounted thereto for receiving a thermal energy storage element. The receptacle has venting oriented toward one of the first and second chambers, and, when a thermal storage element is mounted in the receptacle, air from the one chamber can communicate therewith through the venting.

In a still further additional feature of that aspect of the invention the first chamber is a lower chamber, the second chamber is an upper chamber, and the common wall is a partition located above the first chamber. The partition is moveable to open and close the first chamber. The common wall is a partition located below the second chamber. The partition is moveable to open and close the second chamber. The partition has an upper face upon which, in use, objects can rest. The receptacle has a lower face, and a receptacle mounted adjacent to the lower face. The receptacle is exposed to the first chamber. The partition has a peripheral wall extending about the upper face for discouraging the objects from being displaced from the upper face in use.

In another aspect of the invention there is a soft-sided container assembly. A first insulated wall structure has a primary chamber defined therewithin. A second insulated wall structure has a secondary chamber defined therewithin. The second insulated structure is removably locatable within the first insulated wall structure. The primary structure has a receptacle mounted therewithin for containing a thermal energy storage element. The receptacle is vented to permit air exchange between the first chamber and the receptacle.

In an additional feature of that aspect of the invention, the primary structure has a first portion, a second portion, and a closure member operable to permit the first portion to be displaced relative to the second portion, thereby giving access to a first volume defined within the first portion, and a second volume defined within the second portion. The primary structure has a divider mounted between the first and second portions. In a further additional feature of that aspect of the invention the divider is suspended between the first and second volumes, and has a receptacle mounted thereto for receiving a thermal energy storage element. In a still further additional feature of that aspect of the invention, the divider is releasably attachable to the primary structure along at least a portion thereof. The divider is moveable between an open position for facilitating access to the second volume.

In yet another additional feature of that aspect of the invention, the first portion is a lower portion of the structure having a rectangular base wall and an upstanding wall having front, rear, left and right hand side portions extending upwardly of the base. The second portion is an upper portion having a pair of ends and a longitudinal member extending between the ends. The longitudinal member has a lower rear edge. The upper portion is hingedly attached to an upper edge of the rear side portion and to the lower rear edge of the longitudinal member. The primary structure includes a divider suspended between the first and second portions. The divider is moveable to facilitate access to the first portion. The divider has the receptacle mounted in a suspended position relative thereto.

In another additional feature of that aspect of the invention the first and second insulated wall structures are attachable to each other to discourage relative movement therebetween in use.

In another aspect of the invention there is a soft sided insulated container assembly. A first soft-sided insulated wall structure has a rectangular base, and rectangular sides extending upwardly from the rectangular base. The first insulated wall structure has a first insulated chamber defined therewithin. A second soft-sided insulated wall structure has a pair of end walls. The end walls have upper margins defining a lid contour, and a longitudinal wall extending between the end walls and conforming to the lid contour. The second insulated wall structure defines a second insulated chamber therewithin. The second insulated wall structure is locatable above the first insulated wall structure. An insulated divider is mounted between the first and second insulated wall structures to segregate the first chamber from the second chamber.

In an additional feature of that aspect of the invention the second soft-sided insulated wall structure is pivotally mounted relative to the first soft-sided insulated wall structure. In another additional feature of that aspect of the invention the end walls have respective first and second lower margins. The longitudinal panel has a front lower margin and a rear lower margin. The first, second, front and rear margins define an opening of the second chamber. In still another additional feature of that aspect of the invention the assembly has a hinge mounted to the rear lower margin and a closure mounted to the divider and to the first, second and front margins. The closure member is operable to permit the second chamber to be opened relative to the divider. In still yet another additional feature of that aspect of the invention the divider has a receptacle mounted thereto, and a thermal energy storage element mounted therein. In a further additional feature of that aspect of the invention the divider has an upwardly facing surface and a peripheral retainer mounted to the upwardly facing surface.

In another aspect of the invention, there is a soft sided insulated container assembly. There is a first soft-sided insulated wall structure. A second soft-sided insulated wall structure has a pair of end walls. The end walls have upper margins defining a lid contour, and a longitudinal wall extending between the end walls and conforming to the lid contour. The second soft-sided insulated wall structure is locatable above the first soft-sided insulated wall structure. The first and second soft-sided insulated wall structures co-operate to define a first chamber therewithin. A closure member is mounted to the first and second soft-sided insulated wall structures. The closure member is operable to permit displacement of the first soft-sided insulated wall structure relative to the second soft-sided insulated wall structure to give access to the first chamber. A third soft-sided insulated wall structure defines a second chamber therewithin. The third soft-sided insulated wall structure has a closure member operable to give access to the second chamber. The third soft-sided insulated wall structure is locatable within the first chamber. The third soft-sided insulated wall structure is removable from within the first chamber.

In an additional feature of that aspect of the invention, the first soft-sided insulated wall structure has a rectangular base, and rectangular sides extending upwardly from the rectangular base. The longitudinal wall has a crest along the uppermost portion thereof. The assembly has a suspension member mounted thereto by which the assembly can be carried, and, when carried by the suspension member, the crest is above the base.

In another additional feature of that aspect of the invention, the suspension member is chosen from the set of suspension members consisting of a handle mounted to the longitudinal member and a carrying strap mounted to the second soft-sided insulated wall structure. In a further additional feature of that aspect of the invention, the third soft-sided insulated structure has a releasable attachment element operable to discourage motion of the third soft-sided insulated wall structure relative to the chamber when mounted therewithin. In still another additional feature of that aspect of the invention, the releasable attachment element is a hook-and-eye fabric strip. The chamber has an internal wall, and the internal wall has a mating hook-and-eye fabric strip mounted thereto.

In yet another additional feature of that aspect of the invention, the first soft-sided insulated wall structure defines a first portion of the first chamber, and the second soft-sided insulated wall structure defines a second portion of the first chamber, and the third soft-sided insulated wall structure is mountable within the first portion of the first chamber.

In another additional feature of that aspect of the invention, the first soft-sided insulated wall structure has an upper peripheral margin. The second soft-sided insulated wall structure has a lower peripheral margin. The first and second soft-sided insulated wall structures are joined by a hinge mounted along respective portions of the upper peripheral margin and the lower peripheral margin. The hinge is operable to permit pivotal motion of the second soft-sided insulated wall structure relative to the first soft-sided insulated wall structure in the manner of a hinged lid. The closure member is mounted to other respective portions of the upper and lower peripheral margins.

In still another additional feature of that aspect of the invention, the first chamber includes a first portion defined within the first soft-sided insulated wall structure, and a second portion defined within the second soft-sided insulated wall structure. A flap is suspended between the first and second portions. The flap is moveable to facilitate access to at least one of the portions. In yet another additional feature of that aspect of the invention, the flap has a pocket mounted thereto and a thermal energy storage element contained therein.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION OF THE INVENTION

Figure 1:
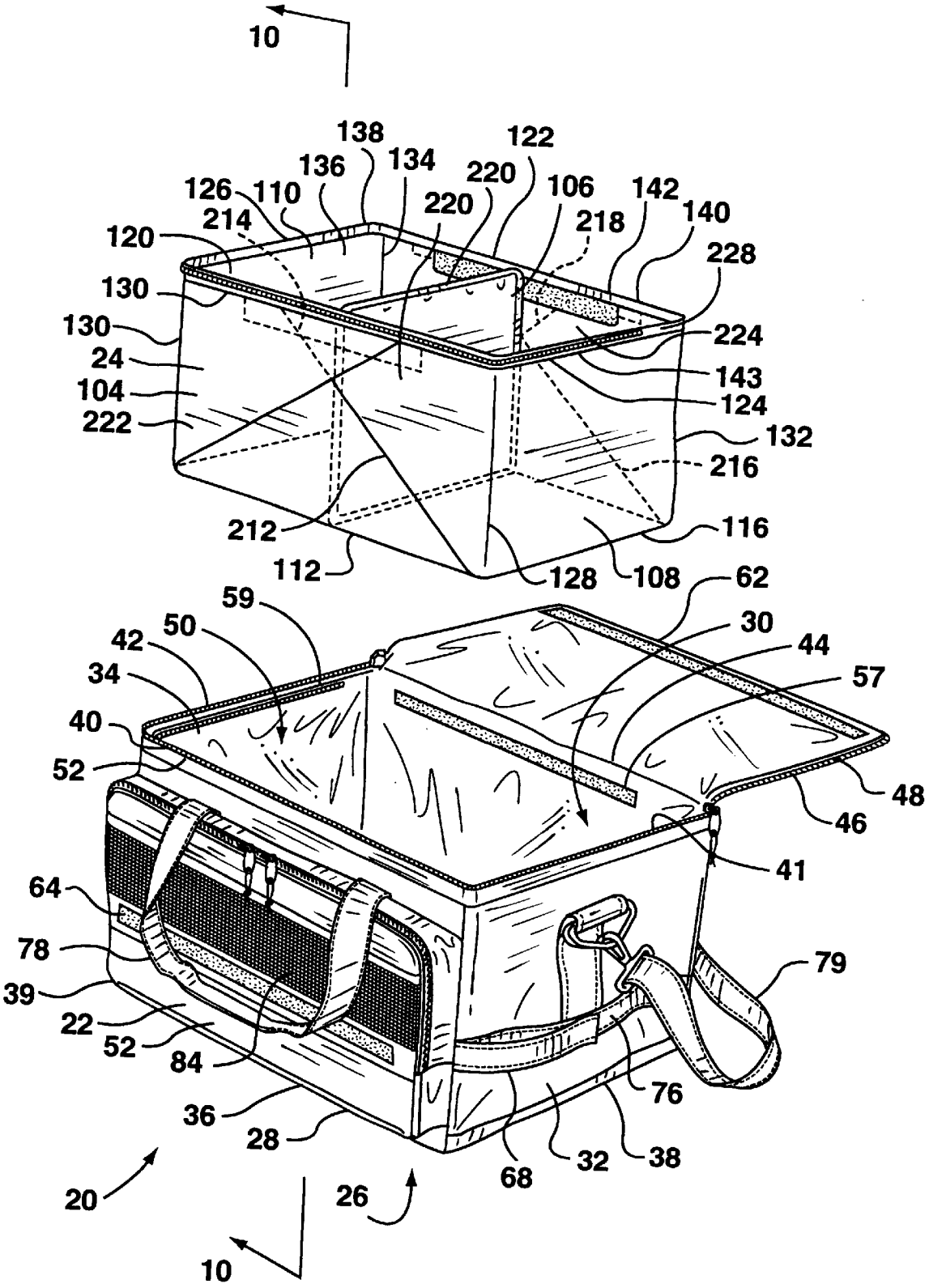
FIG. 1 is a three quarter view, general arrangement drawing of an insulated container and liner assembly according to the present invention.

The description which follows, and the embodiments described therein, are provided by way of illustration of an example of a particular embodiment, or examples of particular embodiments, of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
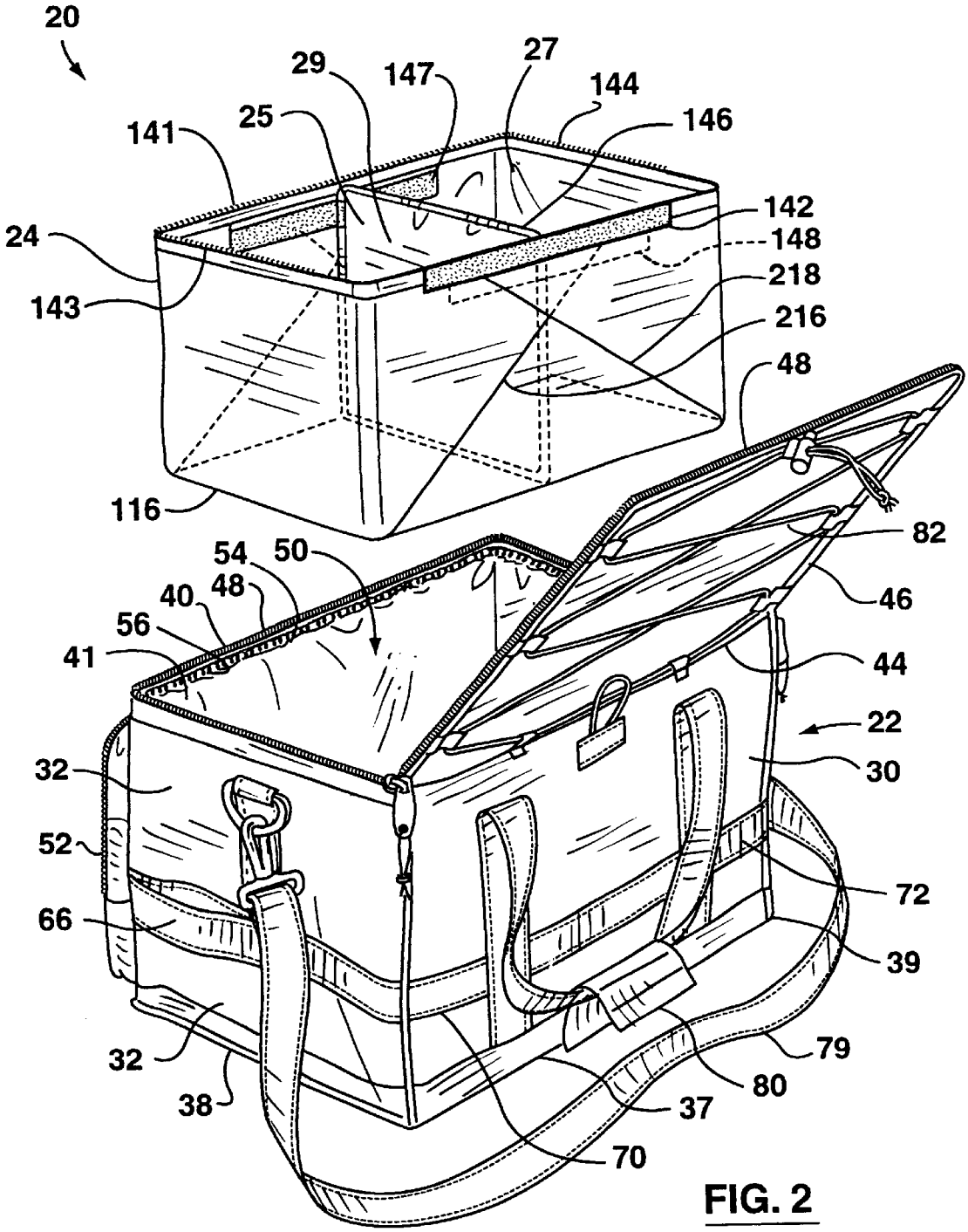
FIG. 2 is a view of the liner of FIG. 1 taken on an opposite angle.

Referring to the general arrangement illustrations of FIGS. 1 and 2, an example of an embodiment of an insulated container and liner assembly is indicated generally as 20. It has two major elements, those being an outer casing in the nature of a soft-sided insulated container 22, and a removable, impermeable liner 24 for placement inside container 22. An optional moveable bulkhead, or baffle, in the nature of a partition wall 25 seats within liner 24 for dividing the interior space into two sub-compartments 27, 29.

Looking at these major elements in detail, it can be seen that container 22 has a bottom 26, a front panel 28, a rear panel 30, and a pair of left and right hand side panels 32 and 34. In this embodiment the choice of front and rear, left and right, orientations is arbitrary. Each of front panel 28, rear panel 30, and left and right hand side panels 32 and 34 is joined at sewn seams to bottom 26 at bottom vertices 36, 37, 38, or 39 respectively. Similarly, front panel 28 and side panels 32 and 34 have top edges 40, 41 and 42, distant from their base edges. Rear panel 30 is joined by a folded hinge 44 at its top edge to a top panel in the nature of a lid 46. Lid 46 has a closure member in the nature of a zipper 48 extending in a U-shape around the three free edge portions of its periphery to mate with the other portions of zipper 48 positioned about the three top edges 40, 41 and 42 of panels 28, 32 and 34. Lid 46 is moveable between a closed position, in which zipper 48 may be zipped closed, and an open position in which lid 46 is folded back to permit entry and exit of objects to and from an internal cavity 50 defined between bottom 26 and panels 28, 30, 32 and 34. A generally rectangular insulated auxiliary pouch 52 is mounted to the front face of front panel 28.

In the preferred embodiment, lid 46 has an extent substantially equal to that of bottom panel 26. This need not be the case. Lid 26 could be a small opening set in a larger top panel, or could be an opening of half, or some other portion of the panel. The opening need not extend fully along three sides of lid 26, but could extend along part of one or two sides as may be found suitable in a particular use.

Top edges 40, 41, and 42 form the rim 54 of cavity 50. On the inside of rim 54 is a liner securing means, or liner attachment mounting, in the nature of a zipper 56, which, in the embodiment illustrated, includes portions 57, 58, and 59 mounted respectively to panels 28, 32, and 34 near their upper margins, and a hook and eye fabric fastener strip 60 mounted to panel 30. In an alternative embodiment all of strip portions 57, 58, 59 and 60 (or some other combination of them) could be hook-and-eye fabric fasteners. Other types of mounting could be used, in addition to zippers, such as interlocking seal strips, snaps, clips, grommets or other means.

Figure 7:
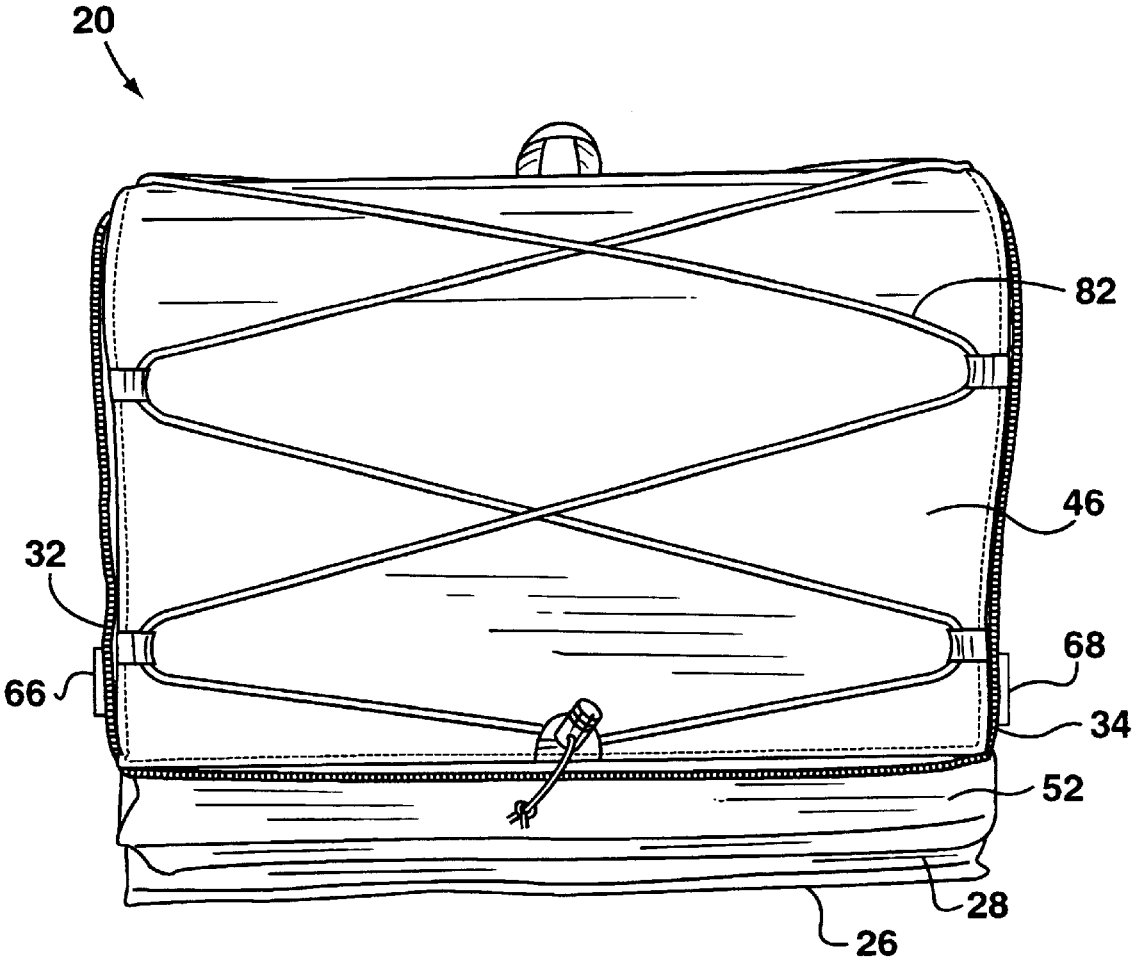
FIG. 7 is a front view of the assembly of FIG. 1 in a collapsed position.
Figure 8:
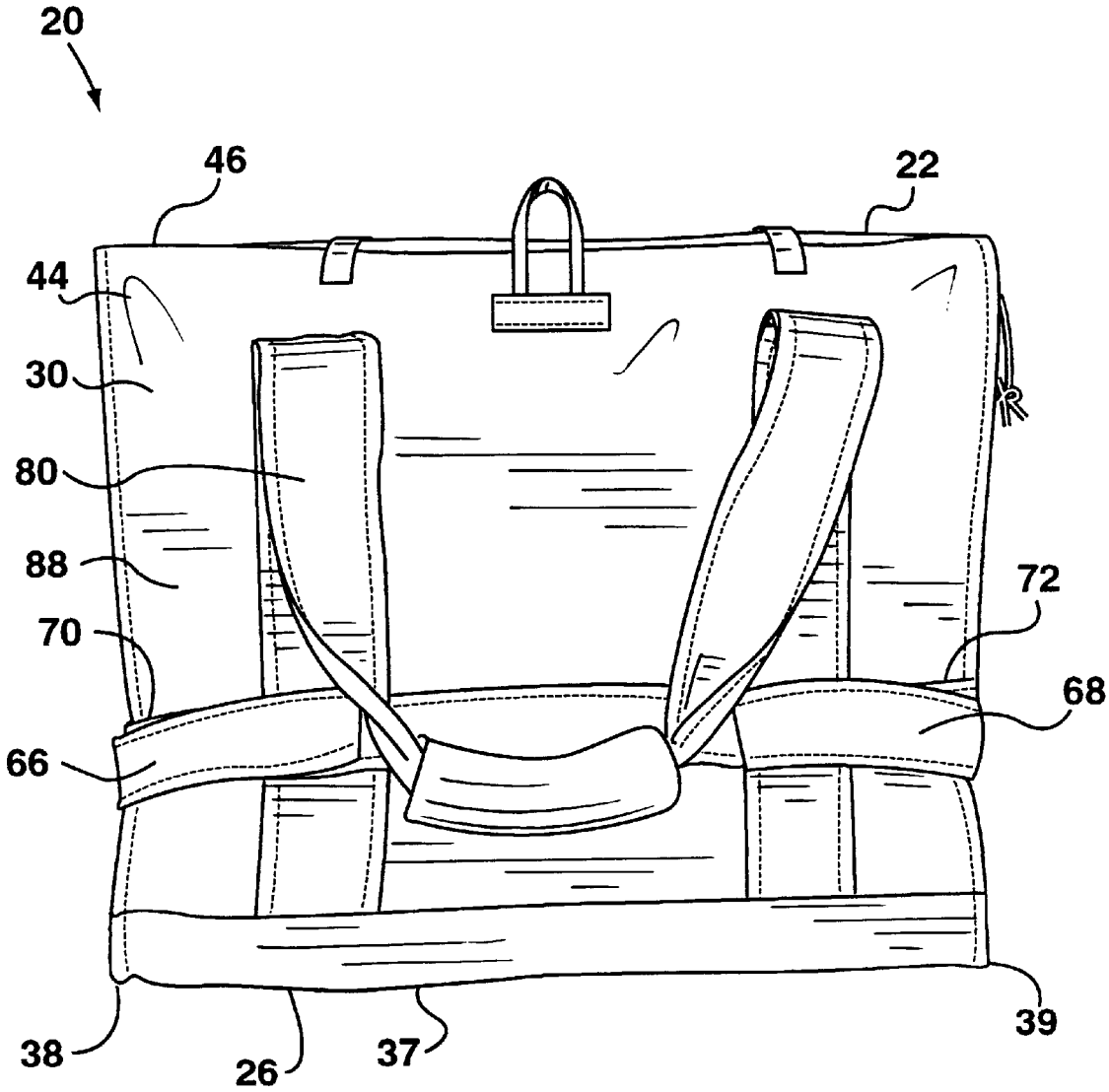
FIG. 8 is a rear view of the assembly of FIG. 1 in a collapsed position.
Figure 9:
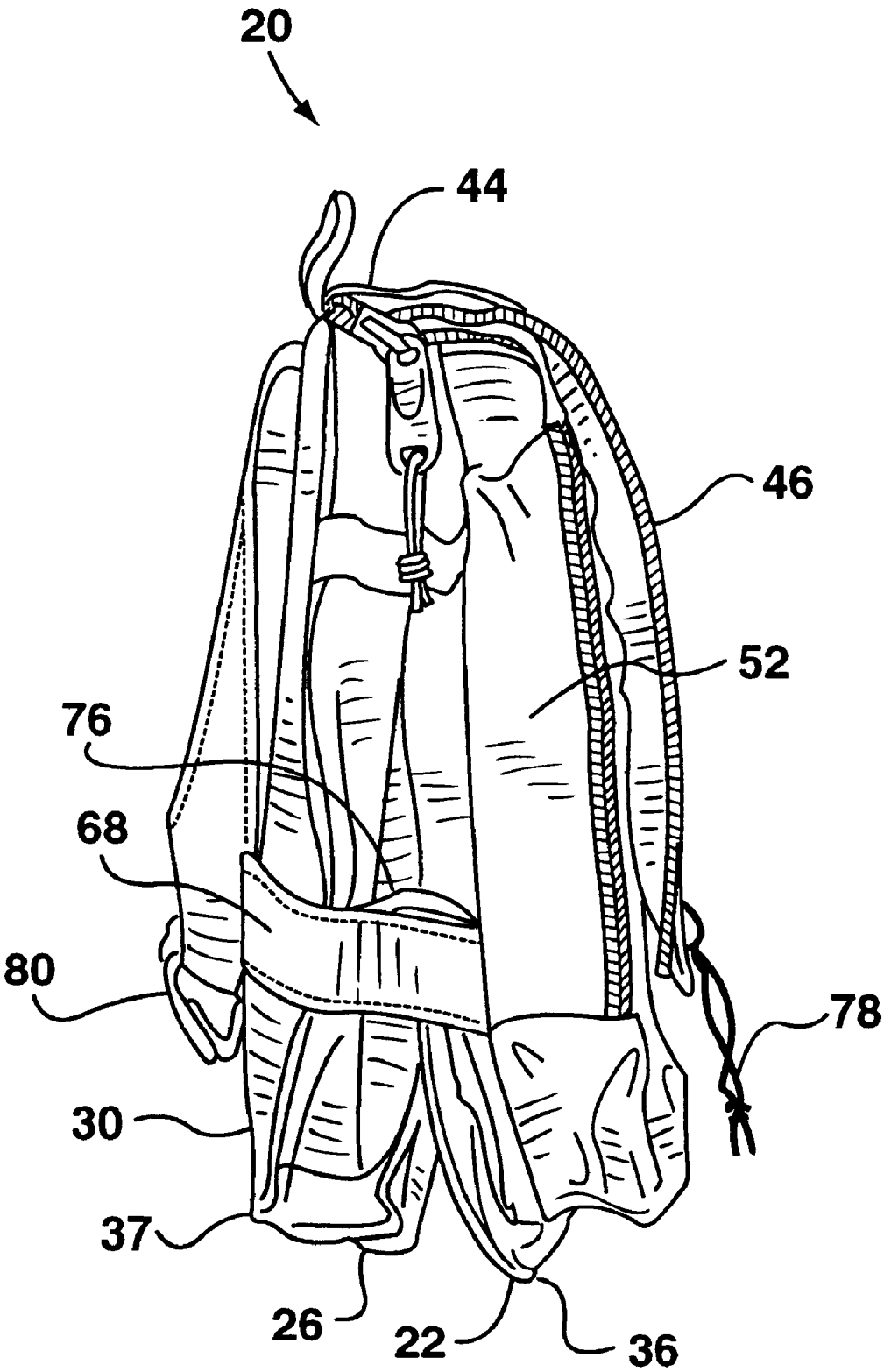
FIG. 9 is a side view of the assembly of FIG. 1 in a collapsed position.

Container 22, with liner 24 installed, can be folded to a collapsed position, as shown in FIGS. 7, 8 and 9. In this collapsed, or storage position, side panels 32 and 34 fold inward, and bottom 26 folds upward. This permits front panel 28 to move toward rear panel 30. Lid 46 is then drawn forward and downward in front of front panel 28 and auxiliary pouch 52. Lid 46 has, on its inner face, spaced inwardly from zipper 48, a retainer in the nature of another hook and eye fastener strip 62 that engages a mating hook and eye fastener strip 64 located on a lower portion of the front face of auxiliary pouch 52. In addition, left and right hand side retainers 66 and 68 mounted to the left and right hand edges of auxiliary pouch 52 of front panel 28 are drawn around to fasten to fastening strips 70 and 72 located on the outer, rearward face of rear panel 30. (When container 22 is in its open position, side retainers 66 and 68 engage storage strips 74 and 76 located on side panels 32 and 34 respectively).

Other features of container 22 are visible in FIGS. 1 and 2. Front and rear carrying handles 78 and 80 with reinforced bails are attached to both front panel 28 and rear panel 30 to permit two people to carry assembly 20 between them. Assembly 20 has a maximum capacity of 24 quarts. Smaller embodiments include a twelve quart container. A single shoulder strap 79 is attached to side panels 32 and 34. An elasticized retaining matrix 82 permits other materials, such as cups, plates, serving utensils or other objects to be carried on top of assembly 20. Above strip 64, auxiliary pouch 52 has a see-through mesh pocket 84, such as may be convenient for carrying knives, forks, spoons or other objects.

Figure 10:
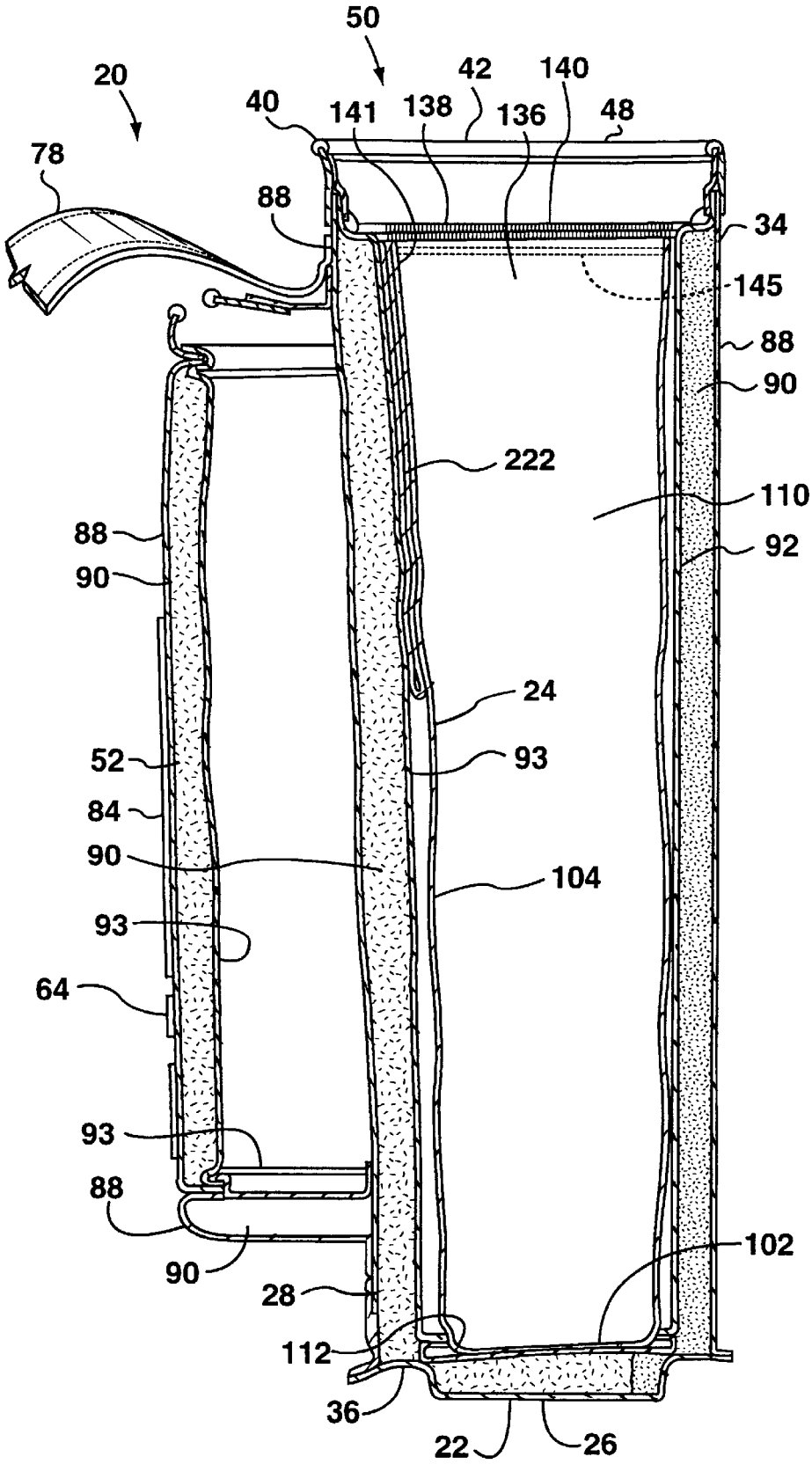
FIG. 10 shows the construction of a wall section of the assembly of FIG. 1.

FIG. 10 shows a cross section of front panel 28 with liner 24 in place. A scab section of panel 34 is also shown to reveal its layers of construction. With the exception of auxiliary pouch 52, this section is typical not only of front panel 28 but also, generally, of rear panel 30, side panels 32 and 34, bottom 26 and lid 46. The outer facing layer of front panel 28 is a canvas covering layer 88 for resisting abrasion. It overlays a closed cell foam insulation layer 90. The inner face of insulation layer 90 is covered by flexible plasticised metallic foil sheeting 92 that is shiny and reflective. The material is sold under the name Therma-Flect (T.M.). Liner 24 lies inside sheeting 92, and is pressed against it by the objects it contains. The inside of pouch 52 is lined with white vinyl sheeting, 93 on its forward and bottom sides.

Figure 3:
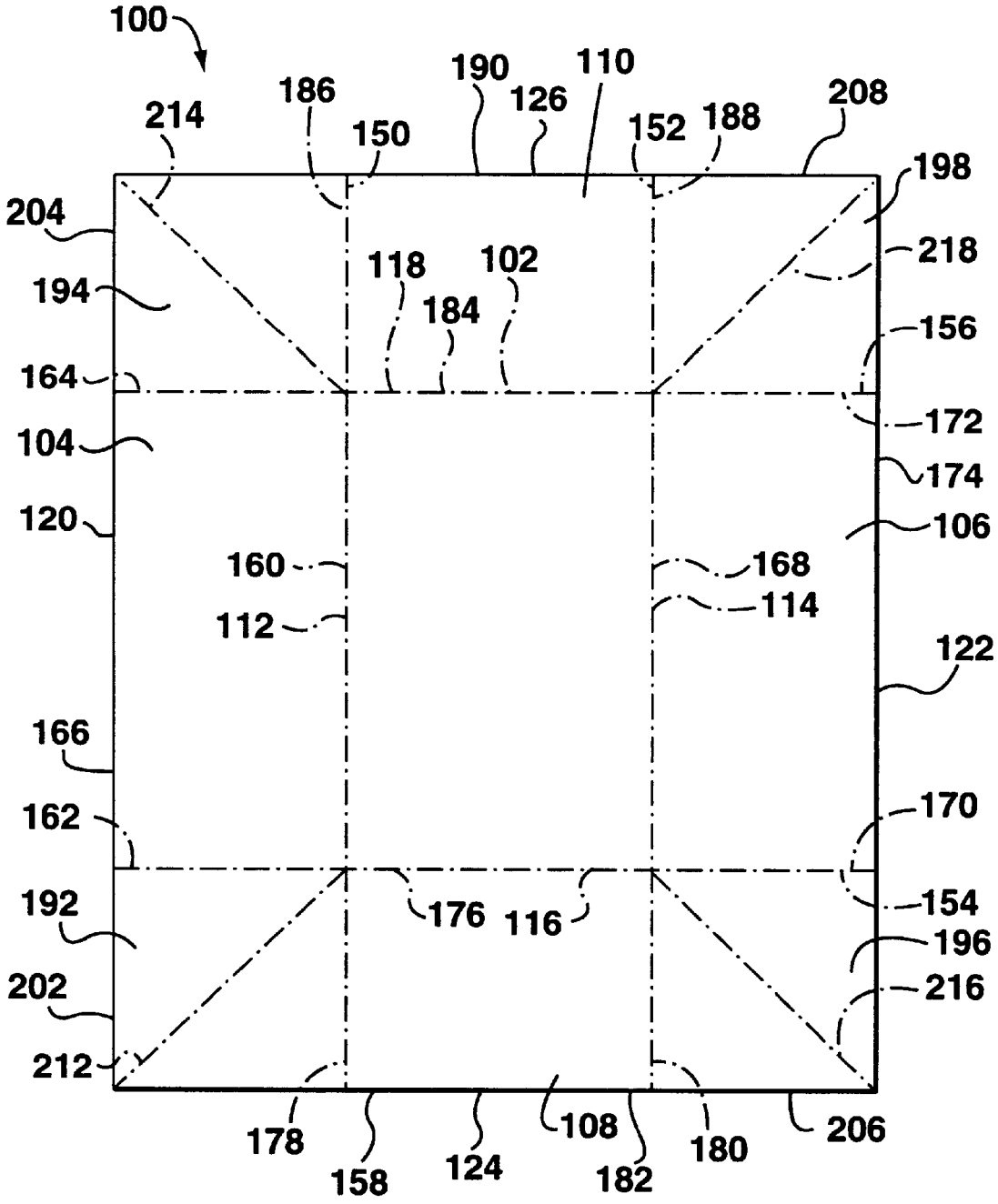
FIG. 3 is a developed view of an assembly for use in the assembly of FIG. 1.

Liner 24 is shown in FIGS. 1, 2 and 3. It is made from a membrane, or web, in the nature of a sheet 100 of flexible, transparent plastic stock, in particular, static cling vinyl. The shiny, reflective surface of sheeting 92 is visible through liner 24 in use. Liner 24 has a base 102 and four sides, front, rear, left hand and right hand respectively, 104, 106, 108, and 110 extending upwardly from base 102. Each of sides 104, 106, 108 and 110 is joined to base 102 at a base edge, 112, 114, 116 or 118, as indicated, and each has an opposite, distal edge 120, 122, 124 or 126 distant from its respective base edge. The sides meet at respective upstanding corners 128, 130, 132 and 134. A chamber 136 is defined between base 102 and sides 104, 106, 108 and 110. Chamber 136 has an opening 138 defined by the peripheral lip 140 formed collectively by the distal edges 120, 122, 124 and 126 of sides 104, 106, 108 and 110. Immediately below lip 140 liner support fasteners, in the nature of hook and eye strips, are mounted to sheet 100. This mounting may be by heat welding or by use of a bonding agent or adhesive. In the preferred embodiment lip 140 is folded over to form a hem, and fasteners 141, 144, 143 are of the nature of a continuous zipper around three sides of lip 140, and a fastener 142 in the nature of a fabric hook-and-eye strip are sewn in place with stitching 145 that is at a height relative to base 102 that is expected to be well above the liquid level in liner 24.

In an alternate embodiment, fasteners 141, 144, and 143 are all fabric hook and eye fasteners each mounted on one side of lip 140, and which mate with corresponding hook-and-eye fastener strips mounted to container 22. These fastener strips are commonly sold under the name Velcro (T.M.). Optional partition 25 is variably positionable. About the upper portion of its periphery it has a strip engaging material 146 that catches on mating strips 147 and 148 located on the inner face of liner 24. These strips can be hook and eye fastener strips. The range of the strips permits the division of sub compartments 27 and 29 of chamber 136 into equal, half-and half portions, or into some other portions, such as ¼ to ¾, ⅓ to ⅔, ⅖ to ⅗ and so forth as may be desirable given the objects to be contained in chamber 136.

In FIG. 3 sheet 100 is shown in developed view, as it would be before being folded to form liner 24. A first pair of parallel fold lines 150 and 152 extend across sheet 100, and a second pair of parallel fold lines 154 and 156, perpendicular to lines 150 and 152 extend along sheet 100, thus dividing it into nine portions within the rectangular periphery, 158, of sheet 100. It will also be noted that each of lines 150, 152, 154 and 156 has two intersections, and is thus divided into a central sector between the parallel lines it intersects, and a pair of end sectors between each of the parallel lines it intersects and the line's termination at periphery 158.

The central portion of sheet 100, bounded by the central sector of each of lines 150, 152, 154 and 156, defines base 102, each of those sectors defining one of base edges 112, 114, 116 and 118. Front side 104 is defined between the central sector 160 of line 150, two parallel forward end sectors 162 and 164 of lines 154 and 156, and a mid-edge sector 166 of periphery 158. Rear side 106 is defined by the central sector 168 of line 152, two parallel rearward end sectors 170 and 172 of lines 154 and 156, and a mid edge sector 174 of periphery 158. Left hand side 108 is defined by central sector 176 of line 154, two left end sectors 178 and 180 of lines 150 and 152, and a mid-edge sector 182 of periphery 158. Right hand side 110 is defined by central sector 184 of line 156, two right end sectors 186 and 188 of lines 150 and 152, and a mid-edge sector 190 of periphery 158.

The remaining four portions of sheet 100 are corner portions 192, 194, 196 and 198 defined by a pair of adjacent end sectors of a pair of perpendicular lines, and a corner sector of periphery 158, indicated respectively as 202, 204, 206 and 208. Corner portions 192, 194, 196 and 198 are bisected by diagonal bisectors 212, 214, 216 and 218 which extend from the intersection of the respective perpendicular lines to periphery 158.

Having thus defined the geometry of sheet 100, liner 24 is formed by folding sides 104, 106, 108 and 110 upwardly such that sectors 162 and 178, 164 and 186, 170 and 180, and 172 and 188 lie adjacent to each other to form corners 128, 130, 132 and 134 respectively. This folding necessitates folding of corner portions 192, 194, 196 and 198, and this is done along their respective diagonal bisectors.

When folded along bisectors 212, 214, 216, and 218 corner portions 192, 194, 196 and 198 form triangular flaps 220, 222, 224 and 226. In the preferred embodiment flaps 220 and 222 are folded to lie against the outside face of front side 104, the corner of flap 220 lying most distant from corner 128 overlapping the corner of flap 222 lying most distant from corner 130. Similarly flaps 224 and 226 are folded to lie against the outside face of rear side 106 the most distant corner of flap 224 overlapping the most distant corner of flap 226. One edge of each flap lies roughly flush with lip 140, which is folded over and the entire periphery of opening 138 of chamber 136 sewn as a hem 228 having a double row of stitches. In this way liner 24 is formed from sheet 100 such that it is not only free of welded seams, but free of any seams below hem 228 of lip 140.

In the preferred embodiment the folding process is purely mechanical, and can be performed relatively quickly, in contradistinction to heat welding or adhesive bonding processes which require a time interval for heating and cooling or for adhesive curing. Inasmuch as the preferred embodiment uses a relatively thick static cling vinyl, sheet 100 can be folded over a cube form of the desired dimensions, and held in place by its own clinging properties in preparation for the sewing of hem 228. The overlap of the tips of flaps 220 and 222, and flaps 224 and 226, and subsequent sewing makes it doubly improbable that liner 24 will unfold.

Liner 24 is formed from a single integral sheet, and, absent punctures of that sheet, is not intended to leak below the level of the sewn seam at lip 140. The body of base 102 and sides 104, 106, 108 and 110 is seamless, being free of heat welds or other joints. In general use the liquid level in chamber 136 is not expected to be greater than one half of the height of the sides, and still less commonly to be more than three quarters of the height. There are no seams below either of these levels, heat welded or otherwise.

Liner 24 is also thin enough that it can be folded inside container 22 when container 22 is compressed to its collapsed position as illustrated in FIGS. 7, 8, and 9. Liner 24 need not be transparent, but could be translucent or opaque. A transparent liner is preferred since it permits the reflection of sheeting 92 to be seen.

Figure 11:
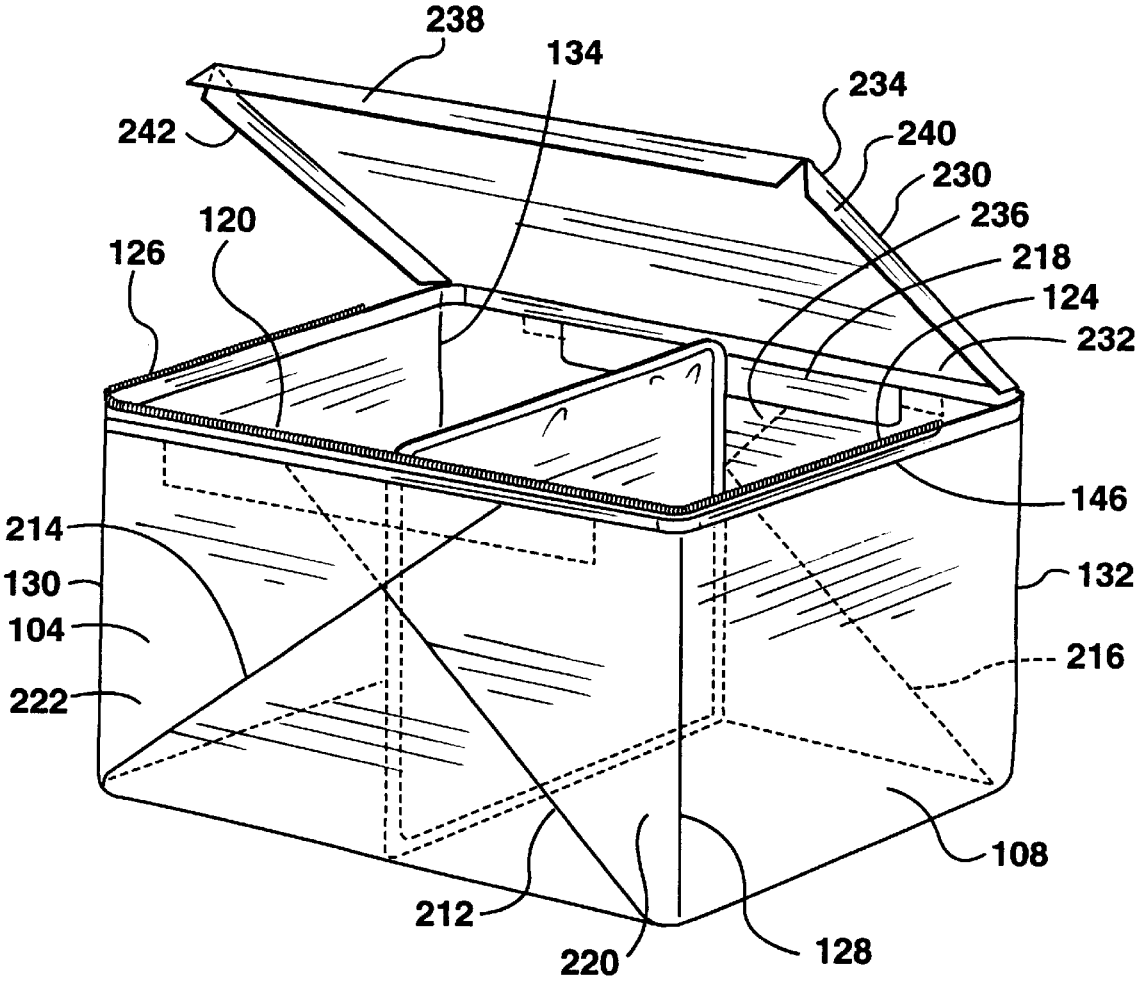
FIG. 11 is a view of an alternative liner for the assembly of FIG. 1.

In an optional embodiment, a liner 224 can have its own closure, or lid, 230, to provide a double closure with lid 46 of container 22 in FIG. 11. As shown in FIG. 11, optional lid 230 extends on a folding plastic hinge 232 that is an integral part of sheet 234 from rear side 236 of sheet 234, and mates at front, left hand and right hand side edges 238, 240 and 242 along a U-shaped closure interface such as may be held closed by a closure member in the nature of a seal, a zipper, a hook and eye fabric fastener, or a similar device. It is not necessary that the opening of the container, or the liner, form a parallel plane to the respective base or bottom sides. The opening could be in a skewed plane, or could be something other than a plane.

In alternative embodiments, one of each of corner flaps 220, 222, 224 and 226 can be folded against each of sides 104, 106, 108 and 110, or a pair (220, 224) can be folded against left hand side 108 and another pair (222, 226) against right hand side 110, rather than against front and rear sides 104 and 106 as illustrated in FIG. 11. It is not necessary that the corner portions have one edge lying flush with lip 140. However, if the corner portions are cut down, the height at which a liquid tight barrier is provided may not necessarily be as high as shown in the preferred embodiment of FIG. 1. It is also not necessary that corner portions 192, 194, 196, and 198 be folded against the outside faces of the sides, but could be folded to lie along the inside faces. It would also be possible to fold each flap to lie partially against one side and partially against another side by using more than one fold line and by cutting the periphery of the corner portions differently. There is simplicity in using a single fold and to fold the flaps against the outside of one side of the liner, as shown in the preferred embodiment of FIG. 1.

Figure 4:
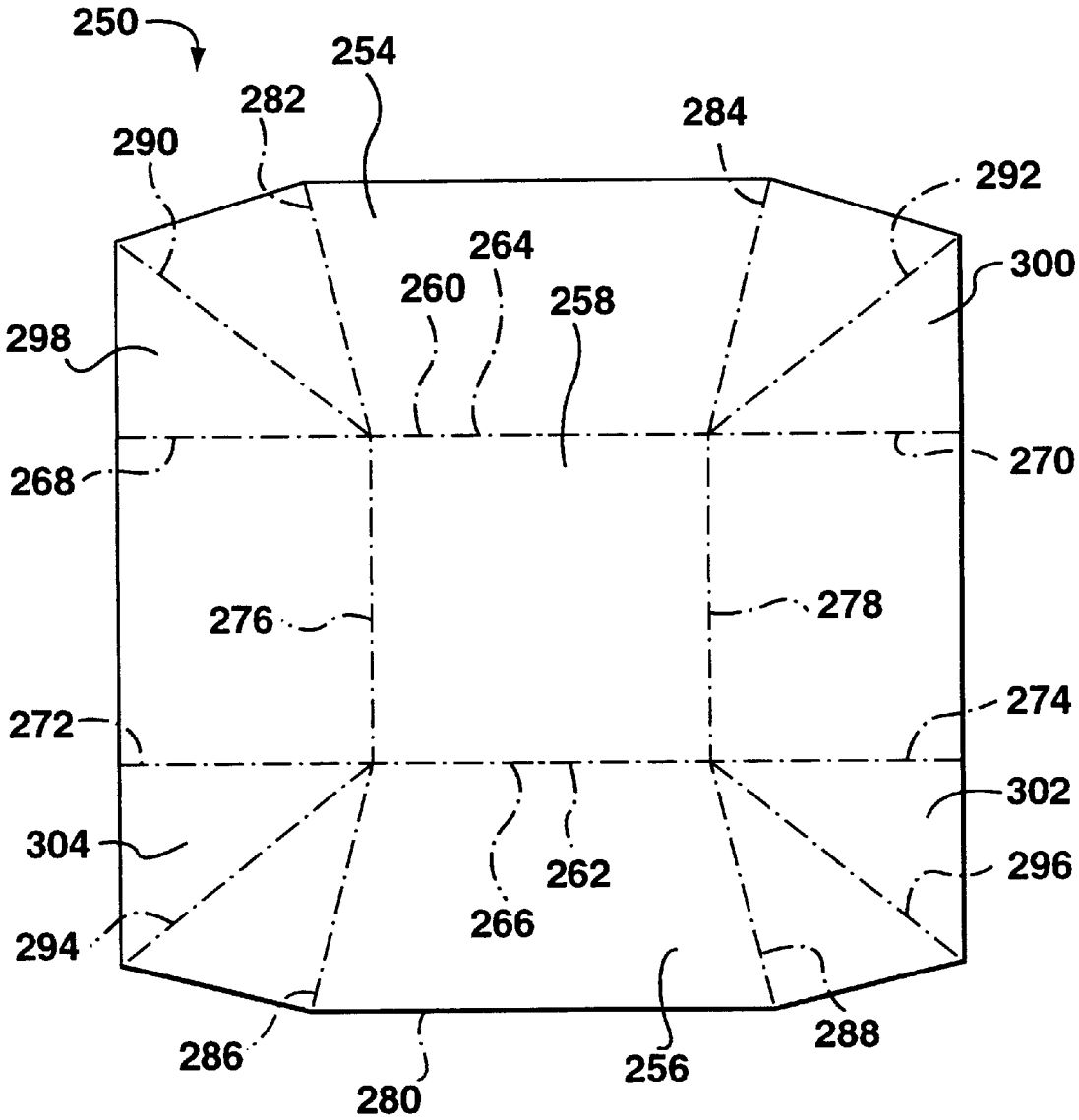
FIG. 4 is a developed view of an alternative liner for an assembly analogous to the assembly of FIG. 1 in which two sides are tapered.
Figure 5:
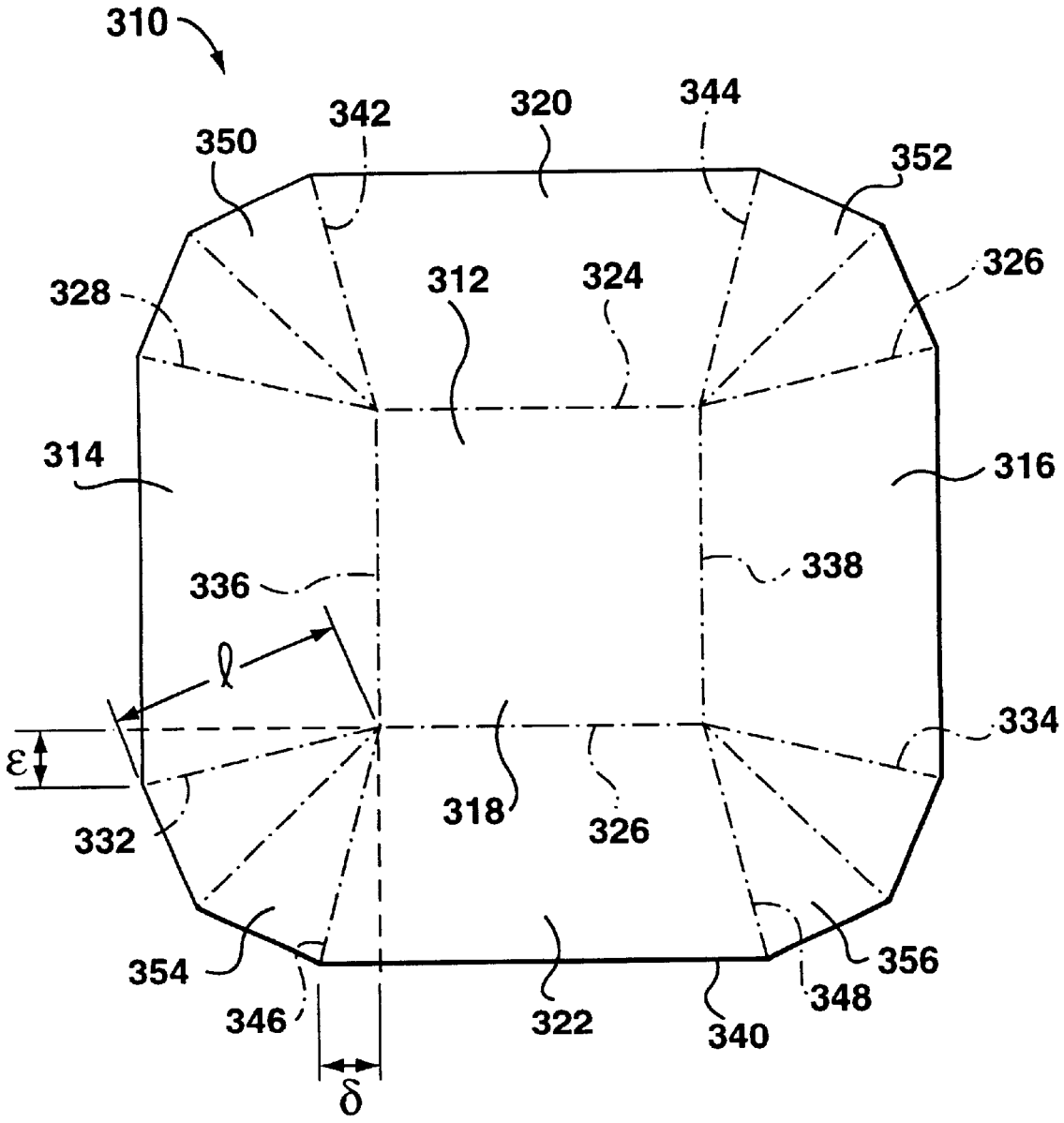
FIG. 5 is a developed view of an alternative liner for an assembly analogous to the assembly of FIG. 1 in which four sides are tapered.
Figure 6:
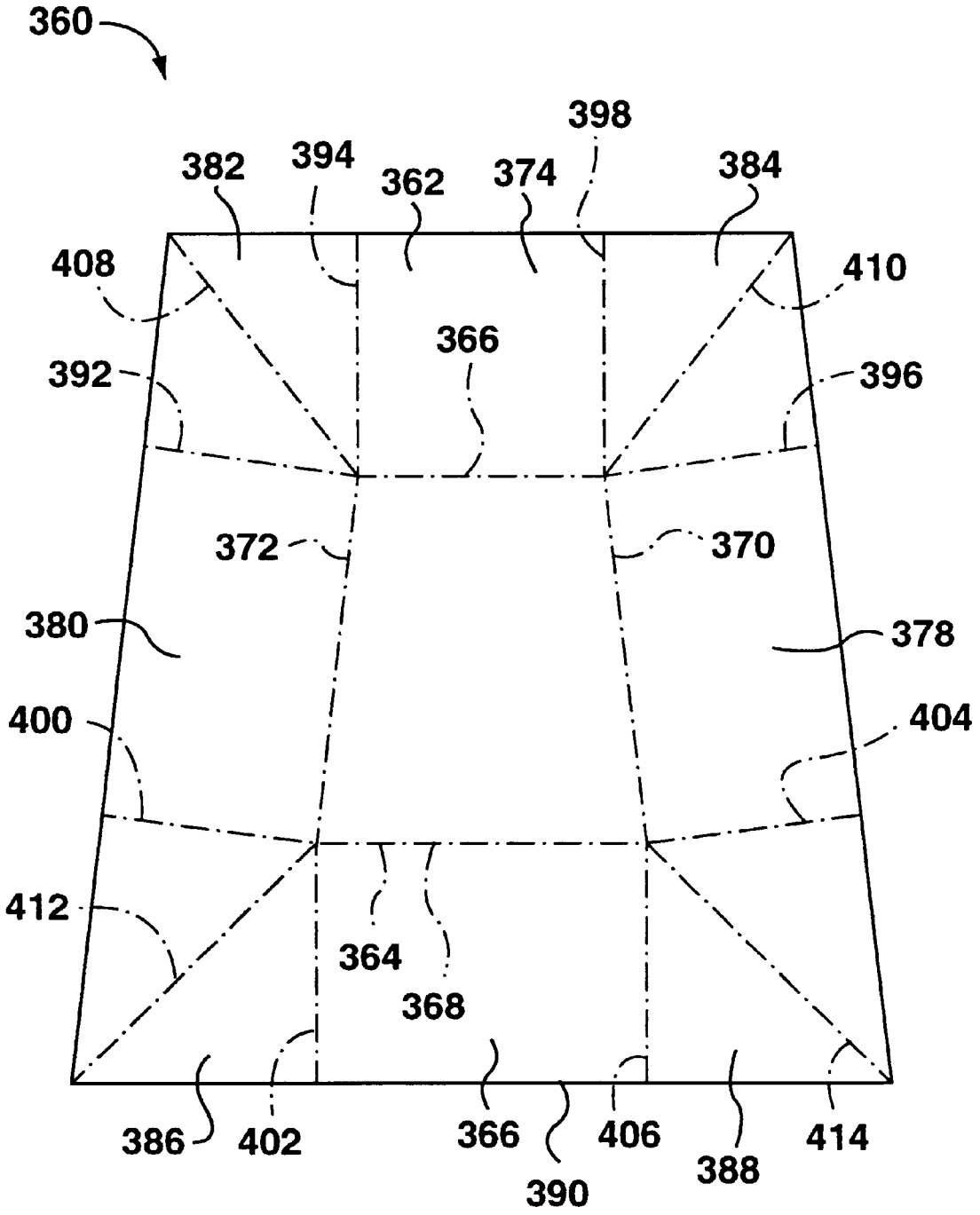
FIG. 6 is a developed view of an alternative liner for an assembly analogous to the assembly of FIG. 1 in which the forward side of the assembly is wider than the rearward side.

As shown in the developed views of the alternate embodiments of FIGS. 4, 5, and 6, the liner need not be a cube or cuboid, but could be a tapered, trapezoidal, or truncated pyramidal shape. In the embodiment of FIG. 4 a developed sheet 250 has fold lines for forming a liner having a pair of opposed trapezoidal sides 254 and 256 which rise at right angles from a base 258, and a pair of opposed rectangular sides that are folded upward at an angle corresponding to the rake angle P of trapezoidal sides 254 and 256. It can be seen that there is one pair of parallel fold lines 260 and 262, each line having a central sector 264, 266 and a pair of left and right end sectors 268, 270 or 272, 274. There is also a pair of fold line sectors 276 and 278 which define the remaining two sides of base 258 (perpendicular to sectors 264 and 266). The intersections of sectors 276, 264, 278, and 266 define the corners of base 258. Extending away from those corners to periphery 280 are left and right hand canted trapezoidal side sectors 282, 284, 286, and 288 to define the remaining vertices of trapezoidal sides 254 and 256. At the angular bisector of the included angle between adjacent pairs of rectangular side lateral sectors and trapezoidal side sectors, as, for example between sectors 268 and 282, are corner portion fold lines 290, 292, 294, and 296. Corner portions 298, 300, 302 and 304, each defined between one trapezoidal side end sector, one rectangular side end sector and periphery 280, have been trimmed along periphery 280 to lie flush with the resulting lip. When sheet 250 is folded in a manner analogous to the folding of sheet 100, a cradle shaped liner will result, for mating use with a similarly cradle shaped container analogous to container 22.

In the embodiment of FIG. 5 a developed sheet 310 has fold lines for forming a liner 312 having a first pair of opposed trapezoidal sides 314 and 316 which rise at a non-perpendicular angle $\phi$ from a base 318, and a second pair of opposed trapezoidal sides 320, 322 that are folded upward at a rake angle $\Psi$ of the first pair of trapezoidal sides 314 and 316. It can be seen that there is one pair of fold line sectors 324, 326 and a perpendicular pair of fold line sectors 336 and 338 which define the remaining two sides of base 318. The intersections of sectors 328, 324, 338, and 336 define the corners of base 318. Extending away from those corners to periphery 340 are left and right hand trapezoidal side lateral sectors 332, 334, 336 and 338. Similarly, left and right hand canted trapezoidal side sectors 342, 344, 346, and 348 extend from those intersections toward periphery 340 to define the remaining vertices of the trapezoidal sides. At the angular bisector of the included angle between adjacent pairs of rectangular side lateral sectors and trapezoidal side sectors, as, for example between sectors 328 and 342, are corner portion fold lines 350, 352, 354, and 356 of corner portions 358, 360, 362 and 364.

Sectors 332, 334, 328, 330, 342, 344, 346 and 348 all have the same true length, indicated as l. The distance that sectors 332, 334, 336 and 338 are splayed outward from square is indicated as $\epsilon$. The distance that sections 342, 344, 346 and 348 are splayed outward from square is indicated as $\delta$.

When folded in a manner analogous to the folding of sheet 100, sheet 310 will form a truncated, inverted rectangular shaped pyramid. It should be noted that the pairs of opposed slanted pyramid sides need not rise at the same angle, but could be at different angles. In the most general case, each side could rise at a different angle, and to a different height. The upper edges of the sides need not be level, but could have a slant, or, alternatively, need not be linear but could be curved as may suit the desired geometry. However, it is expected that the sides will, most often, have straight and level edges.

In the embodiment of FIG. 6, a developed sheet 360 has fold lines for forming a liner 362 having a trapezoidal base 364 such as might be desired in a knapsack having a large rearward face for placement against a person's back, and a narrower outer or forward face. A pair of parallel lines of unequal length, being a short front fold line 366 and a longer rear fold line 368, define the parallel sides of the trapezoidal base 364. A pair of left and right hand side fold lines 370 and 372 extend between lines 366 and 368 at angles to define the splayed sides of trapezoidal base 364. Front side 374, rear side 376, left side 378 and right side 380 are all hinged along respective fold lines 366, 368, 370 and 372 to base 364. Corner portions 382, 384, 386 and 388 are defined between the periphery 390 and respective pairs of side sectors 392 and 394, 396 and 398, 400 and 402, and 404 and 406. Each of portions 382, 384, 386 and 388 has a fold line 408, 410, 412 or 414 on which the respective corner portion is folded, those portions being trimmed along their peripheral edges to lie flush with the peripheral edges of the respective sides against which they are folded, similar to the manner described above in for the preferred embodiment.

Figure 12:
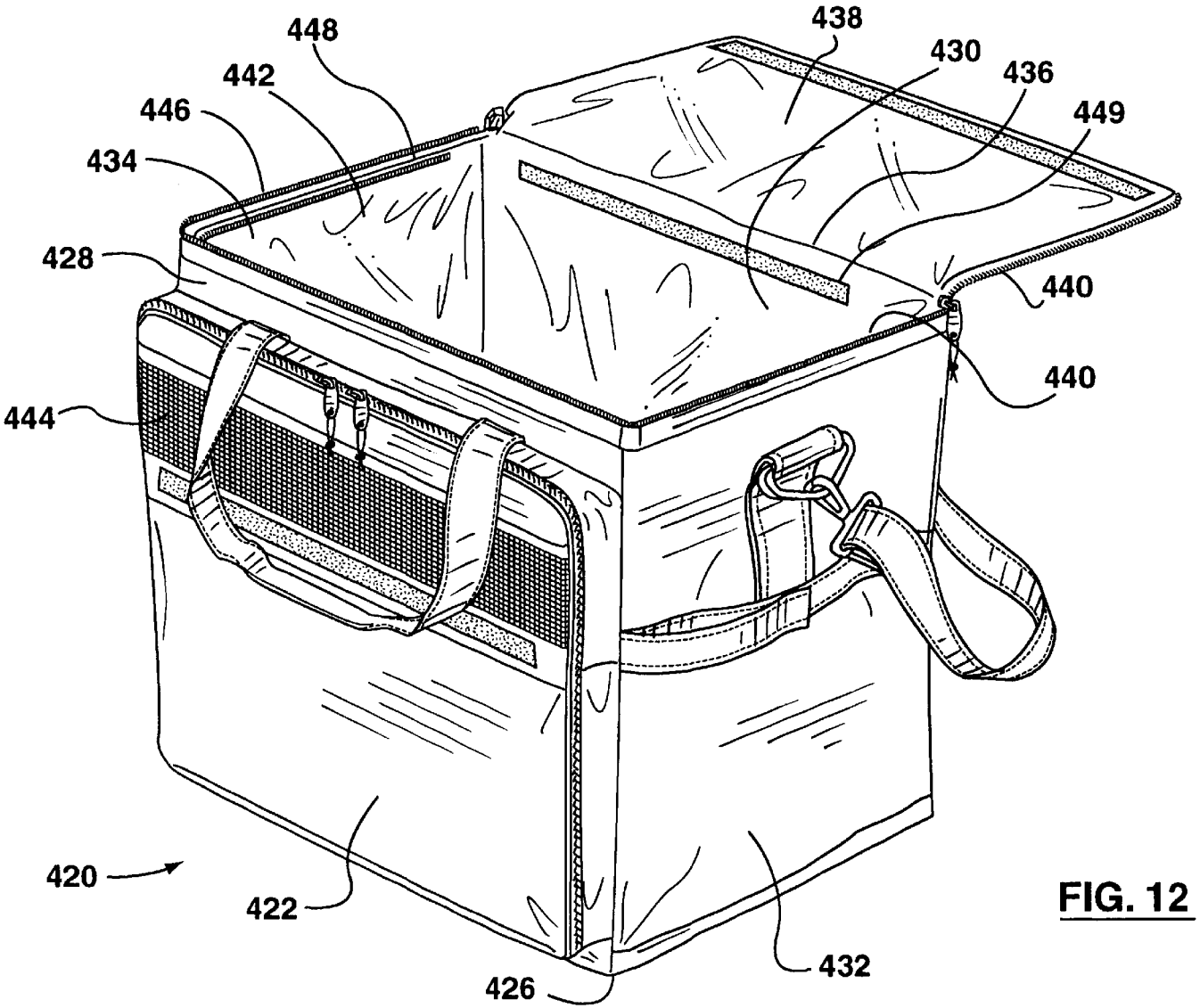
FIG. 12 is an isometric view of an alternative insulated container for an assembly similar to that of FIG. 1, but being of greater depth.
Figure 13:
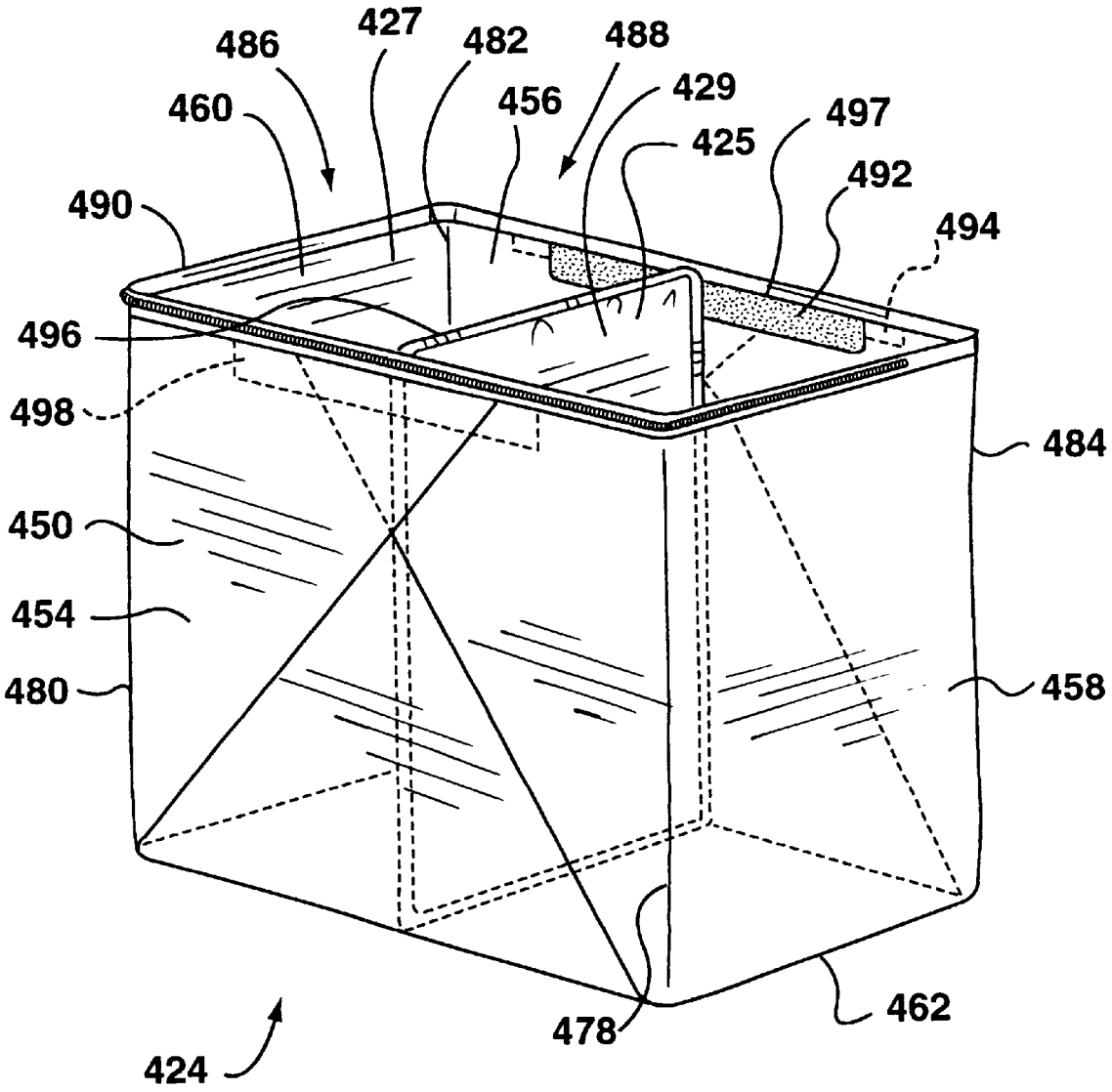
FIG. 13 shows a liner for the insulated container of FIG. 12 with an internal divider in a vertical orientation.

Referring to the general arrangement illustrations of FIGS. 12 and 13, an alternative embodiment of an insulated container and liner assembly is indicated generally as 420. It has two major elements, those being an outer casing in the nature of a soft-sided insulated container 422, and a removable, impermeable liner 424 for placement inside container 422. An optional moveable bulkhead, or baffle, in the nature of an insulated, partition wall 425 seats within liner 424 for dividing the interior space into two chambers, or sub-compartments 427, and 429.

Looking at these major elements in detail, it can be seen that container 422 is of generally similar construction to container 22. Container 422 has a bottom 426, a front panel 428, a rear panel 430, and a pair of left and right hand side panels 432 and 434. Each of front panel 428, rear panel 430, and left and right hand side panels 432 and 434 is joined at sewn seams to bottom 426 at bottom vertices. Rear panel 430 is joined by a folded hinge 436 at its top edge to a top panel in the nature of a lid 438. Lid 438 has a closure member in the nature of a zipper 440 extending in a U-shape around the three free edge portions of its periphery to mate with the other portions of zipper 440 positioned about the top edges of panels 428, 432 and 434. Lid 438 is moveable between a closed position, in which zipper 440 may be zipped closed, and an open position in which lid 438 is folded back to permit entry and exit of objects to and from an internal cavity 442 defined between bottom 426 and panels 428, 430, 432 and 434. A generally rectangular insulated auxiliary pouch 444 is mounted to the front face of front panel 428.

On the inside of rim 446 is a liner securing means, or liner attachment mounting, in the nature of a zipper 448, which includes portions mounted respectively to panels 428, 432, and 434 near their upper margins, and a hook and eye fabric fastener strip 449 mounted to panel 430. In an alternative embodiment the strip portions (or some other combination of them) could be hook-and-eye fabric fasteners. Other types of mounting could be used, in addition to zippers, such as interlocking seal strips, snaps, clips, grommets or other means.

Container 422, with liner 424 installed, can be folded to a collapsed position in a similar manner to that of container 22, as shown in FIGS. 7, 8 and 9 and described above. Container 422 also has the other feature of container 22 noted above such as shoulder straps, carrying handles, an elasticized retaining matrix, and a see-through mesh pocket. Aside from greater depth, container 422 has the same construction as container 22 described above with reference to FIG. 10.

Figure 14:
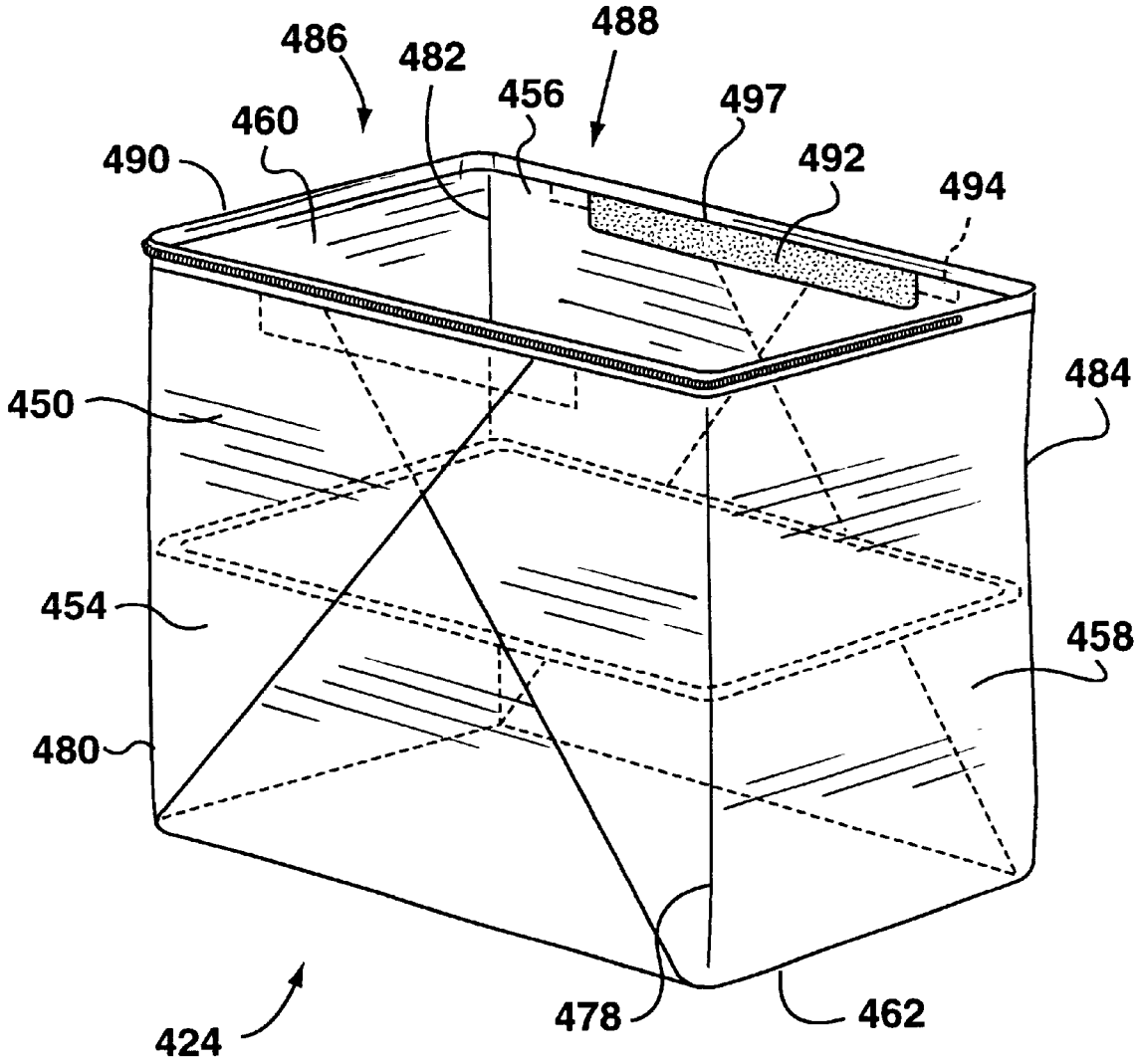
FIG. 14 shows a liner for the insulated container of FIG. 12 with an internal divider in a horizontal orientation.

Liner 424 is shown in FIGS. 13 and 14. It is made from a membrane, or web, in the nature of a sheet 450 of flexible, transparent plastic stock, in particular, static cling vinyl. Liner 424 has a base 462 and four sides, front, rear, left hand and right hand respectively, 454, 456, 458, and 460 extending upwardly from base 462. Each of sides 454, 456, 458 and 460 is joined to base 462 at a base edge, and each has an opposite, distal edge distant from its respective base edge. The sides meet at respective upstanding corners 478, 480, 482 and 484. A chamber 486 is defined between base 462 and sides 454, 456, 458 and 460. Chamber 486 has an opening 488 defined by the peripheral lip 490 formed collectively by the distal edges 470, 472, 474 and 476 of sides 454, 456, 458 and 460. Immediately below lip 490 liner support fasteners, in the nature of hook and eye strips, are mounted to sheet 450. This mounting may be by heat welding or by use of a bonding agent or adhesive. Lip 490 is folded over to form a hem, and a continuous zipper around three sides of lip 490, and a fastener 492 in the nature of a fabric hook-and-eye strip are sewn in place with stitching 494 that is at a height relative to base 462 that is expected to be well above the liquid level in liner 424. It will be appreciated that liner 424 could, alternatively, and with appropriate geometric adjustments, be formed in any of the shapes described above in the context of FIGS. 3, 4, 5 and 6. It will also be appreciated that liner 424 could be formed in a shape having a lid, as illustrated in FIG. 11.

In FIG. 13, partition 425 is shown in a vertical orientation, and, just as in the manner of partition 25, partition 425 is variably positionable. About the upper portion of its periphery it has a strip engaging material 496 that catches on mating strips 497 and 498 located on the inner face of liner 424. These strips can be hook and eye fastener strips. The range of the strips permits the division of sub-compartments 427 and 429 of chamber 486 into equal, half-and half zones or portions, or into some other proportion of zones or portions, such as ¼ to ¾, ⅓ to ⅔, ⅖ to ⅗ and so forth as may be found desirable given the objects to be contained in chamber 486.

In FIG. 14, liner 424 is shown with partition 425 in a horizontal arrangement. Container 422 and liner 424 have been illustrated as having the same, or roughly the same, width and height, so that partition 425 can be used, as in FIG. 13, to divide chamber 486 into two zones separated by a vertical bulkhead or divider. Alternatively partition 425 can be used to divide chamber 486 into two zones separated by a horizontal, or roughly horizontal, floor or divider, or partition. In the latter case, the materials below the partition, such as cans, bottles or boxes, (not shown) support the partition, and the materials above rest upon the partition. Partition 425 is a relatively stiff panel, having a stiffener element that is insulated on both planar faces, and encased in a substantially water impermeable, and washable, external skin. The insulation material is a closed cell foam, generally similar to that used in the body of container 422. The plan form of partition 425 is generally rectangular, with rounded corners, to fit within the projected opening shape of liner 424 in close fitting relationship either in the vertical orientation of FIG. 13 or the horizontal orientation of FIG. 14.

While partition 425 is water impermeable, its fit within liner 424 is not water-tight. It is, however, a sufficient fit to tend to permit a measure of isolation, or environmental segregation, between the zones on either side of the partition from each other. When partition 425 is oriented to lie generally horizontally it may tend to permit cool materials to be carried in that portion of chamber 486 below partition 425, and warm or hot materials above. It may also tend to permit wet, or moist materials to be carried below partition 425 and relatively dry materials, such as bread or buns to be carried above. A vertical orientation of partition 425 may also tend to permit segregation into different zones of hot and cool for dry materials. In either orientation, the stiffness of partition 425 may tend to serve to provide softer materials, such as bread or fruit, with some protection from harder materials, such as bottles or cans that might otherwise crush them during the jostling of transportation.

Although only one partition 425 is illustrated, it would be possible to provide more than one such partition to permit division of the internal volume of the container into 3, 4 or more sub-compartments. It is also possible to provide a divider, or partition that, in generally horizontal orientation, only covers, or occludes, a portion of the chamber, in the manner of a partial shelf, or set of shelves. Such a partial divider may not tend to provide as effective a thermal barrier as a large partition that more closely matches the plan form of vertical section of the container. Notably, each of partitions 25 and 425, as illustrated and described, is mounted within its respective liner, 24 or 424.

Figure 15:
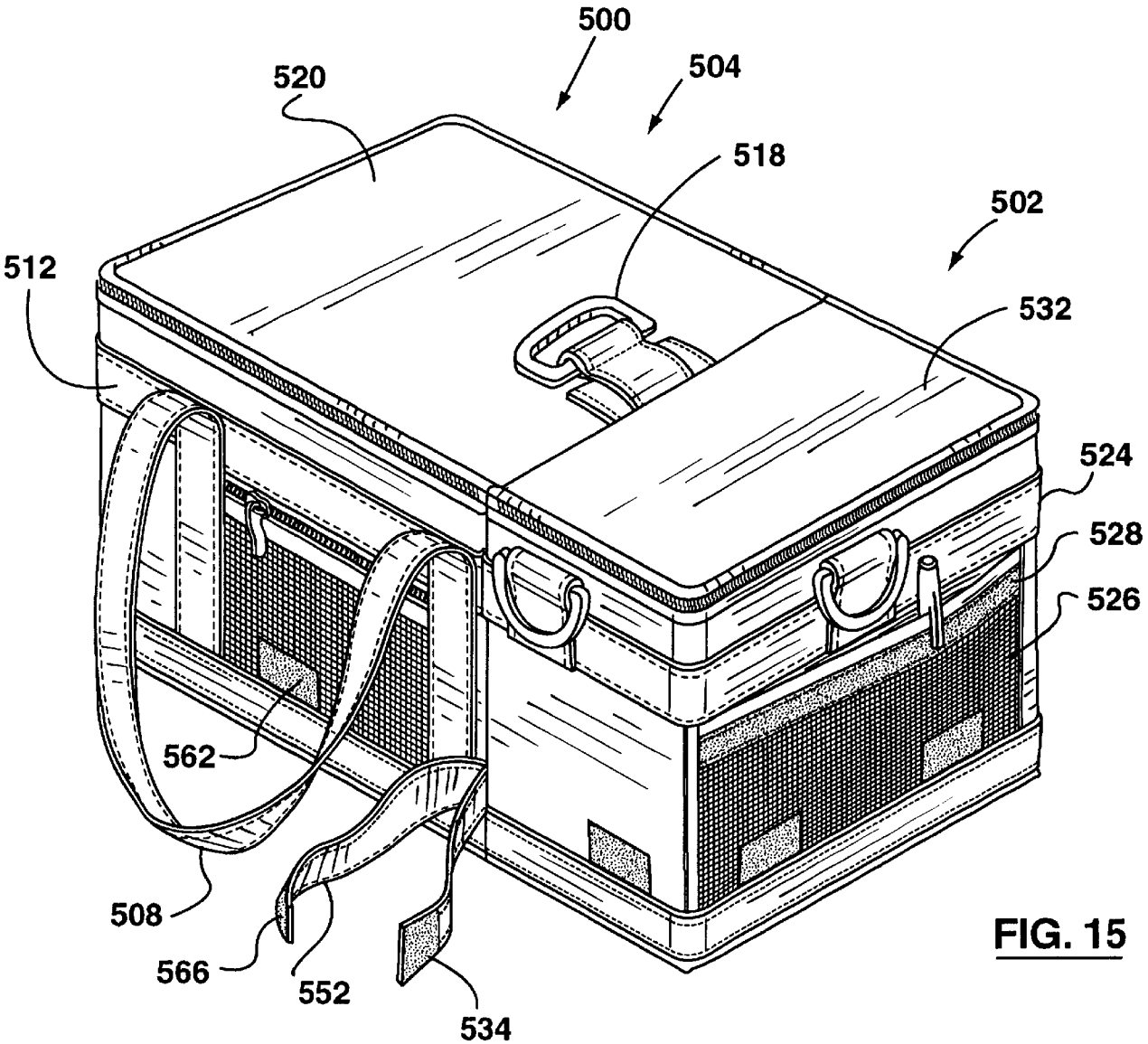
FIG. 15 shows an isometric view of a further alternative assembly to the assembly of FIG. 1.
Figure 16:
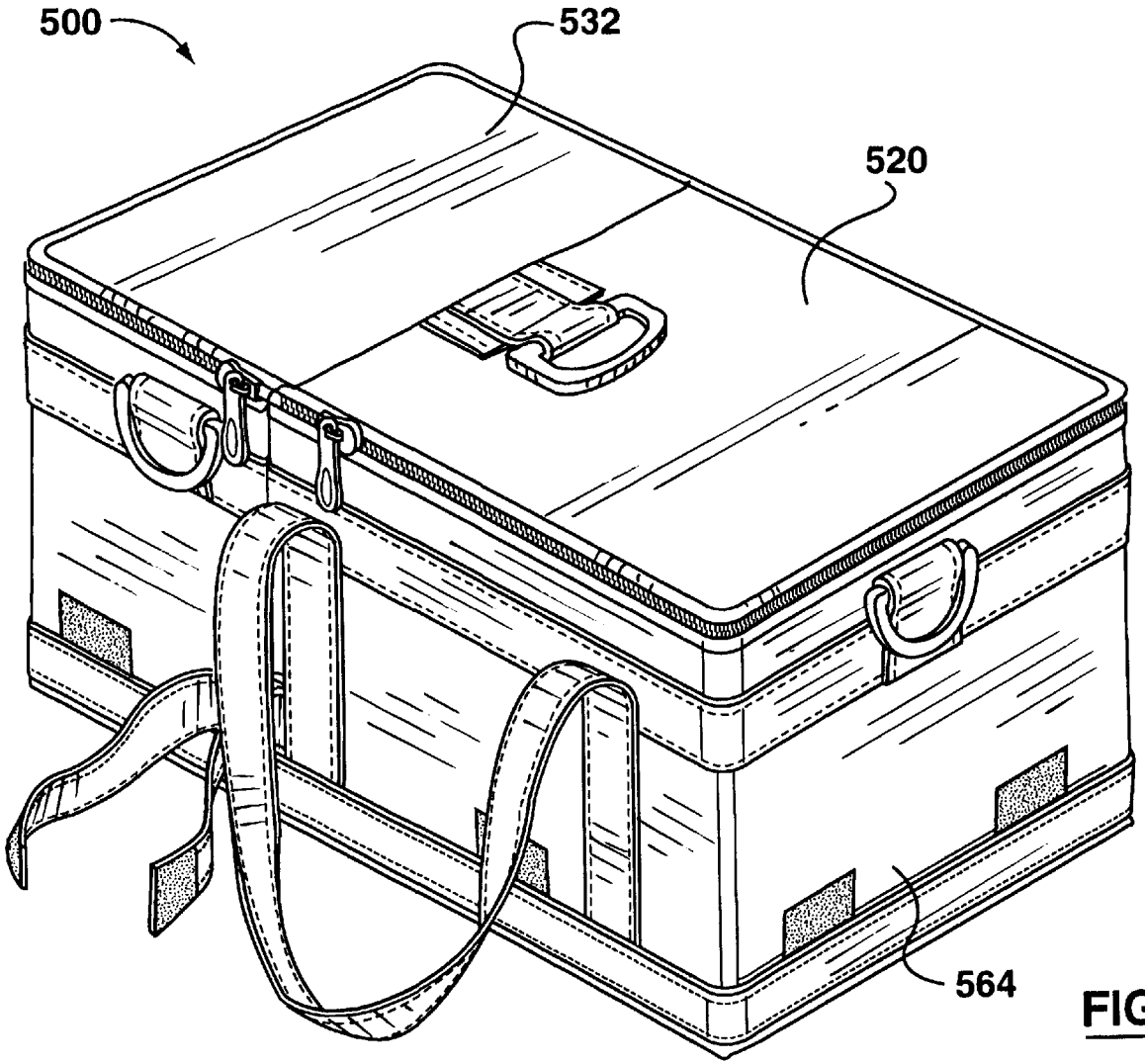
FIG. 16 shows an isometric view of the assembly of FIG. 15 taken from the diagonally opposite corner.
Figure 17:
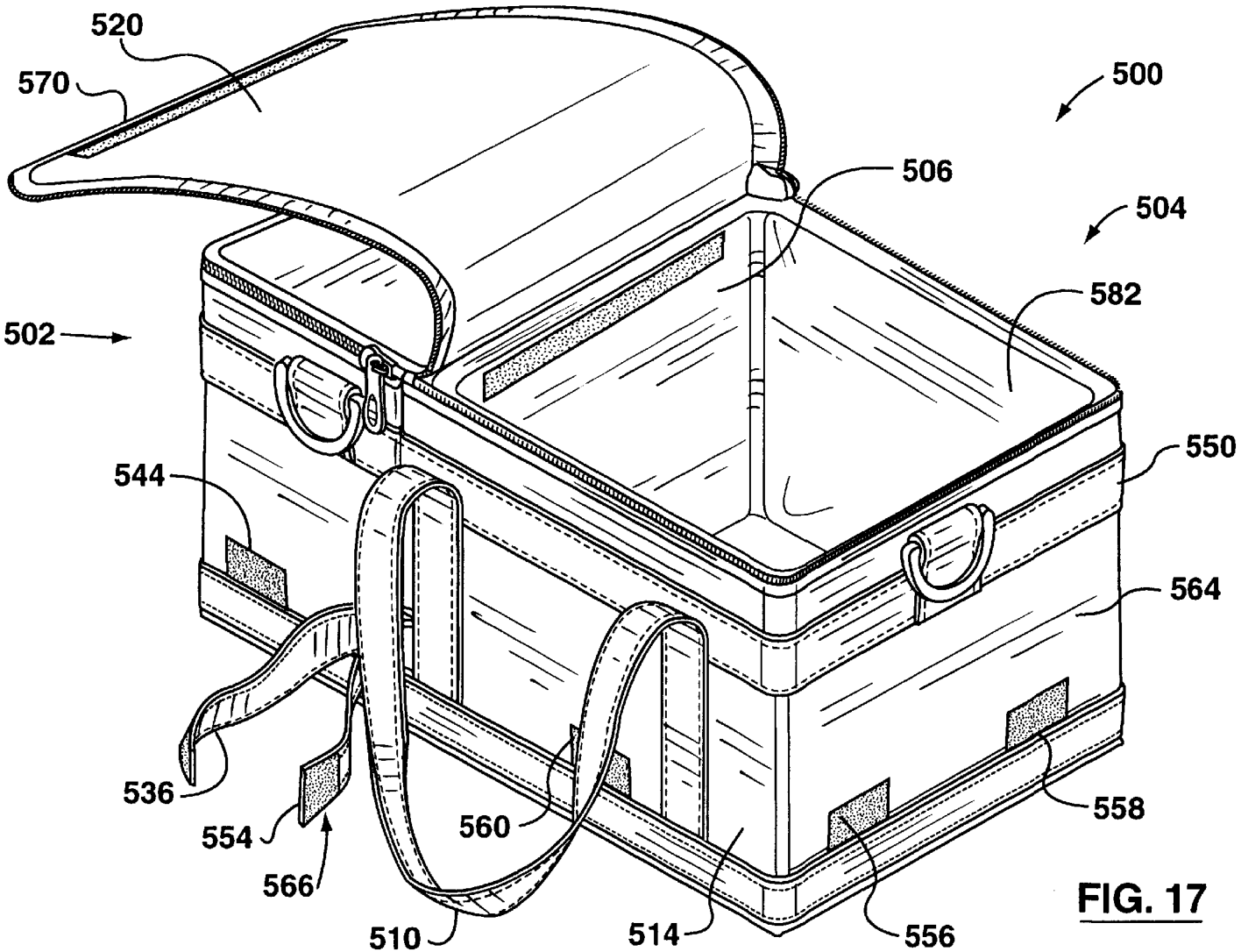
FIG. 17 shows the assembly of FIG. 15 with a lid to one chamber open.
Figure 18:
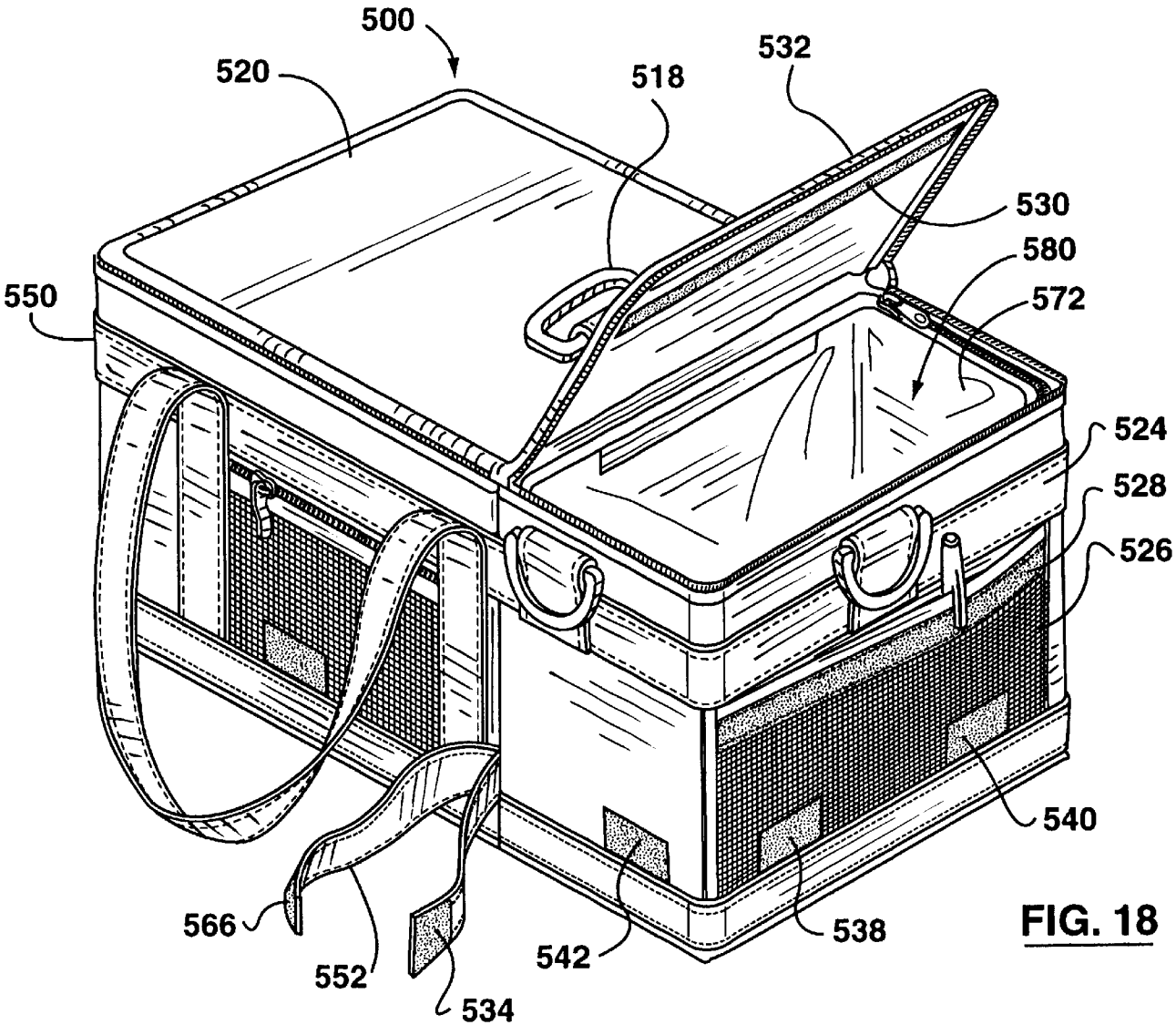
FIG. 18 shows the assembly of FIG. 15 with its opposite chamber open.
Figure 19:
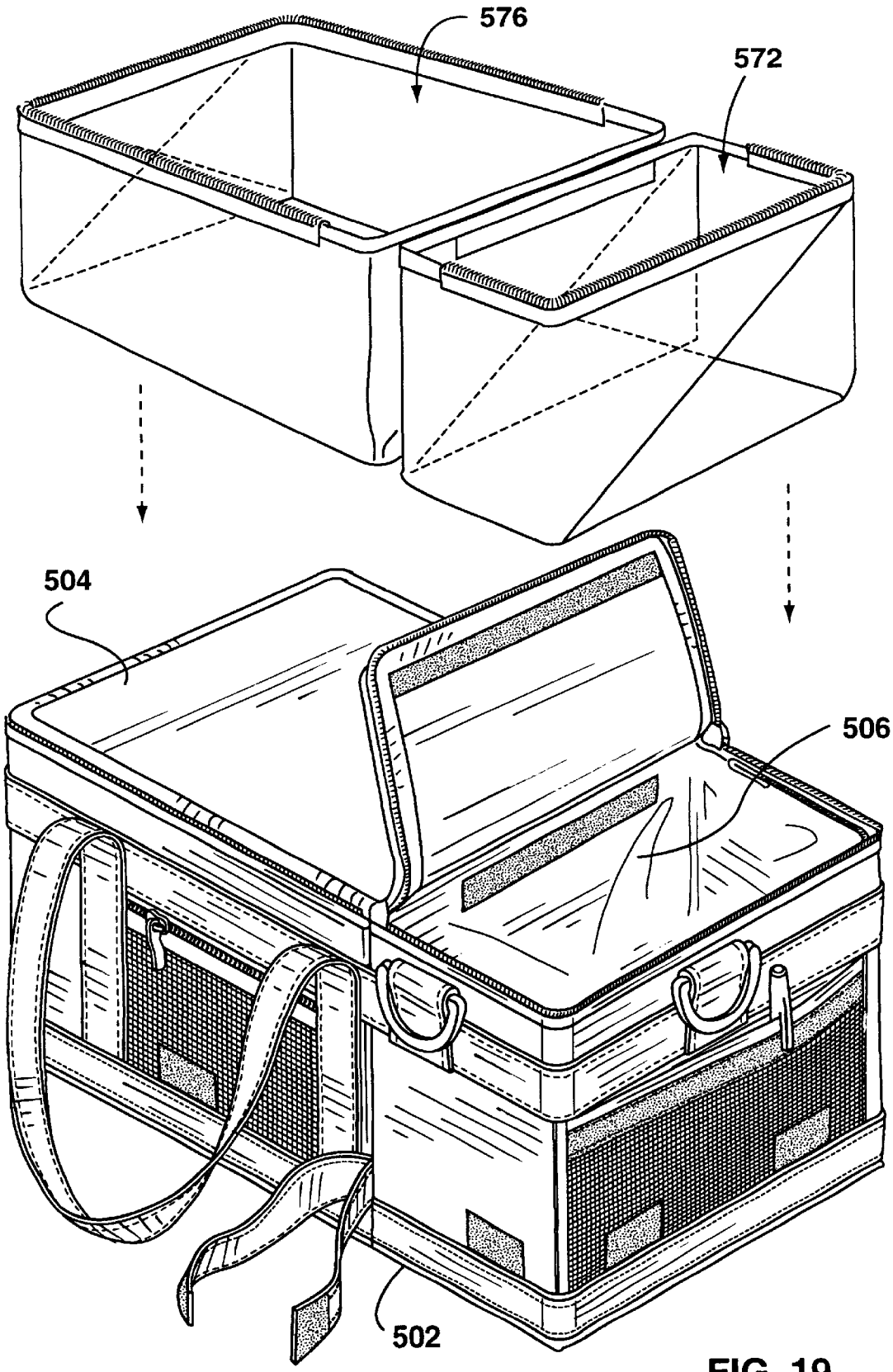
FIG. 19 shows the assembly of FIG. 15 with its liners removed.
Figure 20:
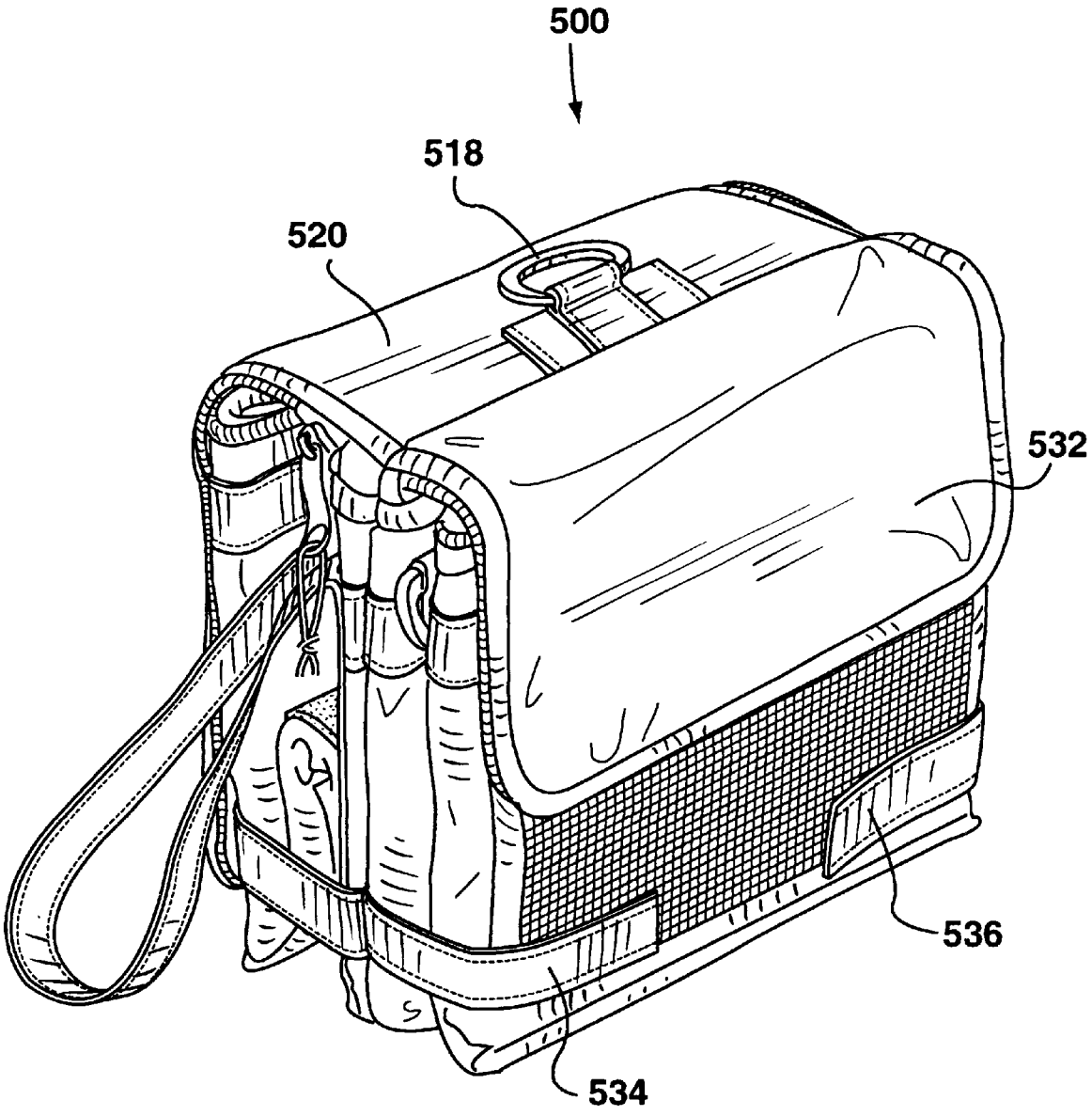
FIG. 20 shows the assembly of FIG. 15 in a collapsed position.
Figure 21:
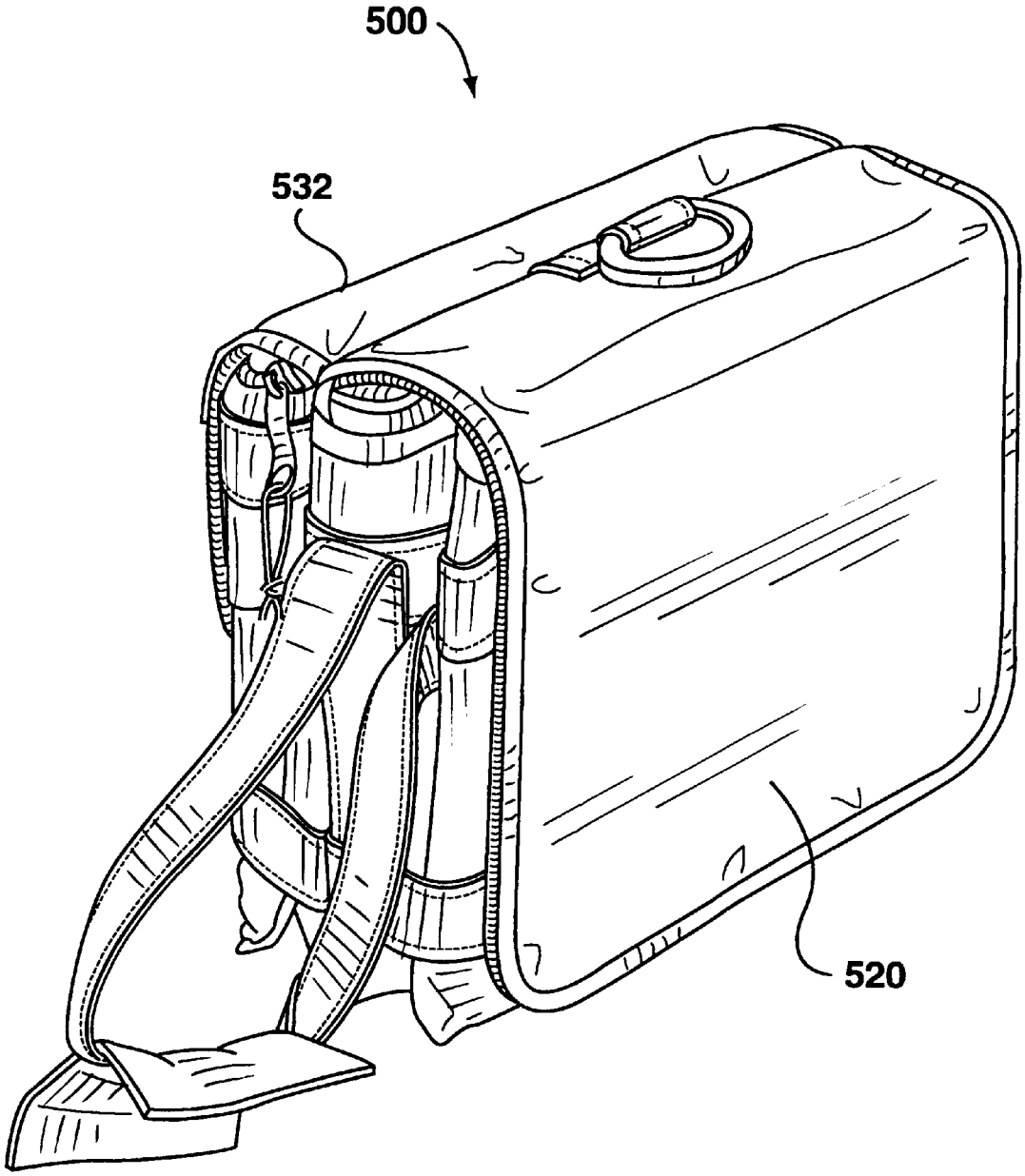
FIG. 21 shows the assembly of FIG. 15 in the collapsed position taken from the diagonally opposite corner to FIG. 20.
Figure 22:
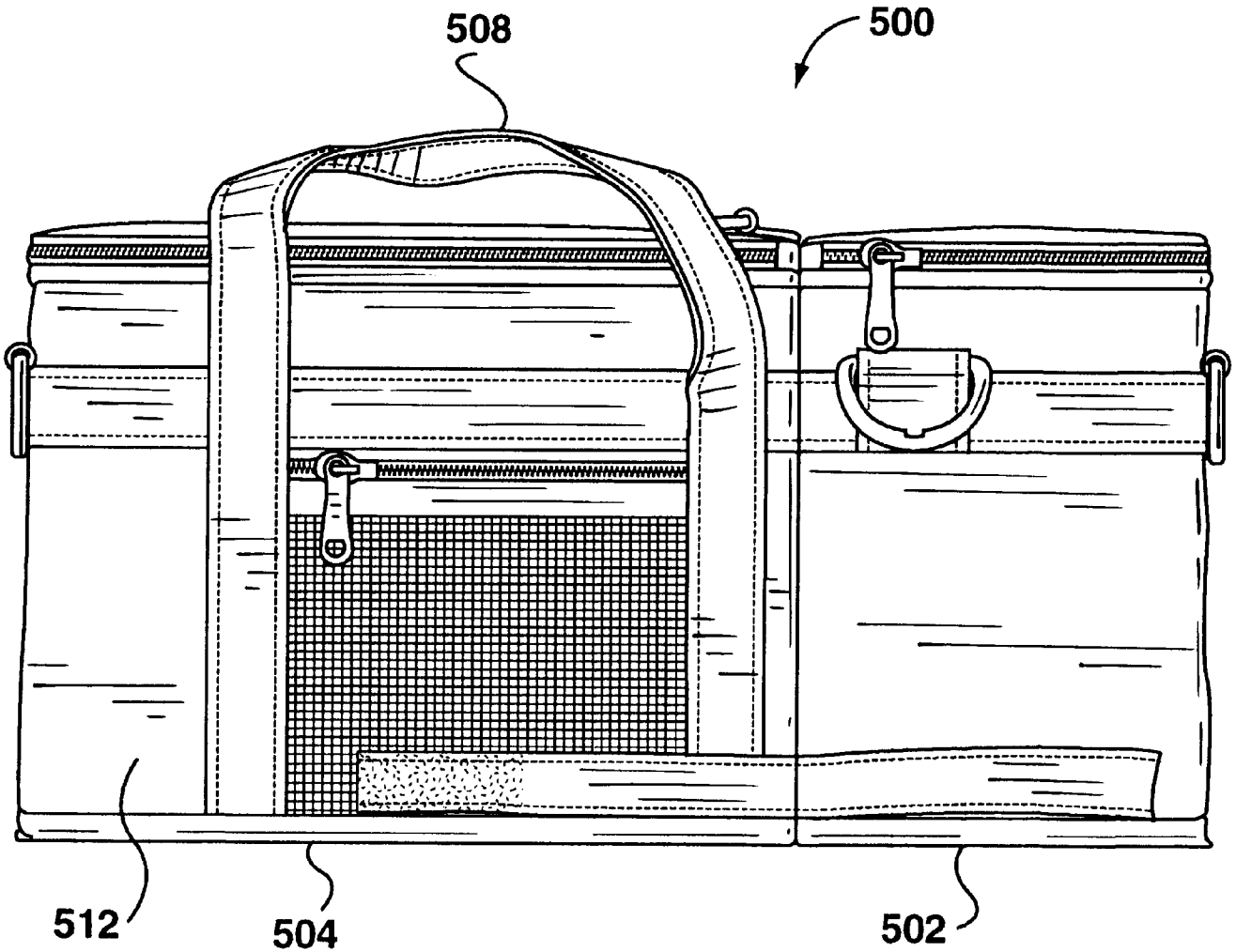
FIG. 22 shows a left-hand side elevation of the assembly of FIG. 15.
Figure 23:
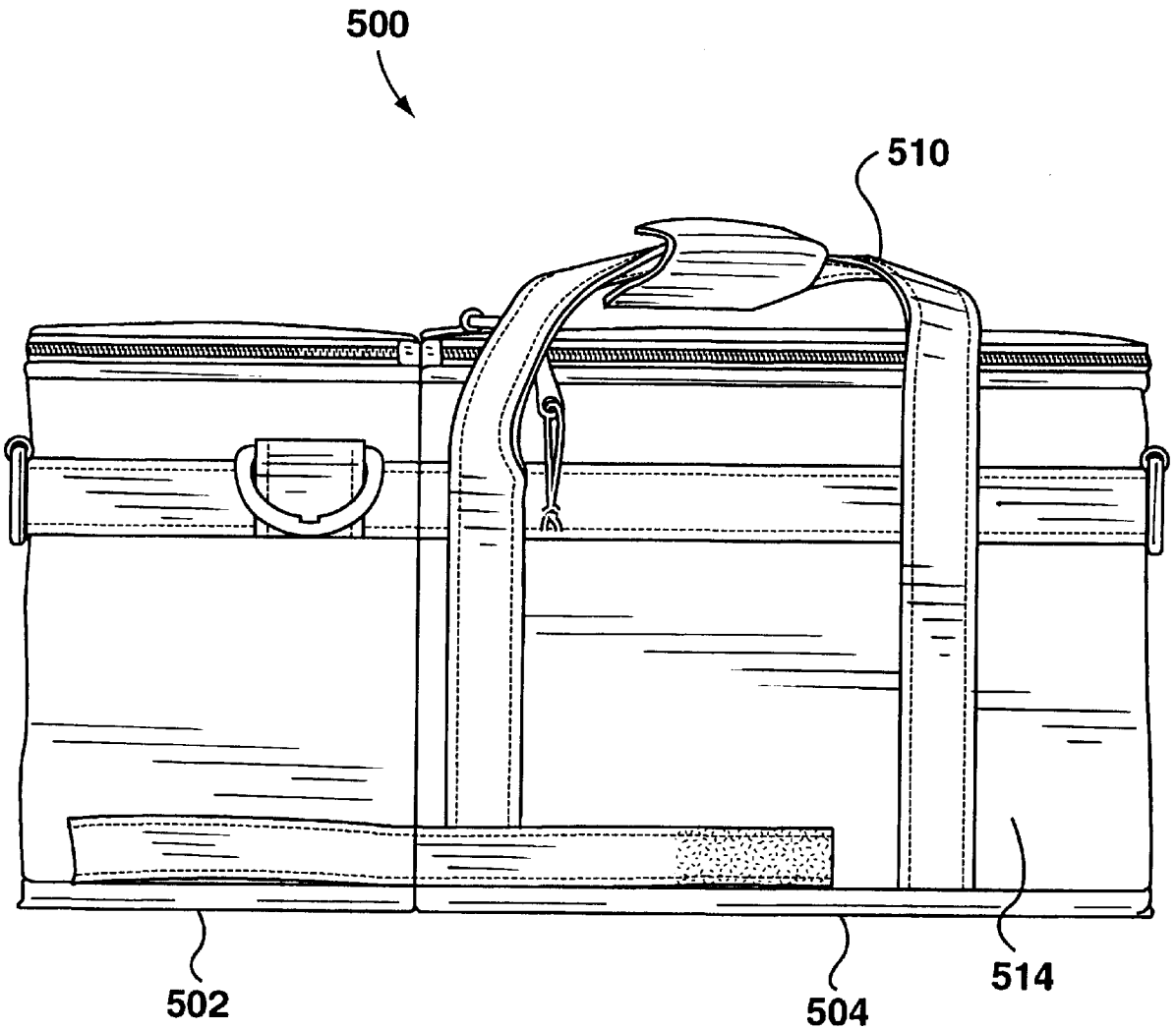
FIG. 23 shows a right-hand side elevation of the assembly of FIG. 15.
Figure 24:
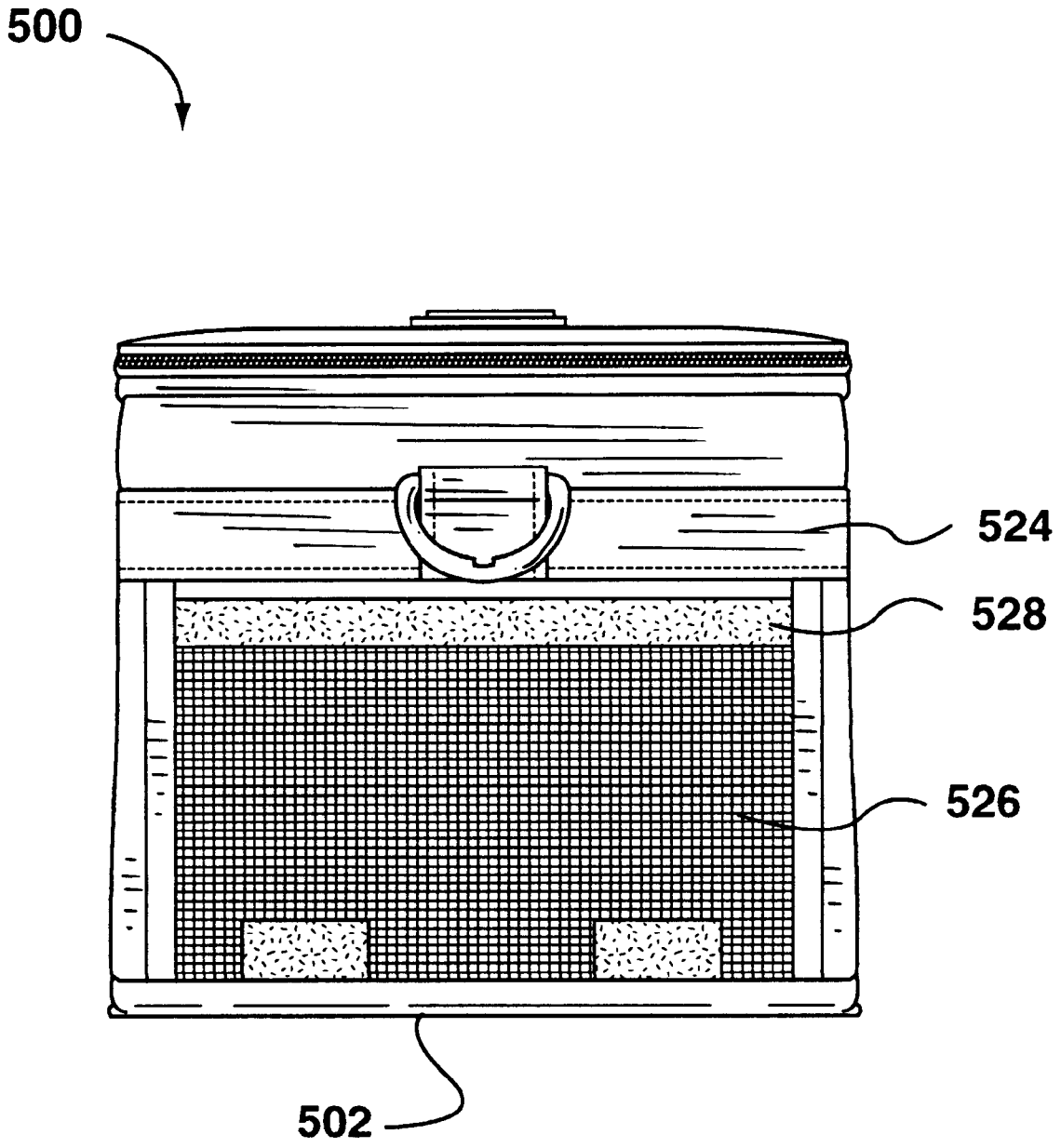
FIG. 24 shows a near end view of the assembly of FIG. 15.
Figure 25:
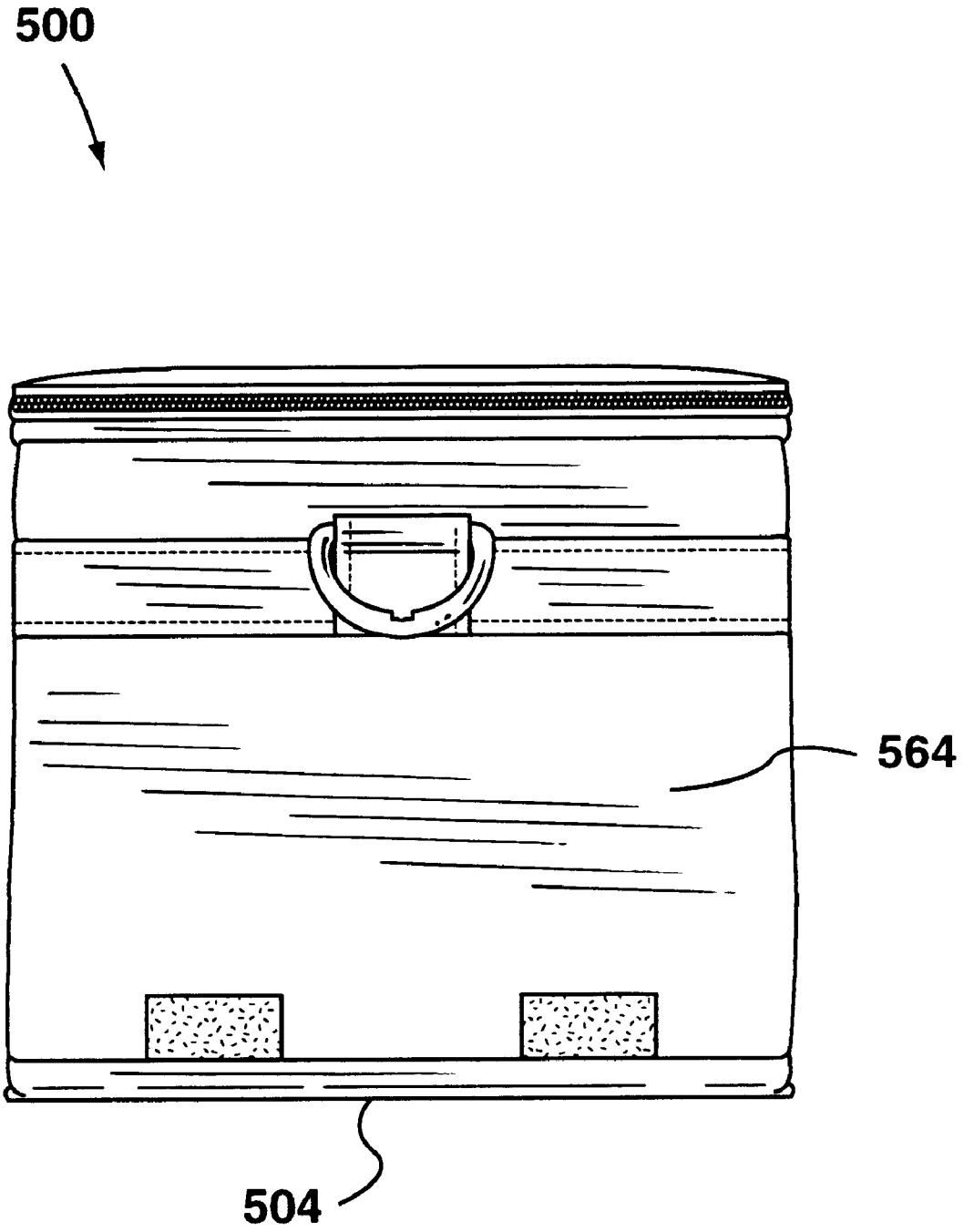
FIG. 25 shows a far end view of the assembly of FIG. 15.
Figure 26:
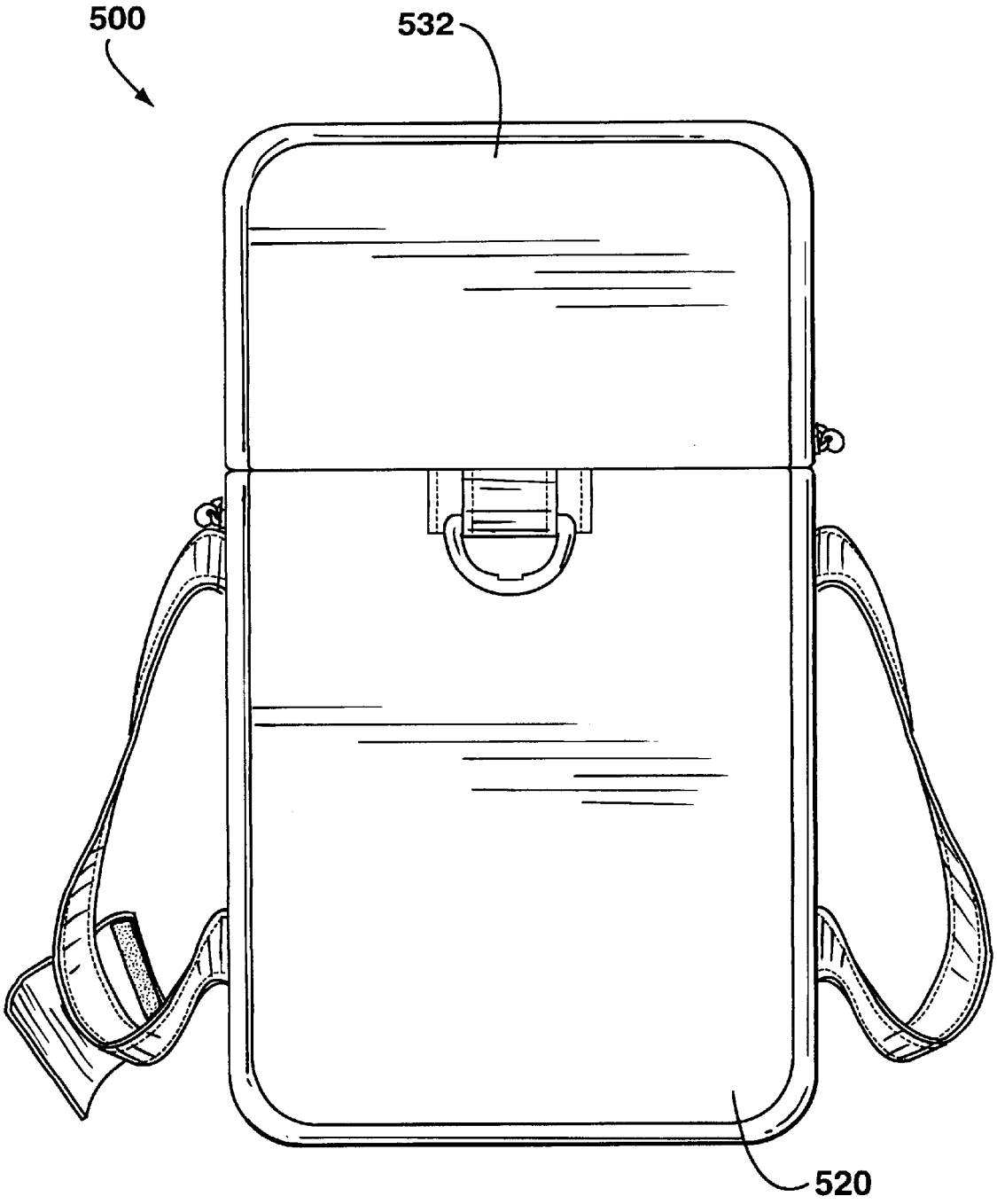
FIG. 26 shows a plan view of the assembly of FIG. 15.
Figure 27:
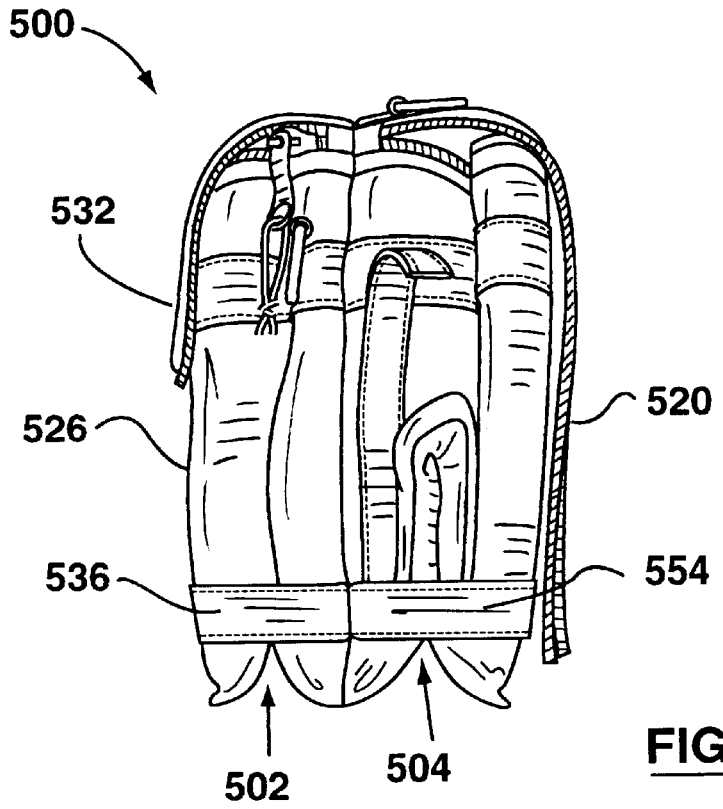
FIG. 27 shows a right-hand side elevation of the assembly of FIG. 20.
Figure 28:
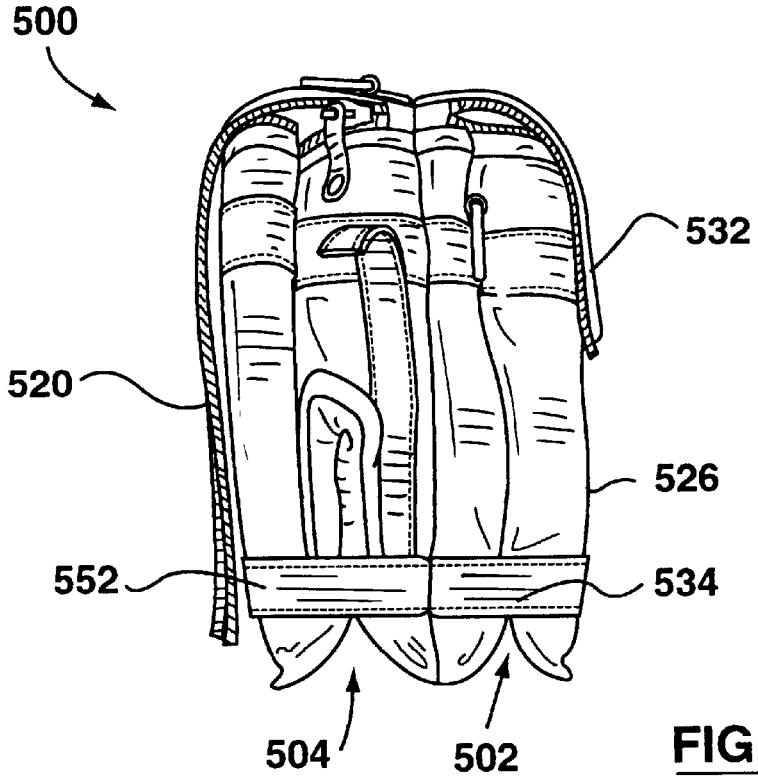
FIG. 28 shows a left-hand side elevation of the assembly of FIG. 20.
Figure 29:
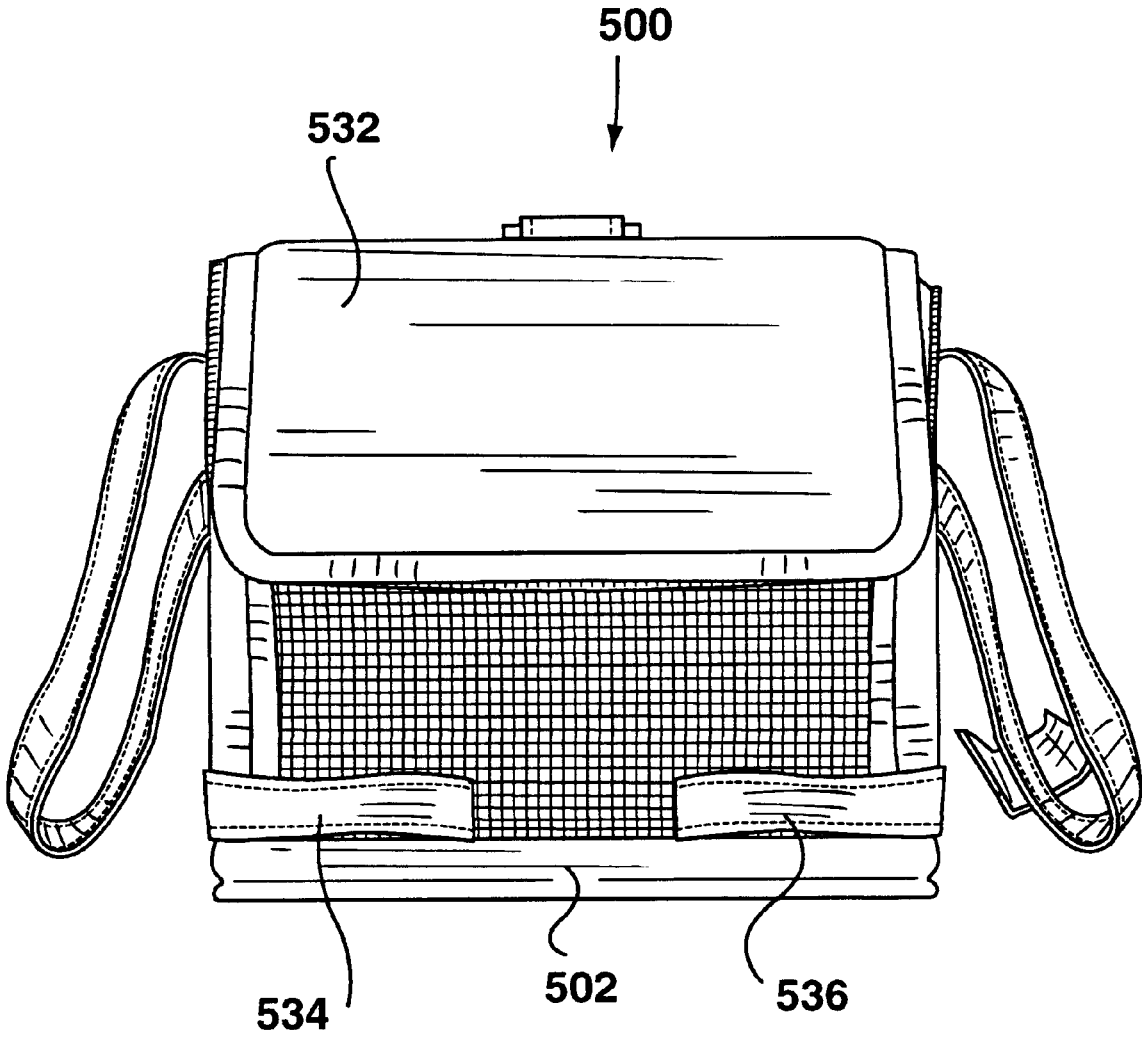
FIG. 29 shows a near end view of the assembly of FIG. 20.
Figure 30:
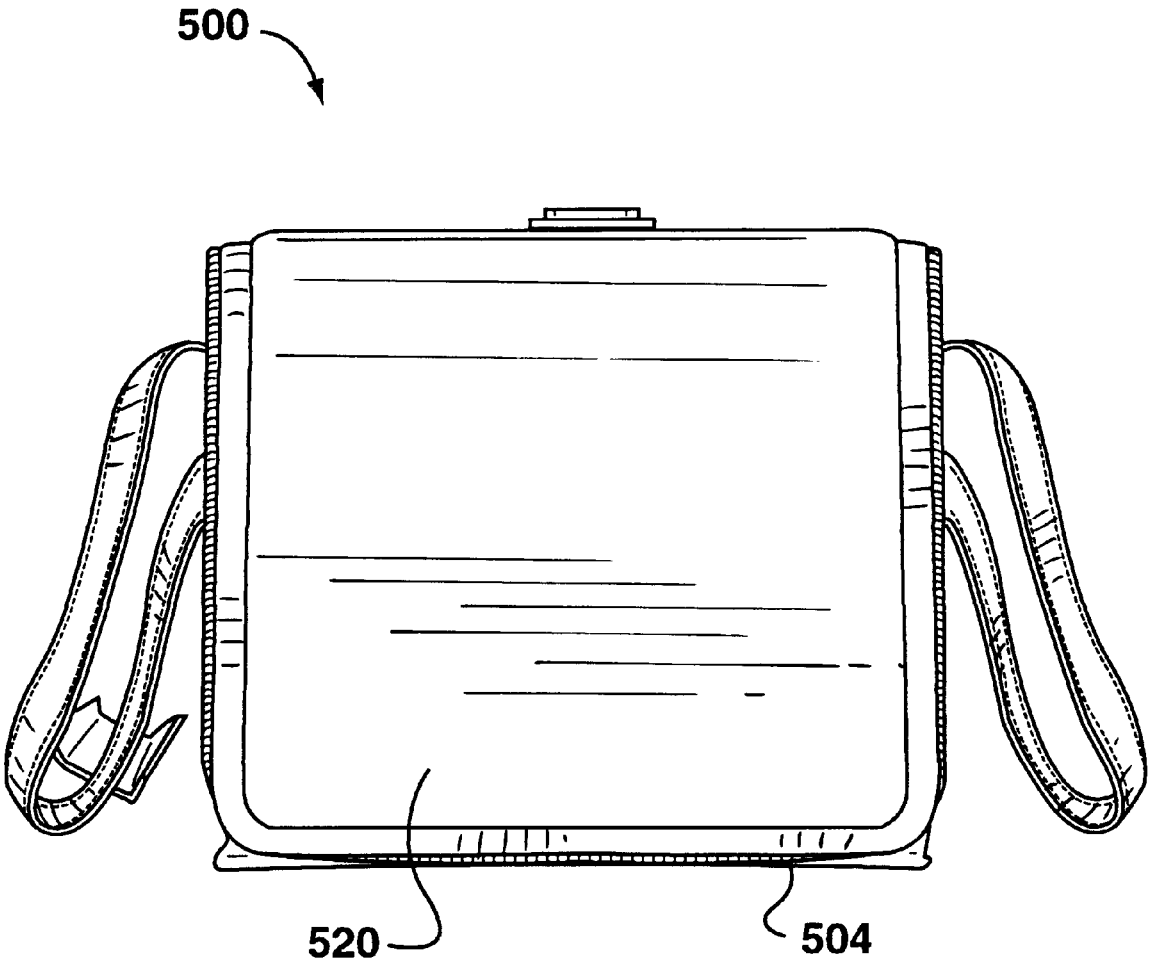
FIG. 30 shows a far end view of the assembly of FIG. 20.
Figure 31:
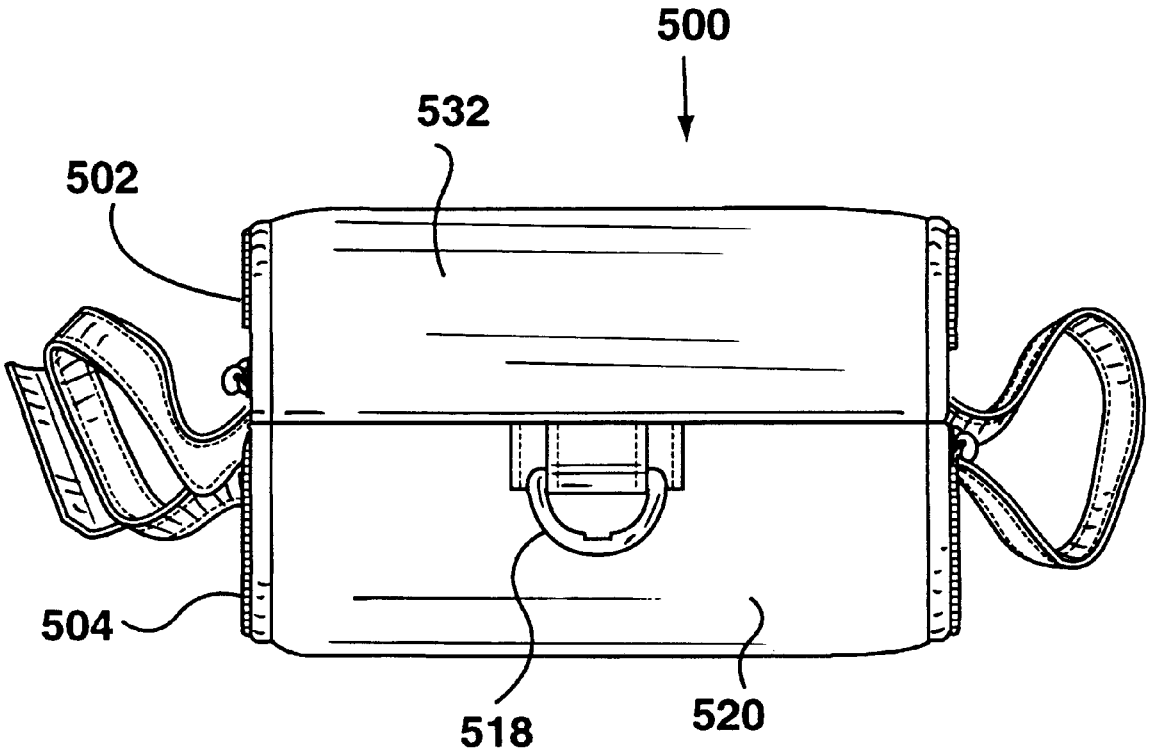
FIG. 31 shows a plan view of the assembly of FIG. 20.
Figure 32:
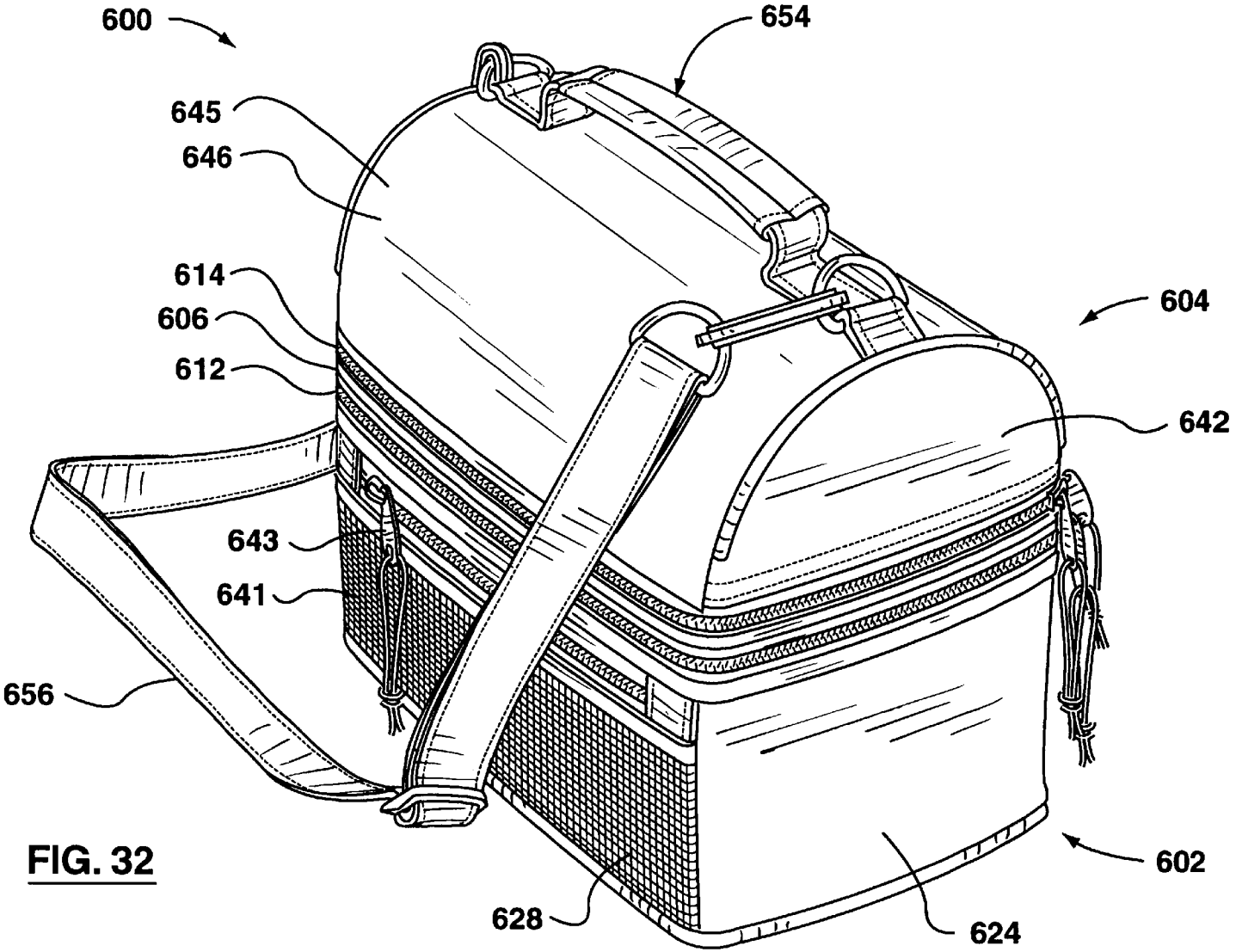
FIG. 32 shows a perspective view of an alternative embodiment of an assembly to that of FIG. 15.
Figure 33:
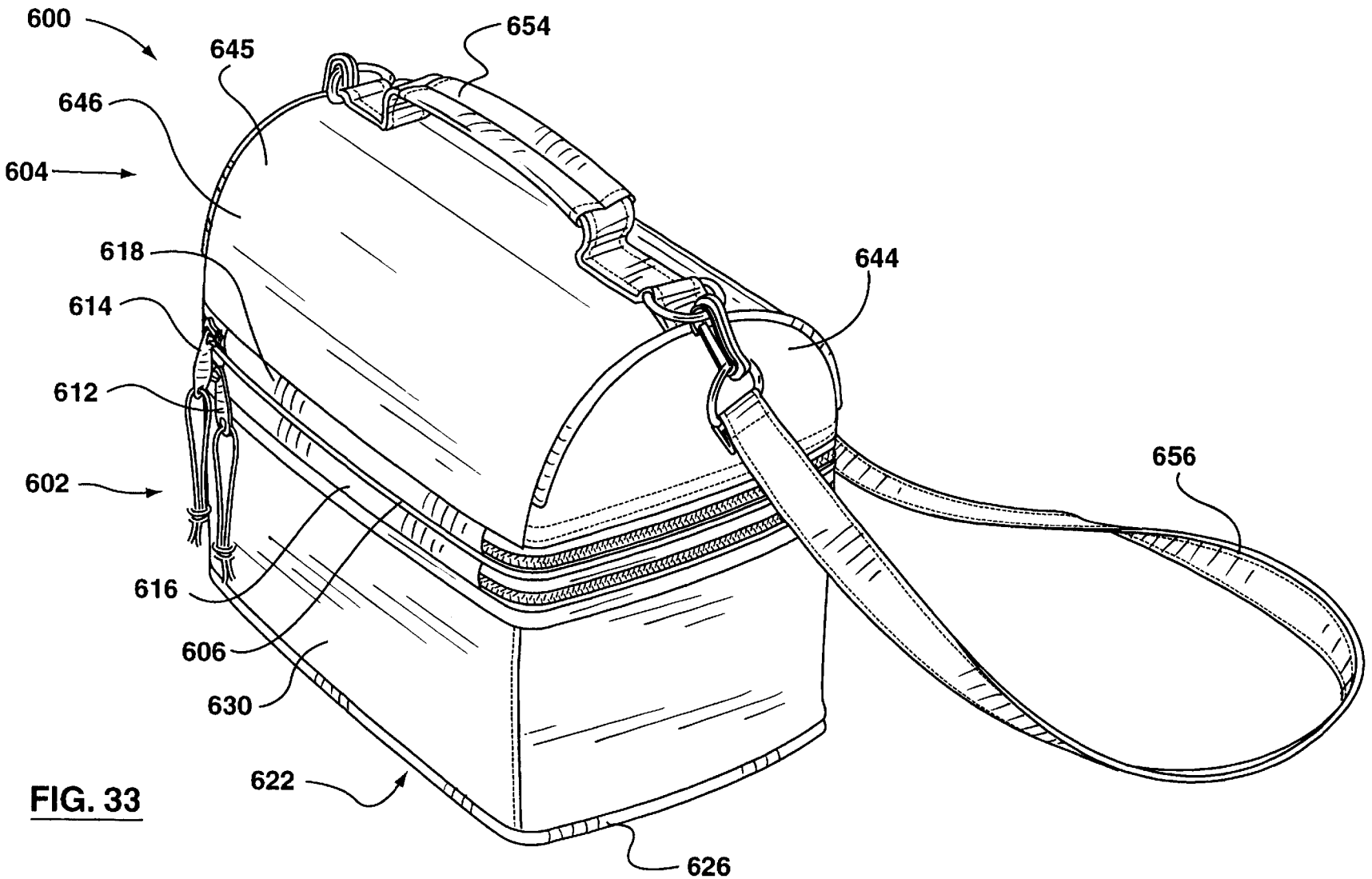
FIG. 33 shows a perspective view of the assembly of FIG. 32 taken from a view diagonally opposite to that of FIG. 32.
Figure 34:
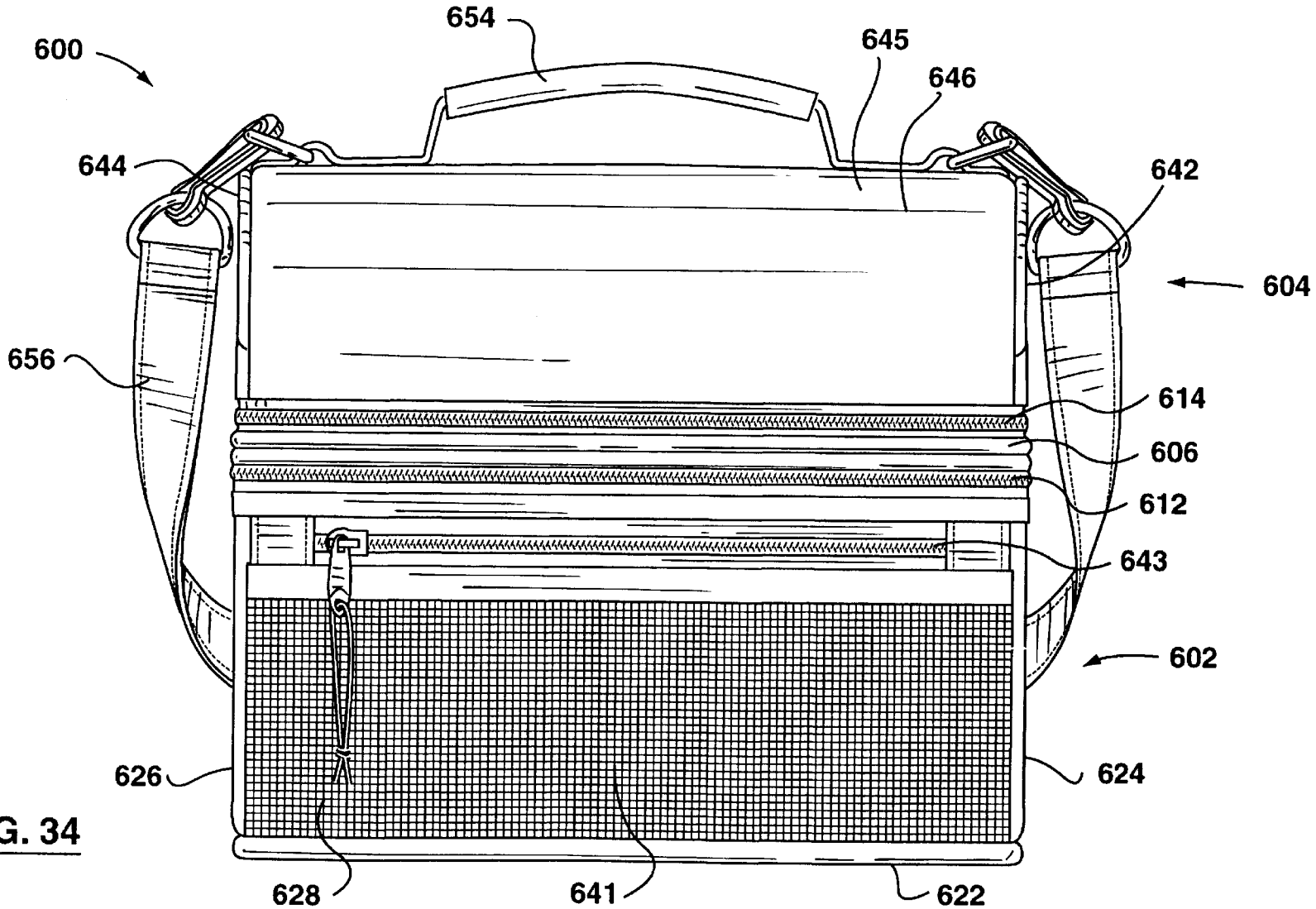
FIG. 34 shows a front view of the assembly of FIG. 32.
Figure 35:
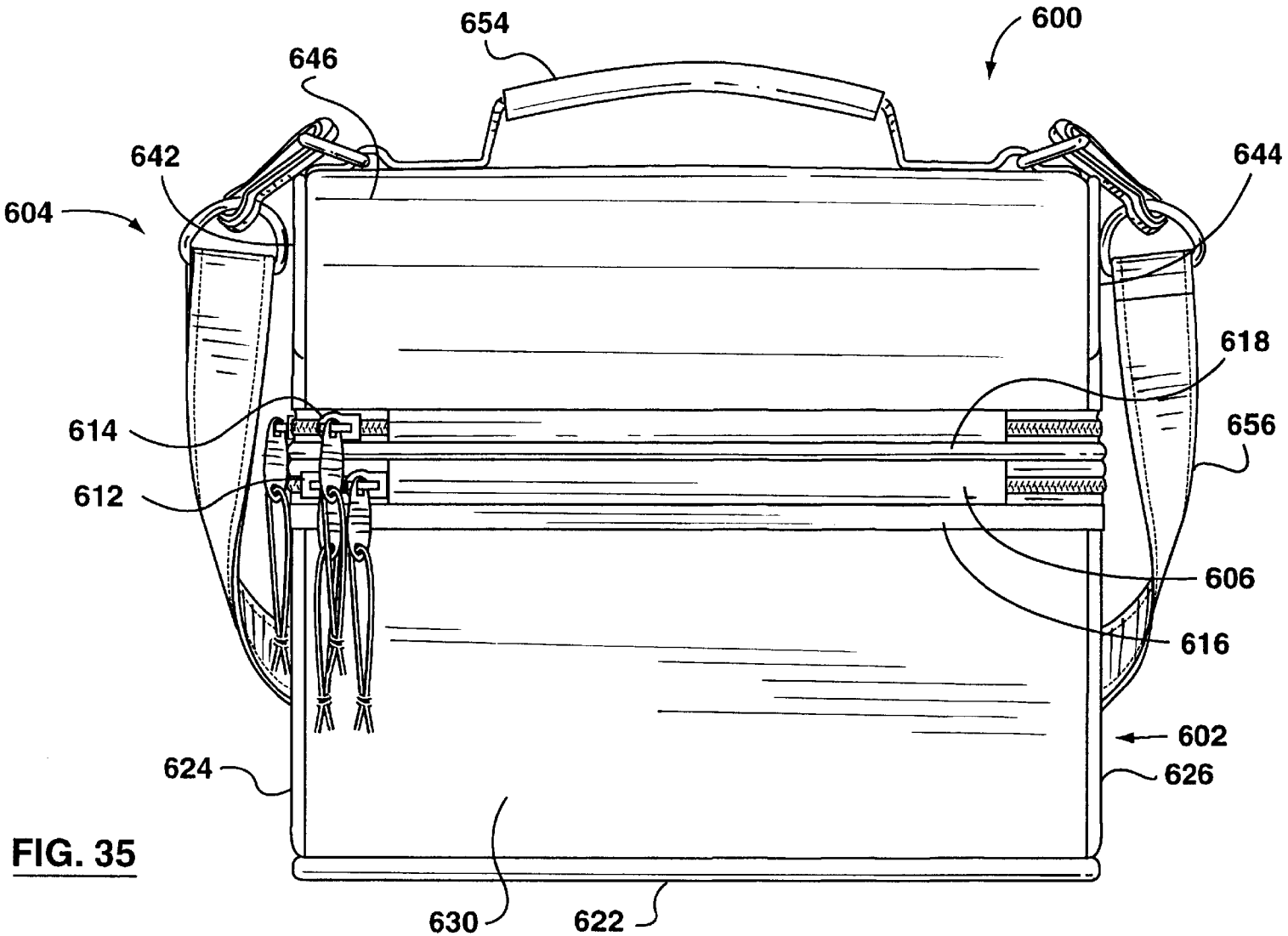
FIG. 35 shows a rear view of the assembly of FIG. 32.
Figure 36:
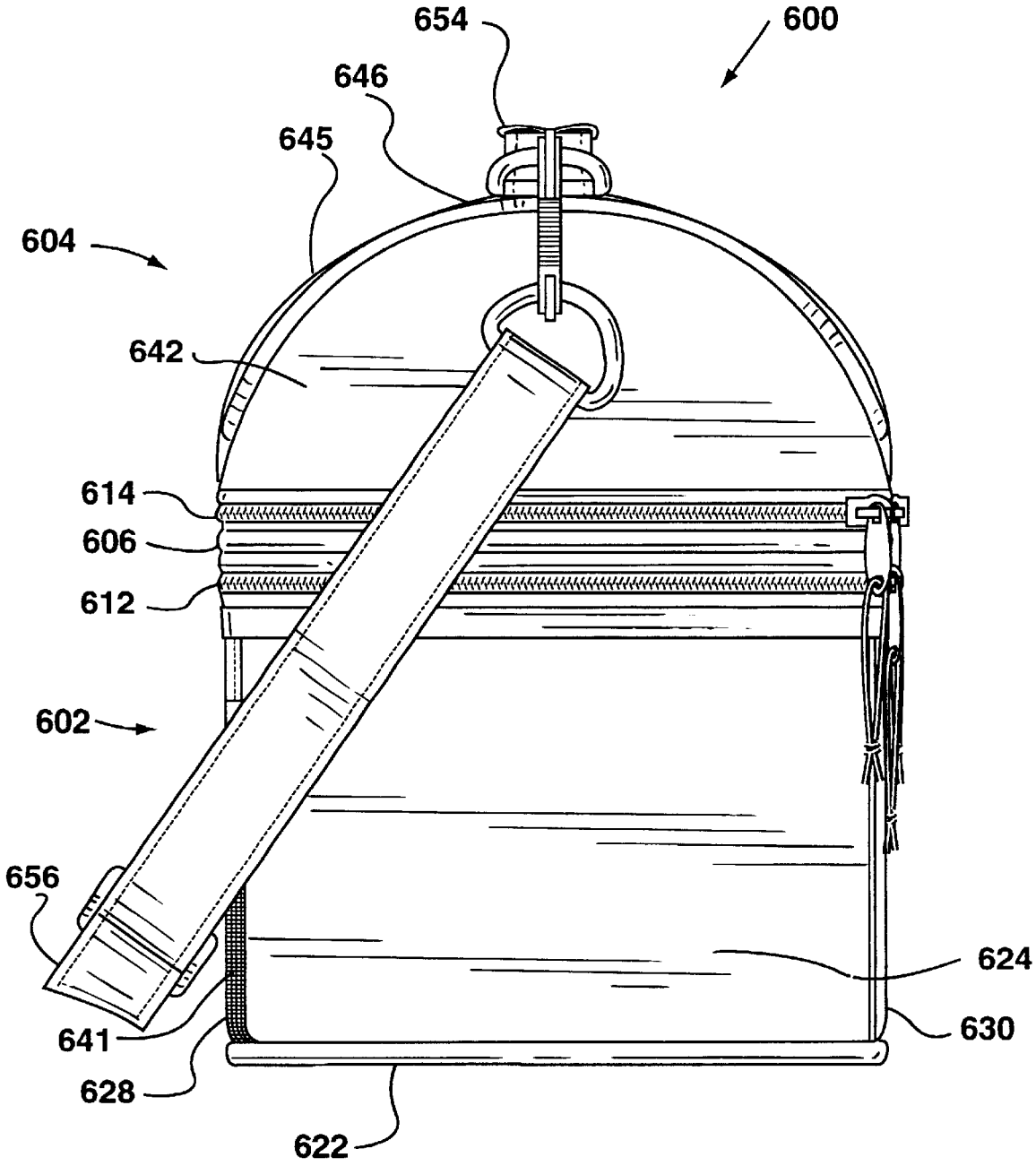
FIG. 36 shows a left hand view of the assembly of FIG. 32.
Figure 37:
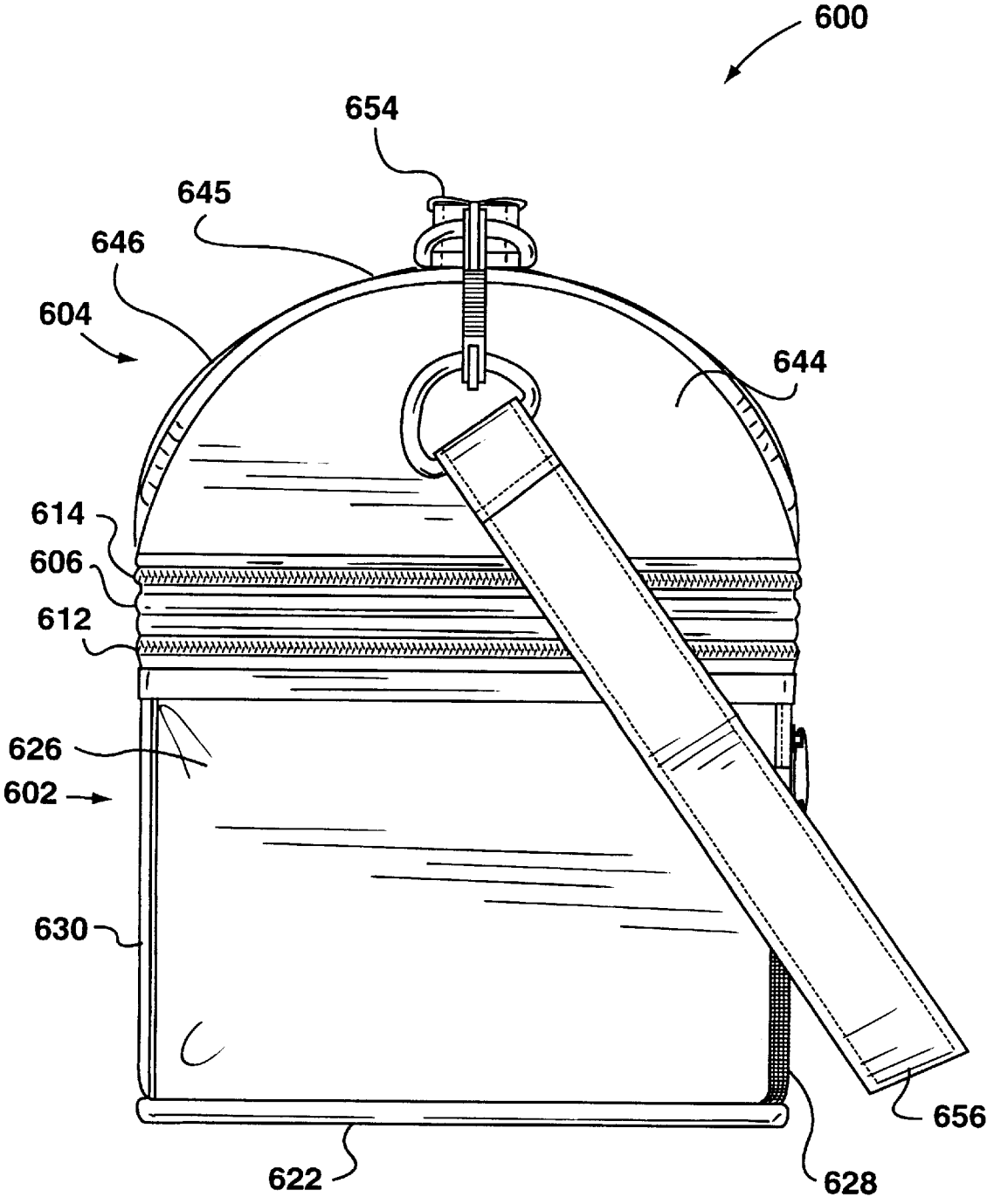
FIG. 37 shows a right hand view of the assembly of FIG. 32.
Figure 38:
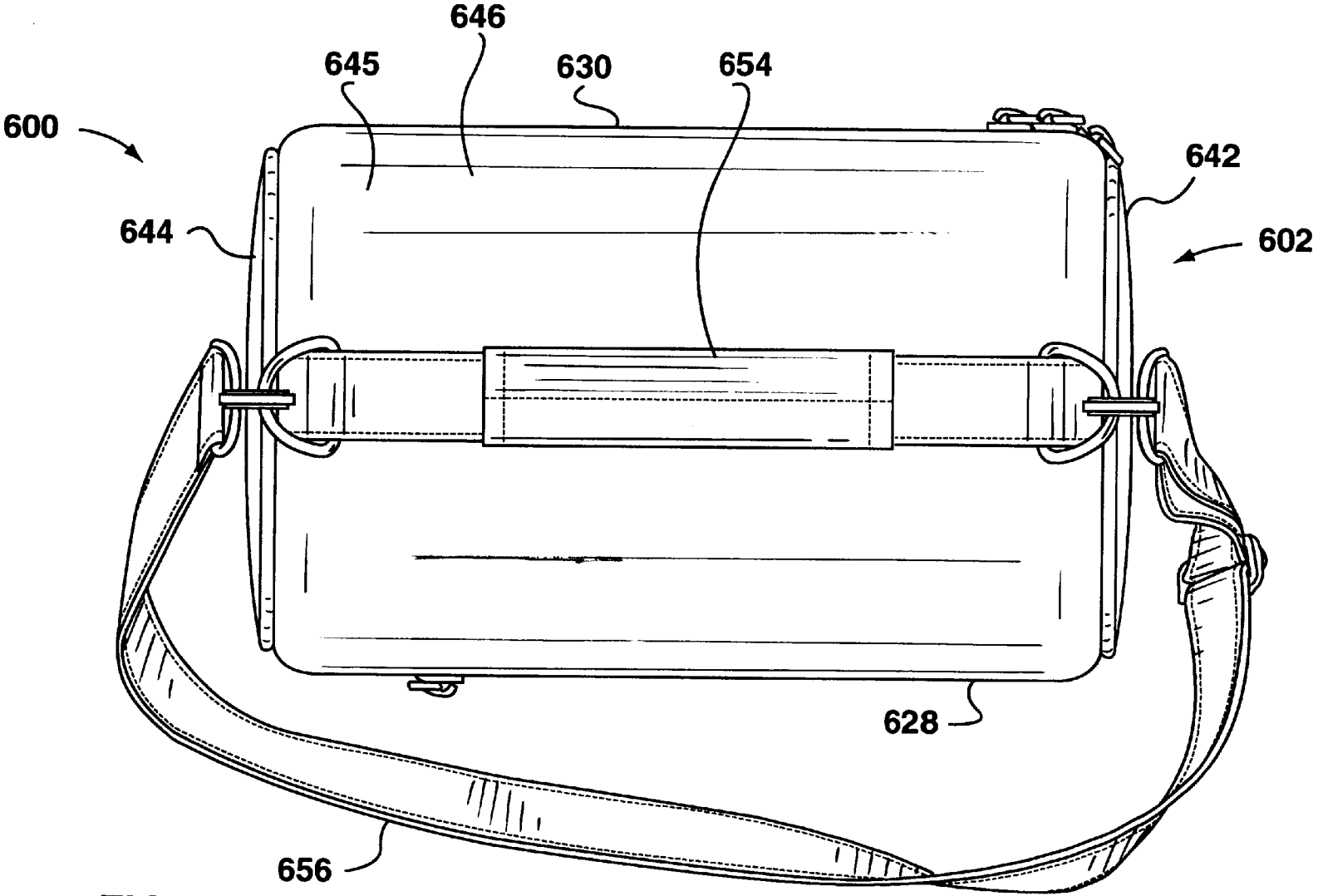
FIG. 38 shows a top view of the assembly of FIG. 32.
Figure 39:
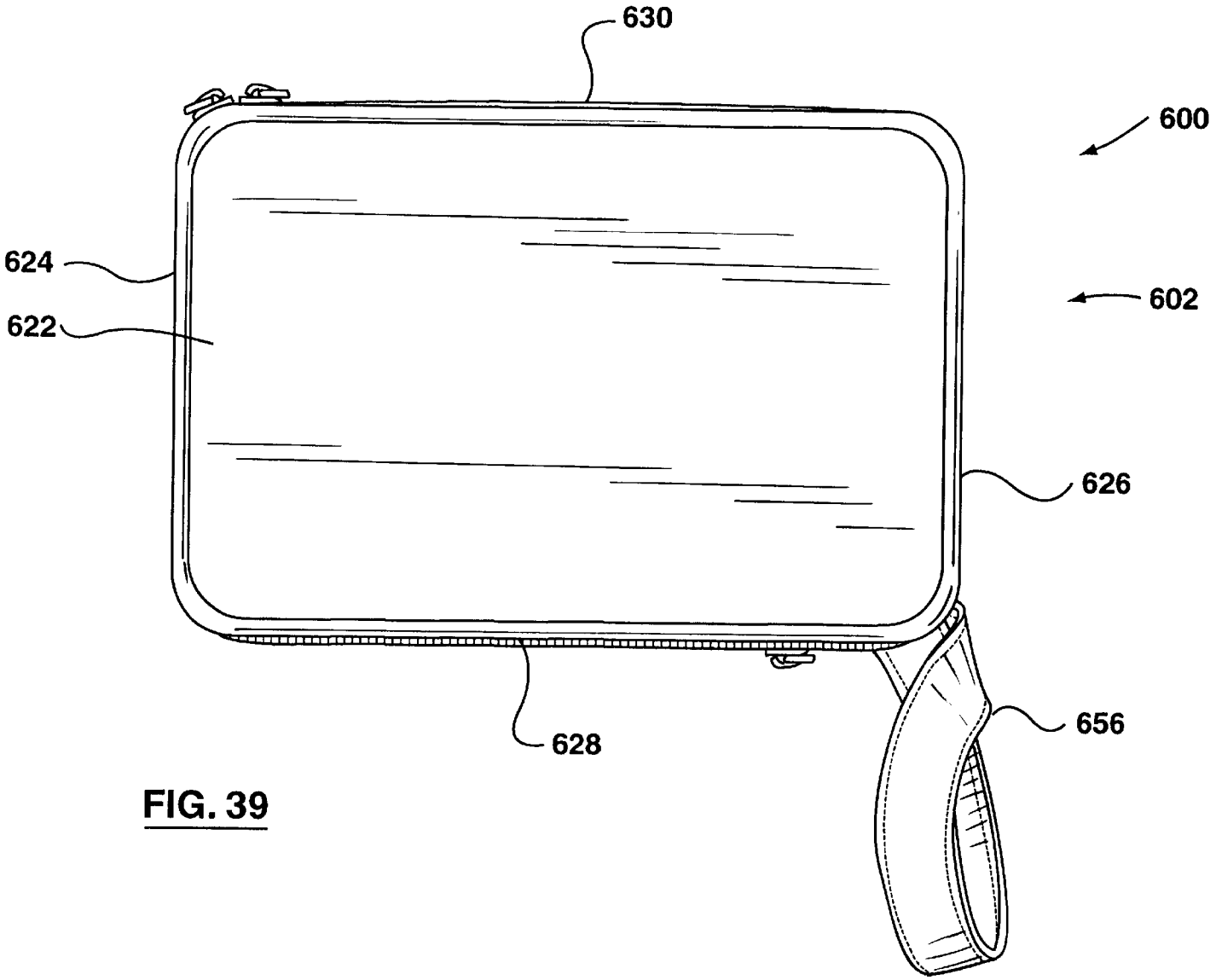
FIG. 39 shows a bottom view of the assembly of FIG. 32.

FIGS. 15 to 31 show an alternative type of soft-sided, insulated wall, collapsible container assembly, indicated generally as 500. In FIG. 15, a first container portion is indicated generally as 502, and a second container portion is indicated generally as 504. As illustrated, first portion 502 is the same width and height as second portion 504, but is of lesser length. In the embodiment illustrated this difference is in the ratio of approximately 2:1, but could be greater or lesser, typically in the range of 1:1 to 5:1.

The basic lid, bottom, and sidewall construction of each of the first and second portions is the same as described above in the context of containers 22 and 422. Each has the general form of six-sided softwalled box, with portions 502 and 504 being joined at a common insulated wall 506 that is silvered on both sides. As with containers 22 and 422, a pair of left and right hand carrying handles 508 and 510 are provided, being mounted to main sidewall portions 512 and 514 of second portion 504. The front and rear faces each have a ring mounting 515, 516 to which a carrying strap, such as a shoulder strap, (not shown) can be attached. A top ring fitting 518 is mounted to the lid portion 520 of second portion 504, and is rooted in the joint between first and second portions 502 and 504.

End face 522 of first portion 502 has a peripheral strap 524, and a see through mesh pocket 526 in the manner of pocket 84 described above. A hook and eye fastener strip 528 is mounted laterally to pocket 526 adjacent to, and below its lip to provide an anchoring location for a mating fastener strap 530 mounted to the inner lip 531 of the inside face of lid portion 532 of first portion 502. First portion 502 also has a pair of storage fastening straps, in the nature of left and right hand side retainers 534 and 536 rooted in the main junction, that extend to engage either fastening strips 538 and 540 (similar to items 70 and 72, above) when in the collapsed position described above, or storage strips 542 and 544 (similar to items 74 and 76) when the cooler is in its expanded position.

Second portion 504 also has a peripheral strap, 550, side retainers 552 and 554, and collapsed and open position hook and eye fastener patches 556, 558, 560 and 562. End face 564 of second portion 504 does not have a lateral strip similar to strip 528. Instead, the outer end tang 566 of each of retainers 552 and 554 has a hook and eye fabric fastener patch on both inside and outside faces. In that way, when second portion 504 is collapsed, retainers 552 and 554 engage patches 560 and 562. Then lid portion 520 is drawn downwardly over end face 564 and a fastening strip 570 mounted inside the lip of lid portion 520 engages the outside face patches of tangs 566, and is retained in place by them.

Each of portions 502 and 504 is provided with a liner, 572 and 576 respectively, either or both of which can be provided with an insulated partition analogous to partition 425, as described above in the context of FIGS. 12, 13 and 14. It is not necessary that both portions 502 and 504 have a water-tight liner, since it may be that only one chamber is required for containing a wet object or objects. The double-cooler arrangement illustrated provides a fixed, water-tight barrier between one environment, that prevailing in chamber 580 of first portion 502, and another environment, that prevailing in chamber 582 of second portion 504. In the event that partitions are provided, those chamber can themselves be further divided. Although the relative sizes of chambers 580 and 582 are fixed, wall 506 provides a more substantial thermal barrier than the moveable partitions. Further, lid portions 520 and 532 provide separate access to the respective compartments, that is, chambers 580 and 582. Assembly 500, like assemblies 20 and 420 provides the combination of a liquid containment barrier for discouraging unwanted escape of liquid, and an environment segregation barrier by which to separate cool and cold, cold and hot, wet and dry, or soft and hard. However, in the former two cases, the physical segregation barrier, that is, partition 25 or 425, is mounted within the moisture containment barrier, that is either liner 28 or 428. In the latter instance whether or not there is also a moveable partition provided, the moisture containment barrier lies to one side of the dividing wall, in the nature of common wall 506.

FIGS. 32 to 41 show a soft-sided insulated container assembly, indicated generally as 600. It has a first, or lower portion, indicated generally as 602, a second, or upper portion, indicated generally as 604, and an insulated partition 606 segregating the interior of lower portion 602 from the interior of upper portion 604. As with collapsible container assembly 500, container assembly 600 has two separate enclosures, or chambers, 608 and 610, defined within respective portions 602 and 604, each of which can be used to encourage the contents thereof to be maintained at a different temperature. For example, one chamber, be it 608 or 610, can be used to keep one type of food or other object warm, while the other is used to keep another food or object cool. In contrast to assembly 500, in which the two chambers 580 and 582 are side by side, container assembly 600 is intended to place chambers 608 and 610 one above the other, as in the manner of a lunch bucket. As with container portions 502 and 504, lower portion 602 and upper portion 604 each have an independent closure member, in the nature of zippers 612 and 614, respectively. However, while portions 502 and 504 have separate opening panels, namely lid portions 520 and 532, in the case of container assembly 600, portions 602 and 604 share a common wall, or enclosing member, namely partition 606. When zipper 612 (or zipper 614) is moved to an open position, the remainder of container assembly 600 is displaceable relative to lower portion 602. That is, the remainder of container assembly 600 is able to move pivotally about a flexible fabric hinge 616 away from lower portion 602 (or, in the case of upper portion 604, the remainder pivots away from portion 604 about a flexible fabric hinge 618), generally in the manner of a pivotable lunch bucket lid. In the case of use of container assembly 600 as a lunch container, such as a student may take to school, or such as may be used for a similar purpose, it is possible to place food in the lower chamber, 608, in the same orientation as it will be carried when container assembly 600 is lifted either by its handle or by its carrying strap. In this way, food carried in container assembly 600 may have less tendency to be squashed of to spill than if packed in a container that is then subsequently carried in a sideways orientation.

Describing this structure in detail, lower portion 602 is a soft-sided insulated wall structure that has a rectangular bottom wall, 622, a left hand side wall 624, a right hand side wall 626, a front wall 628 and a rear wall 630. Walls 624, 626, 628 and 630 are joined in a rectilinear shape about bottom wall 622. The lower margins of walls 624, 626, 628 and 630 mate with the margins of bottom wall 622 to form an upwardly opening, open top box, those walls defining therewithin lower chamber 608. Bottom wall 622 has a reinforced wear resistant outer surface, and rounded corners so that container assembly 600 has corners that are not sharp, but slightly rounded. This tends to facilitate packing of container assembly 600 into larger containers, such as a child's knapsack, and also facilitates use of closure members in the nature of zippers 612 and 614, as zippers tend to follow a radiused curve with relatively greater ease than a sharp corner, even a small radius providing relatively smooth operation.

Figure 41:
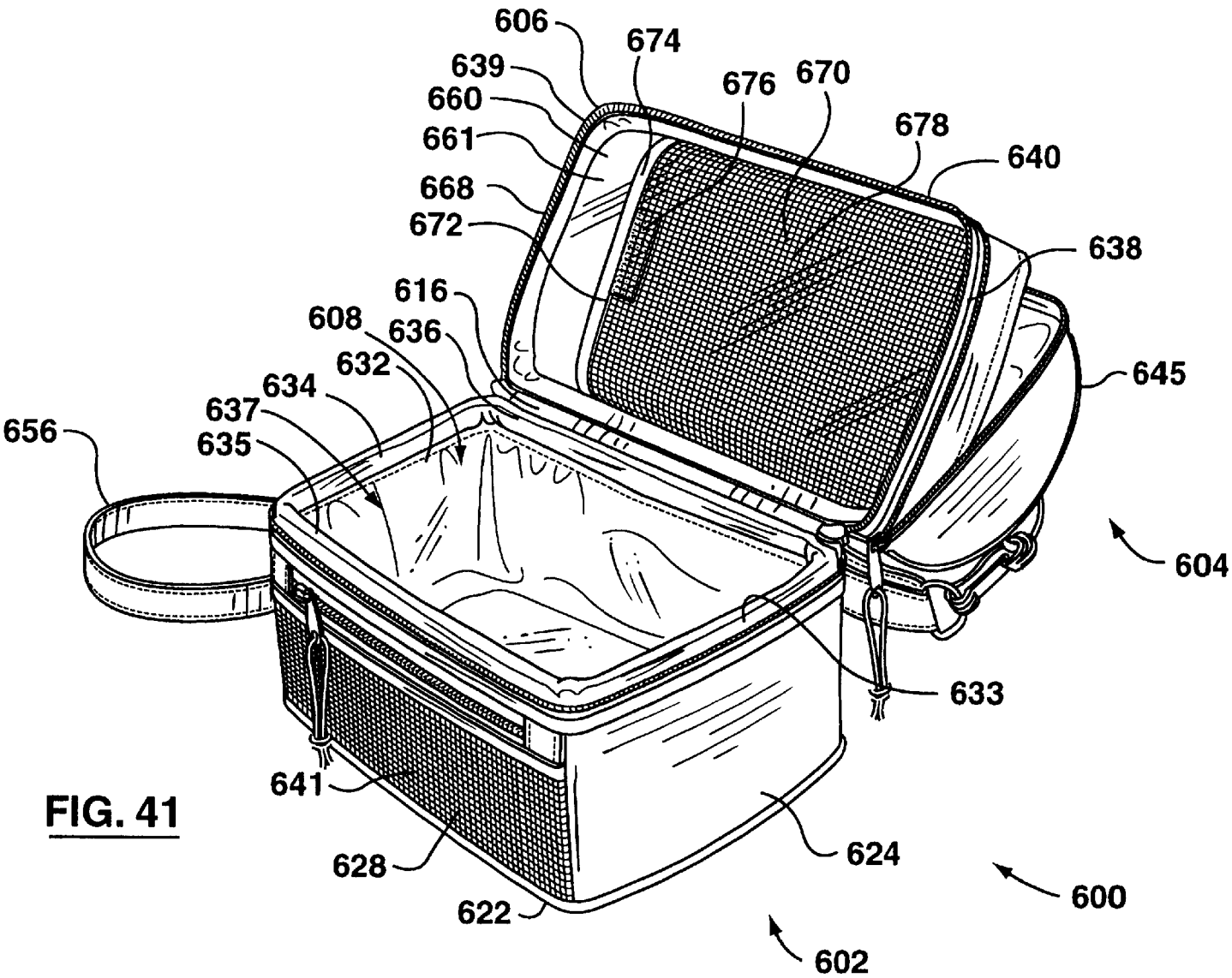
FIG. 41 shows a perspective view of the assembly of FIG. 32 in another open position in which a lower chamber is open.
Figure 42:
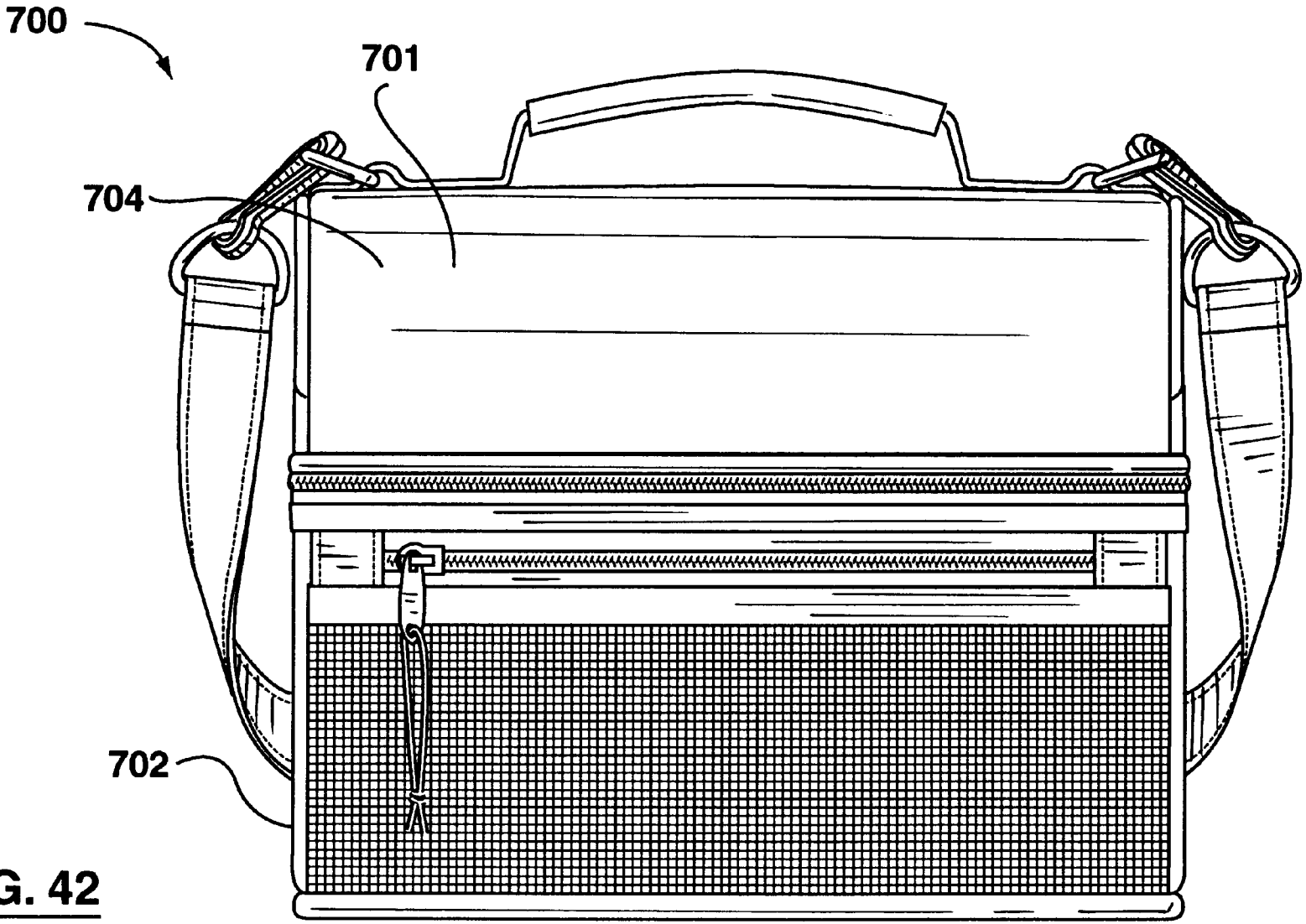
FIG. 42 shows a front view of a container assembly providing an alternative configuration to the assembly of FIG. 32.

As shown in FIG. 41, chamber 608 has a vinyl lining 632 that is secured about the open edges 633, 634, 635, and 636 of walls 624, 626, 628, and 630 and is not otherwise secured, such that lining 632 can be partially inverted to facilitate washing and drying. The upper peripheral margin of lower portion 602, being made up of the upper margins of each of the sides, namely edges 633, 634, 635 and 636, define the lip, or rim, of an opening 637 of chamber 608. At the upper margin of rear wall 630, namely edge 636, rear wall 630 is joined by hinge 616 to a rearward margin, or edge, of partition 606. One set of teeth of lower zipper 612 is mounted about the upper margins of the remaining three sides, namely to edges 633, 634 and 635, and mates with an opposed set of zipper teeth mounted to side and front edges 638, 639 and 640 of partition 606. Movement of the zipper car of zipper 612 allows zipper 612 to be opened and closed, thus controlling access to chamber 608.

The insulated construction of lower portion 602 is the same as that shown in FIG. 10. Lower portion 602 does not, as shown, have an internal, removable clear vinyl liner such as liner 24. Such a liner, whether seamed or seamless, is optional. Lower portion 602 has an open mesh pocket 641 mounted to front wall 628 for carrying loose items, pocket 641 being opened and closed by a closure member in the nature of a zipper 643.

Figure 40:
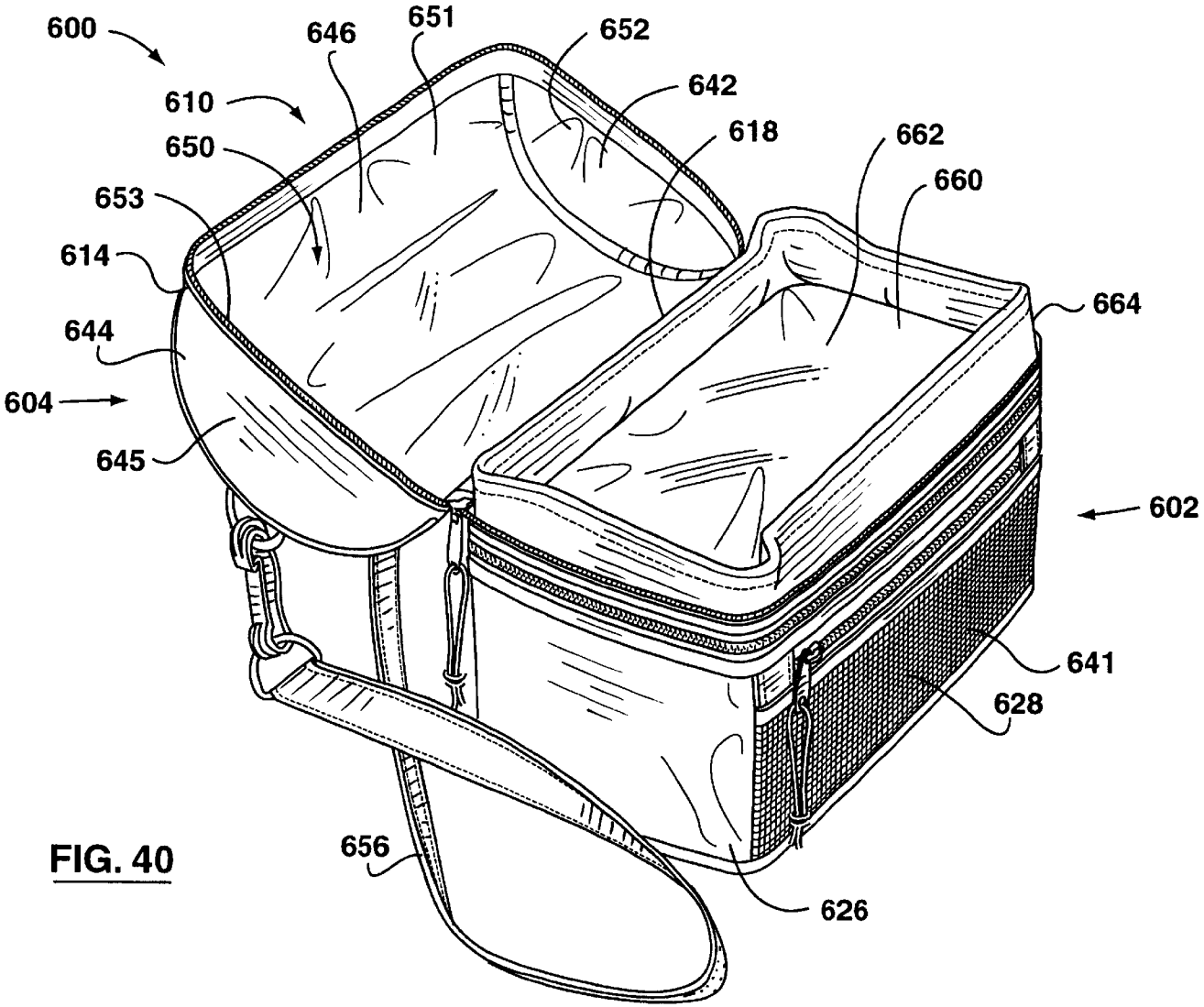
FIG. 40 shows a perspective view of the assembly of FIG. 32 in a first open position in which an upper chamber is open.

As shown in FIG. 40, upper portion 604 is an upper, or second, soft-sided insulated wall structure. It has a pair of flexible, insulated end walls 642 and 644 that have a shape similar to a 'D' placed on its side, or a rounded, inverted 'U', such as to give upper portion 604 a profile when seen from an end view as in FIG. 36 or 37 that defines a container lid contour similar to the end view of a rounded top of a lunch bucket. While a generally semi-circular profile is shown, alternative embodiments need not be precisely semi-circular, but could include an arc describing less than 180 degrees, could include straight portions adjoining radiused portions, or could include a parabolic or elliptic curve, or an arbitrarily chosen curve giving a generally arch-like, domed profile.

A flexible, insulated top panel 646 extends between end panels 642 and 644 and is joined to them at sewn end seams such that panel 646 has a curved form to follow the end profile described in a rounded, generally semi-cylindrical, or partially cylindrical manner, the lower margins of each of end walls 642 and 644 forming a chord of the curved shape. When formed on an arc in this way, top panel 646 may tend, in co-operation with end panels 642 and 644, to form a stiffer section than if panel 646 were replaced by a planar top panel. The cover, or lid structure, indicated generally as 645, that is formed by the co-operation of panel 646 and end walls 642, 644 defines within it upper chamber 610. Lid structure 645 has the general appearance of the top of a lunch bucket, although it is soft-sided and relatively flexible, rather than rigid in the manner of a metal structure. The lower margin of lid structure 645, namely the lower front and rear edges of longitudinal panel 646 and the lower edges of the left and right hand end panels, 642 and 644, is of a size and shape that corresponds to the upper margin of lower portion 602 such that the one soft-sided insulated wall structure can sit upon the other in an aligned manner, the respective lengths and widths corresponding one to another.

Panel 646 is joined along its rearward lower margin, or edge, to partition 606 by flexible hinge 618. One set of teeth of zipper 614 is mounted along the lower margins of end walls 642, 644 and the front lower margin of panel 646, with the corresponding set of mating teeth being mounted to adjacent edges of partition 606 such that zipper 614 has a three-sided U-shape, and is moveable between open and closed positions to govern access to chamber 610 defined within panel 646 and end walls 642 and 644. Chamber 610 has a generally rectangular opening 650 defined by the lower margins, or edges of panel 646 and end walls 642 and 644 as described above. Objects can be introduced into chamber 610 through opening 650 when zipper 618 is in its open position.

The construction of panel 646 and end walls 642 and 644 is generally as described above, incorporating an external skin of a flexible, wear resistant material such as a woven nylon; a medial, closed cell insulation layer; and a reflective inner skin such that inside surfaces 651, 652 and 653 of panel 646 and end walls 642 and 644 respectively, have a shiny finish.

A suspension member, in the nature of a carrying handle 654, is mounted centrally on panel 646, with its bail and reinforcement webbing oriented to run longitudinally, that is, parallel to the crest of panel 646. Another suspension member, in the nature of a carrying strap 656, is connected by releasable clasps to mounting rings lying adjacent to the apices of either end wall, 642 or 646. In alternative embodiments, a suspension member, whether in the nature of handle 654 or in the nature of carrying strap 656 or another suspension means, need not be mounted precisely at the crest of panel 646, or at the respective apices of end panels 642 and 644, but can be mounted in such a manner that the center of lift of the suspension member is at a level, measured relative to the base side, lying above the level of the center of gravity of the container when packed. It is preferable that the center of lift lie directly above the center of gravity such that an axis intersecting both the center of lift and the center of gravity is perpendicular to the base side.

Partition 606 is a flexible insulated structure, including a panel 660 having a closed cell foam insulation layer such as shown in FIG. 10, captured between reflective skins 661 and 662 that define lower and upper surfaces thereof respectively. Zippers 612 and 614, and flexible hinges 616 and 618 are mounted about the peripheral edges of panel 660 as described above. In addition, a retainer in the nature of an upstanding peripheral wall member, identified as a rim, or lip, 664 having front, rear, left hand and right hand side portions, is mounted continuously about the outer edges of panel 660. Lip 664 extends away from, or, in the orientation shown, upwardly relative to, panel 660 to an altitude that, in the embodiment illustrated is 1.5 inches, or slightly more than half the height of end walls 642 and 644. This generous lip acts as a retainer to urge an object, such as a round cylindrical beverage tin, not to roll away, or a smooth object, such as a plastic soup container not to slide, but to remain in place while the top, or lid structure 645 is being opened or closed. In the alternative, lip 664 could be of lesser height, such as a height between ⅜ inches and 1–½ inches, or a proportion of the internal height of chamber 610 that is less than ½, whether lying in the range of ⅕ to ½ at a height such as ¼, ⅓, or ⅖ of the height of chamber 610. Lip 664 tends to lean inward relative to the periphery of panel 660, such that 664 seats inside the lower margins of lid structure 645 as lid structure 645 closes.

A peripheral rim or lip 668 depends from the underside of panel 660, and extends fully about the front, rear, left hand and right hand margins thereof inside hinge 616 and zipper 612, and, when zipper 612 is closed, lip 668 engages the lip formed about opening 637 tending thereby to form an insulating seal. A ventilated panel, in the nature of a mesh web 670 is attached to the underside of panel 660 by having its edges sewn into the same seam as three sides of lip 668, such that a receptacle in the nature of a pocket 672 is defined between web 670 and lower surface 661 of panel 660. Pocket 672 has a lip 674, and immediately inside lip 674 there is a pocket closure, or fastener, in the nature of a fabric hook and eye strip closure 676. Pocket 672 is of a size to enclose a thermal energy storage element 678, such as an ice pack or heating pack, such that the temperature in chamber 608, and of objects therein, can be influenced to have a warmed or cooled condition relative to external ambient. In an alternative embodiment, lid structure 645 can also be provided with a similar pocket and thermal energy storage element.

Another, preferred embodiment of a two chamber, soft-sided insulated container assembly is shown in FIGS. 42 to 47 as 700. Container assembly 700 has an appearance similar to container assembly 600, but differs from it, and from container assembly 500, insofar as while it has two segregated insulated chambers, rather than having one chamber beside the other, as in container assembly 500, and rather than having one insulated chamber atop the other, as in container assembly 600, container assembly 700 has one chamber that fits removably inside the other. Although assembly 700 is preferred by the inventor, it has been observed that some users prefer item 600 and some prefer item 700 according to their own needs or tastes.

Figure 43:
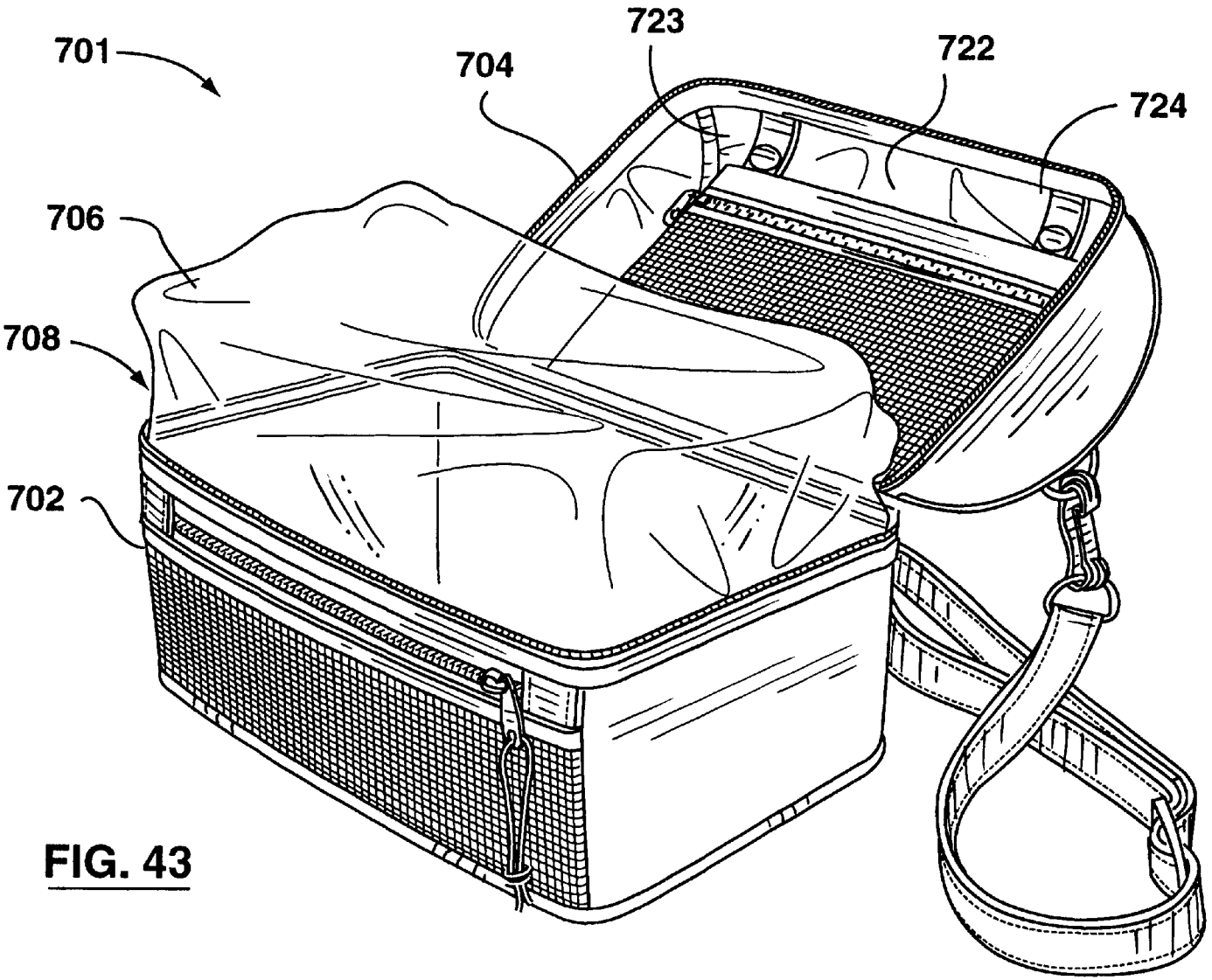
FIG. 43 is a perspective view of part of the container assembly of FIG. 42 in an open position with a liner drawn out for cleaning.

In greater detail, container assembly 700 has a primary enclosure structure, or container, 701 having a first soft-sided insulated wall structure in the nature of a lower portion 702, and a second soft-sided insulated wall structure in the nature of an upper portion 704. Lower portion 702 has the same construction as lower portion 602 of container 600, and upper portion 704 has the same shape and construction as upper portion 604 of container assembly 600. Lower portion 702 differs from lower portion 602 insofar as its component bottom, front, rear, left hand and right hand walls present a reflective inner surface. A clear plastic liner 706 made of vinyl, is mounted within lower chamber 708 and is sewn into rim 710 formed about opening 712 of chamber 708. Rim 710 defines the upper peripheral margin of lower portion 702, that upper margin including the upper margins of each of the front, rear, left hand and right hand sides of lower portion 702. As also noted in the context of other liners described herein, liner 706 can be inverted to facilitate washing and drying, as shown in FIG. 43. One strip of a hook-and-eye fabric fastening is indicated as 711. The purpose of strip 711 is described below.

Upper portion 704 has the same structure as lid structure 645, but is deeper due to the use of only a single closure member, in the nature of zipper 714, rather than the double closure member arrangement of zippers 612 and 614. The volume of upper portion 704 can be defined as that volume lying within upper portion 704 above the level of zipper 714, while the volume of lower portion 702 can similarly be defined as the volume lying within the walls of portion 702 below the level of zipper 714. Zipper 714 and flexible fabric hinge 716 running along the back of container 701 at the level of zipper 714, define openings 712 and 720 of lower and upper portions 702 and 704 respectively. As described, lower portion 702 and upper portion 704 of container assembly 700 co-operate to define an internal chamber 715, having the combined volumes of a first chamber portion, namely the volume of lower portion 702, and of a second chamber portion, namely the volume of upper portion 704. As noted, the second soft-sided insulated wall structure, namely upper portion 704, is displaceable relative to the first soft-sided insulated wall structure, namely lower portion 702, the one being pivotable relative to the other between open and closed positions, thereby giving access to the chamber defined therein.

Figure 44:
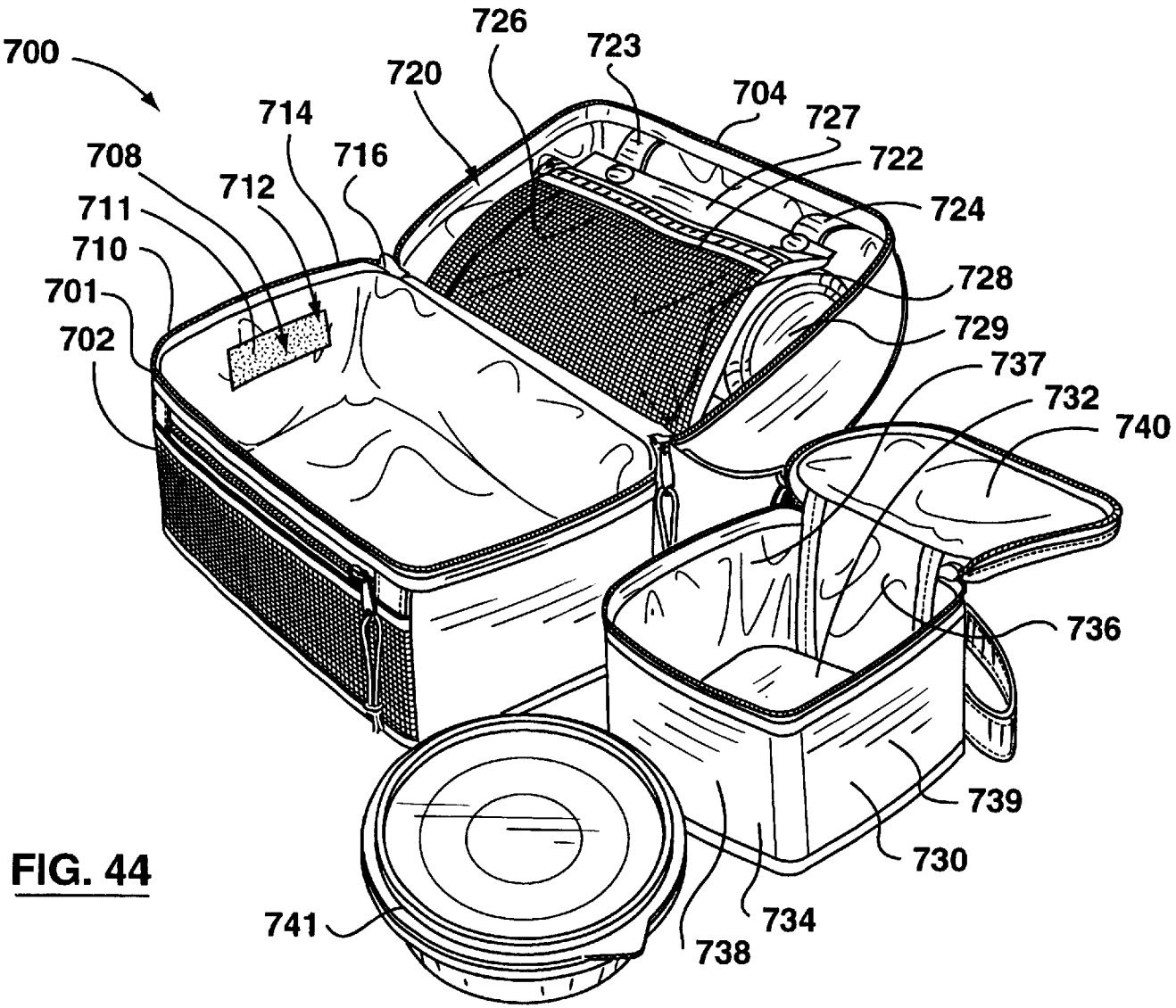
FIG. 44 is a perspective view of the container assembly of FIG. 42 with primary and secondary chambers ready for loading.

Unlike container assembly 600, container 701 has a flap, divider, partition or suspension member, in the nature of a sling 722 mounted as a suspended span across opening 720, one side being attached to hinge 716 by a continuous fabric hinge, the other side being connected to the opposed inner lip, or rim, of upper portion 704 by a pair of spaced apart snaps 723, 724. Sling 722 permits circulation of air between the upper and lower volumes from each other, and is not insulated. Sling 722 has, on the underside thereof, a pocket 726 having an open mesh flap. Pocket 726 is opened and closed by a zipper 727 lying along the outer, or distal edge, that is, the edge lying next to snaps 723 and 724. An energy storage element, in the nature of a heating or cooling pack, indicated as 728, can be placed in pocket 726 to influence the temperature in container 701. As shown in FIG. 44, a beverage such as a canned drink, 729, can be placed, typically longitudinally, between sling 722 and the lid structure of upper portion 704. When the lid portion, that is, upper portion 704, is closed, the beverage is carried above lower portion 702 by sling 722. As such, the beverage is in a position to be influenced directly by conduction heat transfer to or from pack 728. An address label pouch, attached to sling 722, is shown as item 721.

Figure 45:
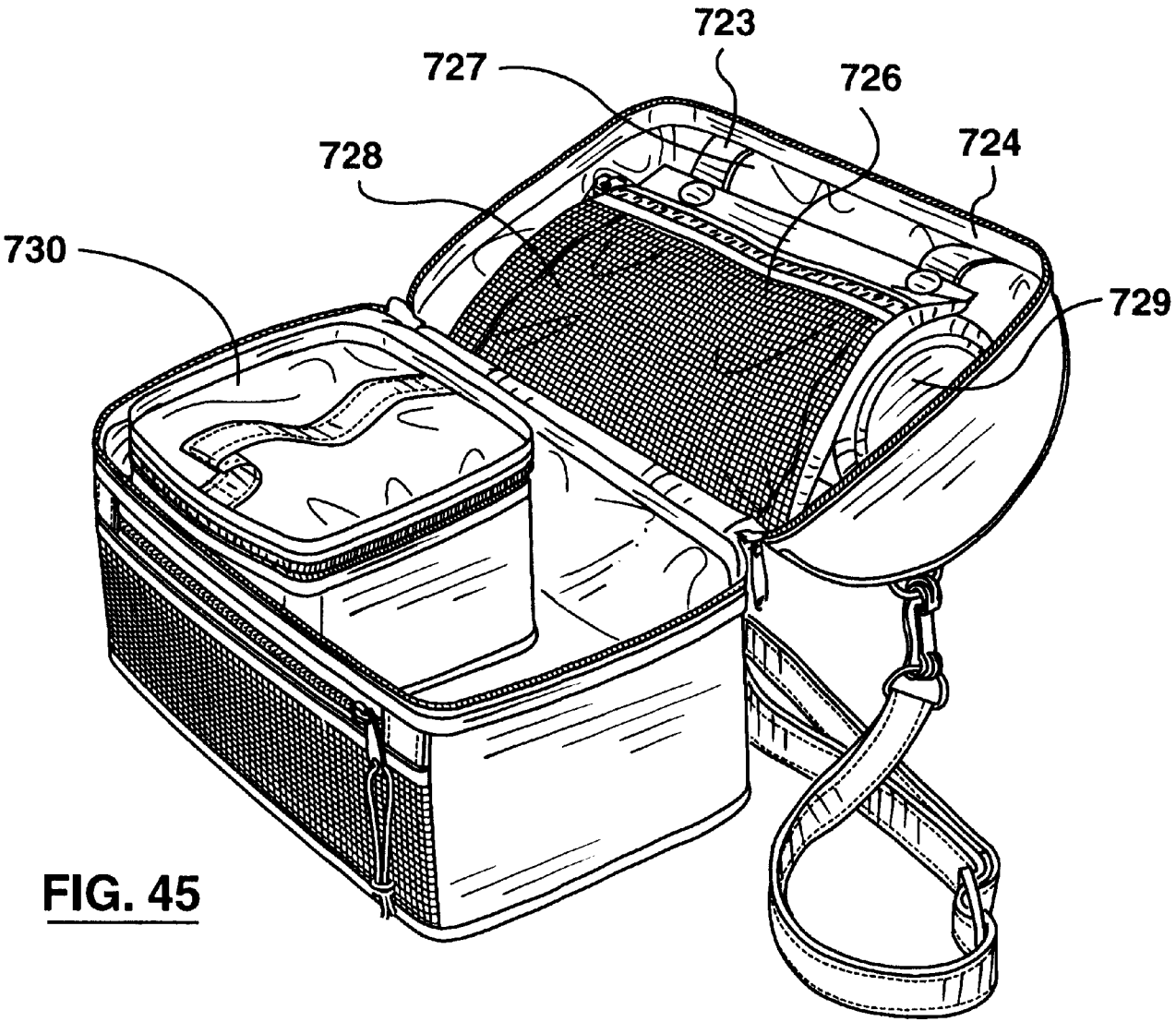
FIG. 45 is a perspective view of the container assembly of FIG. 42 with a secondary enclosure nested inside a primary enclosure.

In contrast to container assembly 600, container assembly 700 does not have a partition segregating the volumes of lower portion 702 and upper portion 704 from each other, and hence has only a single peripheral zipper. Rather, a third soft-sided, insulated wall structure is provided, in the nature of secondary soft-sided insulated container 730. Container 730 is has a generally rectangular bottom wall 732 with rounded corners, and a single upstanding peripheral wall 734 mating with the margins of bottom wall 732 to stand upright with four generally rectangular upstanding side wall portions 736, 737, 738 and 739. A hinged lid 740 is connected to the upper, or distal margin of side wall portion 736, and has a zipper 742 that is drawn about the remaining upper, or distal, edges of side wall portions 737, 738 and 739. Container 730 is of a size for holding commonly available plastic dishware 741 with sealable lids, of a kind suitable for holding hot soup. Lid 740 is pivotally moveable on its hinge between a closed position, as shown in FIG. 45, and an open position as shown in FIG. 44.

Figure 46:
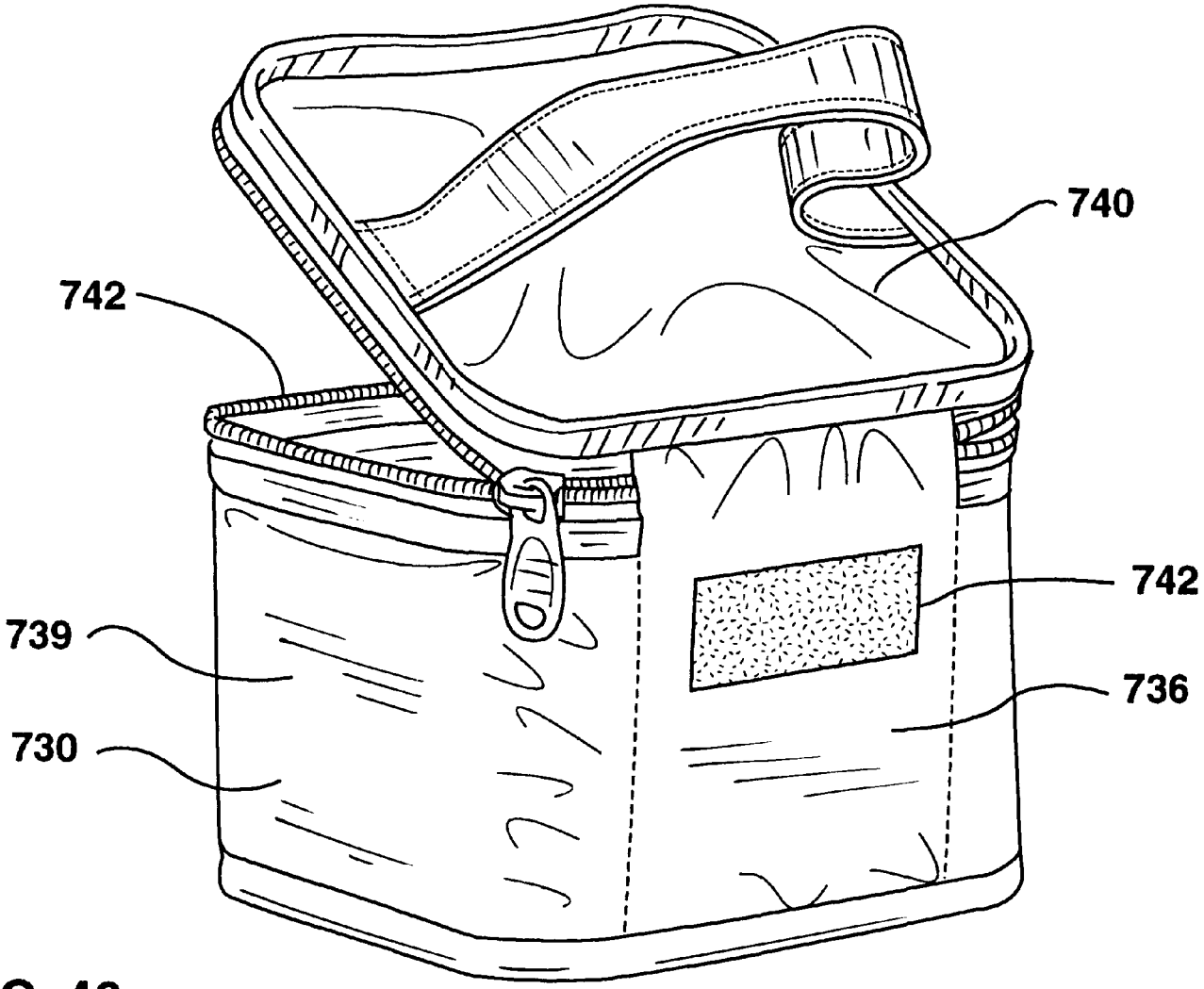
FIG. 46 is a rear perspective view of the secondary enclosure of FIG. 44.
Figure 47:
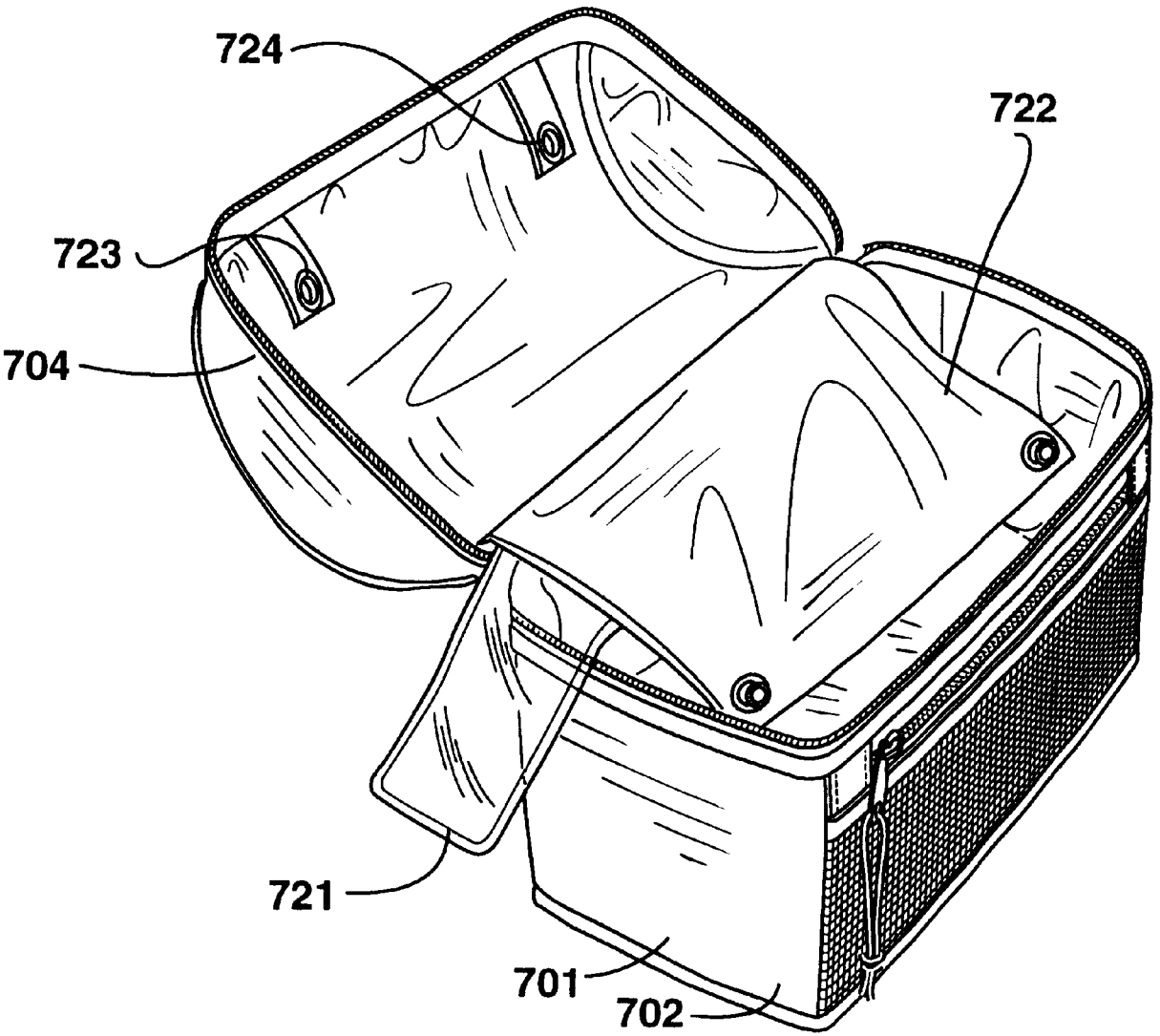
FIG. 47 is a perspective view of the primary chamber of FIG. 44 in an open position with an upper sling in a released condition.

As shown in FIG. 46, the rearward side of container 730 has a strip of hook-and-eye fastening material, indicated as 742, placed to mate with strip 711 when container 730 is mounted in place within container 701. In this way a releasable attachment fitting is provided that permits container 730 to be removed or installed, and, when installed, the releasable attachment fitting, by the co-operation of items 742 and 711, discourages relative motion of container 730 within lower portion 702. When a relatively dense, and heavy, object, such as a canned beverage, or a container of soup, is carried in a lunch box, and the lunch box is placed in a knap sack, or the lunch box is slung about, any adjacent soft object, such as a jam sandwich, for example, may tend to become deformed. The result is that by the time a child opens his or her lunch box, the soft food may no longer be in an overly appetizing condition. The use of an attachment means, whether a fitting in the nature of a hook-and-eye fabric fastener, as shown, or a zipper, or snaps, or an elasticized retainer cord, may tend to immobilize the heavier object, while still permitting the removal of the secondary container, 730, for packing, unpacking, or cleaning.

Figure 48:
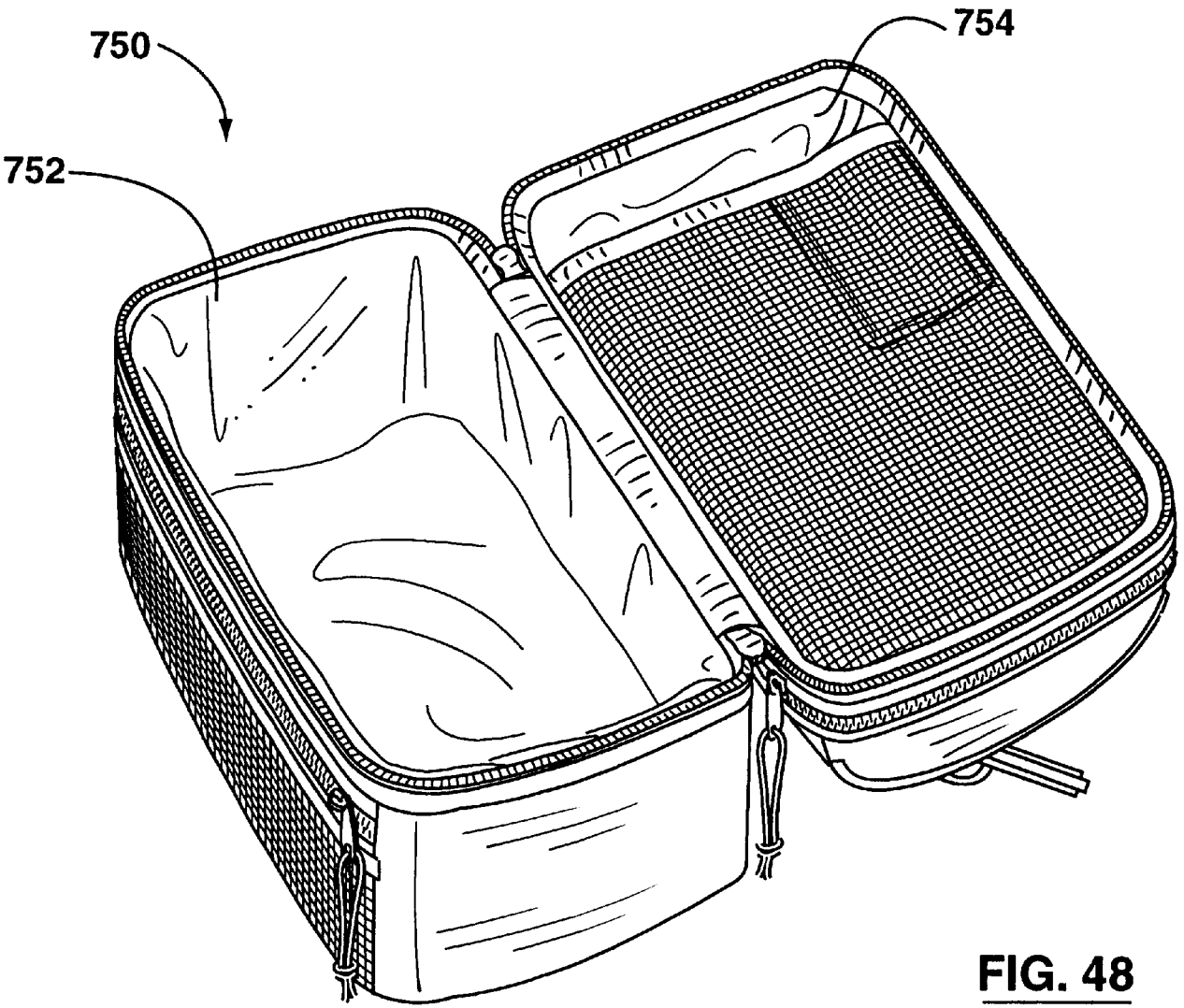
FIG. 48 is a perspective view of an alternative embodiment of assembly to the assembly of FIG. 32 with a lower chamber open.
Figure 49:
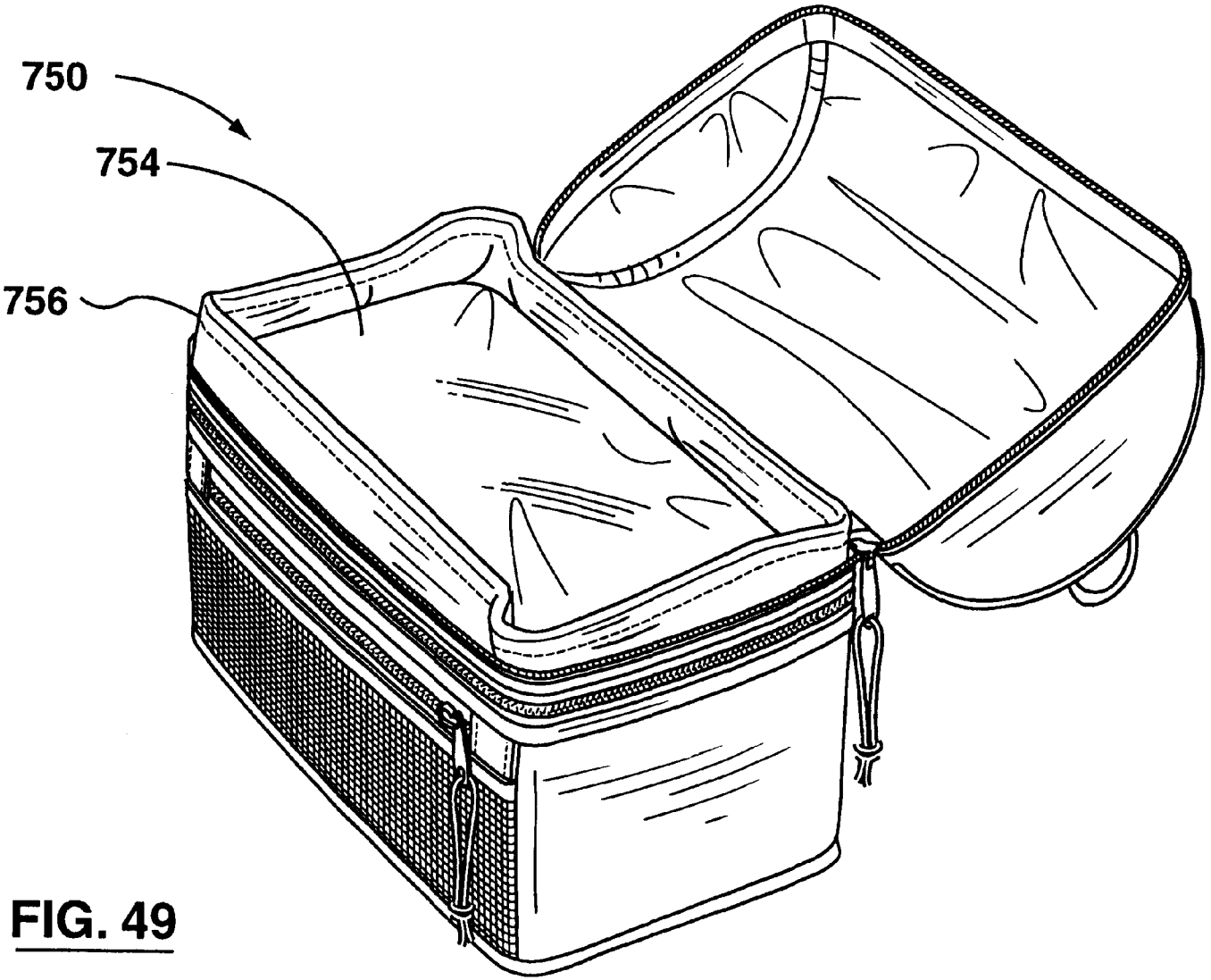
FIG. 49 is a perspective view of the assembly of FIG. 48 with an upper chamber open.

A further embodiment of container, generally similar to container assembly 600, is shown in FIGS. 48 and 49 as 750. Container assembly 750 differs from container assembly 600 in having a clear vinyl liner, similar to liner 706, overlying a reflective metallic inner surface of lower chamber 752, and in having a partition 754 whose upper peripheral lip 756 is more modest than that of container assembly 600, lip 756 being rough ⅜ inches high, rather than 1.5 inches high, and having a more rounded bead profile as opposed to a taller wall profile.

A preferred embodiment has been described in detail and a number of alternatives have been considered. As changes in or additions to the above described embodiments may be made without departing from the nature, spirit or scope of the invention, the invention is not to be limited by or to those details, but only by the appended claims.

I claim:

1. A soft sided insulated container comprising:

an insulated enclosure structure having an upper portion and a lower portion;

said lower portion having a bottom wall, a front wall, a rear wall, a first end wall and a second end wall co-operatively connected to define a first chamber;

said upper portion having a first end wall, a second end wall and a spanning wall co-operatively connected to define a second chamber;

a permanently attached partition mounted between said upper portion and said lower portion, said partition member having a periphery;

said lower portion having an upper margin matable with said periphery of said partition;

said upper portion having a lower margin matable with said periphery of said partition;

said enclosure structure having a first opening defined therein by which to obtain access to said first chamber, and a first closure member operable to inhibit access to said first chamber;

said enclosure structure having a second opening defined therein by which to obtain access to said second chamber, and a second closure member operable to inhibit access to said second chamber;

said end walls of said upper portion each having an upper edge having a downwardly concave profile;

said spanning wall conforming to said downwardly concave profile; and said partition fully closing off said first and second chambers from each other whereby said partition forms a bottom panel of said upper portion and a top panel of said lower portion.

2. The soft sided insulated container of claim 1 wherein said partition includes a mesh pocket member mounted thereto.

3. The soft sided insulated container of claim 1 further comprising a handle by which to carry said container, said handle being mounted to said spanning wall.

4. The soft sided insulated container of claim 1 wherein said soft sided insulated container has a center of gravity, and a carrying member is mounted to said container above said center of gravity.

5. The soft sided insulated container of claim 1 wherein a carrying strap is mounted to said upper portion of said container.

6. The soft sided insulated container of claim 1 wherein said container has a liner.

7. The soft sided insulated container of claim 1 wherein said bottom wall is rectangular, having a pair of long edges and a pair of short edges, said front and rear walls standing upwardly from said long edges.

8. The soft-sided insulated container of claim 1 wherein said upper portion of said container is hinged relative to said lower portion of said container, said upper portion being movable relative to said lower portion when said first closure member is moved to an open position to provide access to said first chamber through said first opening.

9. The soft-sided insulated container of claim 1 wherein said spanning wall conforms to said profile continuously from said first end wall of said upper portion to said second end wall of said upper portion.

10. A soft-sided insulated container comprising:

an upper portion and a lower portion;

said upper portion having, a rectangular bottom wall having a pair of short sides and a pair of long sides;

a pair of first and second opposed end walls each standing upwardly of one of said short sides of said bottom wall;

each of said end walls having an upper edge, said upper edges having a downwardly widening profile;

an intermediate wall having a front wall margin, a rear wall margin, and a top wall portion intermediate said front and rear wall margins;

said rectangular bottom wall being permanently connected to said rear wall margin;

said front wall margin and said rear wall margin being opposed and extending upwardly of respective first and second ones of said long sides of said bottom wall, between said end walls;

said top wall portion conforming to said profile of said upper edges of said end walls;

said top wall portion extending between said rear wall margin and said front wall margin;

said bottom wall, intermediate wall, and said first and second end walls defining a first chamber;

said insulated container having a first opening defined therein by which to obtain access to said first chamber, and a first closure member operable to inhibit access to said first chamber;

said lower portion has insulated wall members co-operating with said bottom wall of said upper portion to define a second insulated chamber; and said insulated container having a second opening defined therein by which to obtain access to said second chamber, and a second closure member operable to inhibit access to said second chamber.

11. The soft-sided insulated container of claim 10 wherein said bottom wall has a mesh pocket member mounted thereto.

12. The soft-sided insulated container of claim 10 wherein a thermal storage element is mounted therewithin.

13. The soft sided insulated container of claim 10 wherein a liner is mounted within one of said chambers.

14. The soft-sided insulated container of claim 10 wherein one of said walls of said upper portion has a reflective surface oriented toward said first chamber.

15. The soft-sided insulated container of claim 10 wherein said top wall portion and said front wall margin meet at said first closure member.

16. The soft-sided container of claim 10 wherein:

said wall members of said lower portion include a bottom wall member, a front wall member, a rear wall member and first and second end wall members, and said wall members co-operate to define an open topped box;

said front wall member, rear wall member and end wall members each have an upper margin;

said rear margin of said intermediate wall of said upper portion is hingedly connected to said upper margin of said rear wall member of said lower portion; and said second closure member is mounted to said upper margin of said front wall member and to said first long side of said bottom wall of said upper portion, said second closure member being operable to secure said upper portion in a closed position relative to said front wall member.

17. The soft-sided container of claim 10 wherein a suspension member is mounted to said top wall portion.

18. The soft-sided container of claim 10 wherein said container has a center of gravity, and a suspension member mounted thereto at a level above said center of gravity.

19. The soft-sided container of claim 10 wherein said container has a shoulder strap mounted thereto.

20. A soft sided insulated container assembly comprising:

a first soft-sided insulated wall structure having a rectangular base, and rectangular sides extending upwardly from said base, said first insulated wall structure having a first insulated chamber defined therewithin;

a second soft-sided insulated wall structure having a pair of end walls, said end walls having upper margins defining a lid contour, and a longitudinal wall extending between said end walls and conforming to said lid contour, said second soft-sided insulated wall structure defining a second insulated chamber therewithin;

an insulated divider mounted between said first and second insulated wall structures to segregate said first chamber from said second chamber;

said divider having a periphery, said second soft-sided insulated wall structure conforming to said periphery of said divider;

first and second closure members operable to control access to said first and second chambers; and said second insulated wall structure being located above said first insulated wall structure when said first chamber is in a closed position.

21. The soft-sided insulated container assembly of claim 20 wherein:

said rectangular sides of said first soft sided insulated wall structure have front and rear upper edges and first and second side upper edges;

said end walls of said second soft sided wall structure have respective first and second lower margins, said longitudinal wall has a front lower margin and a rear lower margin;

said insulated divider is attached to said end wall first and second lower margins and said front and rear lower margins of said longitudinal wall;

said rear lower margin of said longitudinal wall is hingedly connected relative to said rear upper edge of said first soft sided insulated wall structure;

said first closure member of said first soft sided insulated wall structure is mounted to said front upper edge and to a corresponding front portion of said periphery of said divider; and when said first closure member is in an open position, said first soft-sided insulated wall structure being hingedly displaceable relative to said second soft-sided insulated wall structure.

22. The soft-sided insulated container assembly of claim 20 wherein said soft-sided container has a center of gravity, and a carrying member is mounted to said container above said center of gravity, whereby when carried by said carrying member, said first chamber hangs below said second chamber.

23. The soft-sided container assembly of claim 20 wherein a handle by which to carry said container is mounted to said second soft sided wall structure whereby, when carried by said handle, said first chamber hangs below said second chamber.

24. The soft-sided container assembly of claim 20 wherein a carrying strap is mounted to said second soft sided wall structure whereby when carried by said strap, said first chamber hangs below said second chamber.

25. The soft-sided container assembly of claim 20 wherein said insulated divider has a receptacle mounted thereto, said receptacle having an interior for receiving a thermal energy storage element, said receptacle having a vented portion to permit air from one of said chambers to communicate with said interior.

26. The soft-sided container assembly of claim 25 wherein a thermal energy storage element is mounted within said receptacle.

27. The soft-sided container assembly of claim 25 wherein said vented portion is oriented to face said first chamber.

28. The soft-sided container of claim 20 wherein a liner is mounted within one of said first and second chambers.

29. A soft sided insulated container assembly comprising:

a first soft-sided insulated wall structure having a rectangular base, and rectangular sides extending upwardly from said base, said first insulated wall structure having a first insulated chamber defined therewithin;

a second soft-sided insulated wall structure having a pair of end walls, said end walls each having upper margins having a downwardly concave profile, and a longitudinal wall extending between said end walls and conforming to said downwardly concave profile, said second soft-sided insulated wall structure defining a second insulated chamber therewithin;

an insulated divider mounted between said first and second insulated wall structures to segregate said first chamber from said second chamber;

openings to provide access to said first and second chambers, said openings each having a closure member attached thereto, said closure members being operable to maintain said chambers in a closed position or an open position; and said second insulated wall structure being located above said first insulated wall structure when said first chamber is in the closed position thereof.

* * * * *